US009195198B2

(12) United States Patent
Masuda

(10) Patent No.: US 9,195,198 B2
(45) Date of Patent: Nov. 24, 2015

(54) IMAGE FORMING APPARATUS

(71) Applicant: Koji Masuda, Kanagawa (JP)

(72) Inventor: Koji Masuda, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 172 days.

(21) Appl. No.: 13/828,069

(22) Filed: Mar. 14, 2013

(65) Prior Publication Data

US 2013/0243446 A1 Sep. 19, 2013

(30) Foreign Application Priority Data

Mar. 19, 2012 (JP) ..... 2012-061941
May 9, 2012 (JP) ..... 2012-107861

(51) Int. Cl.
*G03G 15/00* (2006.01)
*G03G 15/01* (2006.01)

(52) U.S. Cl.
CPC ..... *G03G 15/6558* (2013.01); *G03G 15/0189* (2013.01); *G03G 15/5058* (2013.01)

(58) Field of Classification Search
CPC ..... G03G 15/00; G03G 15/6558; G03G 15/0189; G03G 15/5058
USPC ..... 399/49, 72, 301, 303
See application file for complete search history.

(56) References Cited

U.S. PATENT DOCUMENTS 6,735,401 B2 * 5/2004 Kajiwara et al. ..... 399/49
8,699,899 B2 * 4/2014 Murayama ..... 399/49
2003/0068180 A1 * 4/2003 Kaji ..... 399/301
2006/0257177 A1 * 11/2006 Kim et al. ..... 399/301
2009/0220263 A1 * 9/2009 Murayama ..... 399/49
2009/0238590 A1 9/2009 Masuda
2010/0008686 A1 1/2010 Masuda et al.
2010/0080603 A1 * 4/2010 Takahashi ..... 399/72
2010/0232817 A1 * 9/2010 Miyadera et al. ..... 399/40
2010/0266302 A1 10/2010 Suzuki et al.
2010/0310284 A1 12/2010 Funato et al.
2011/0043810 A1 2/2011 Suzuki et al.
2011/0044713 A1 2/2011 Masuda et al.
2011/0123202 A1 * 5/2011 Mori ..... 399/16
2012/0163880 A1 * 6/2012 Kuroki et al. ..... 399/301
2012/0268750 A1 10/2012 Masuda
2013/0004194 A1 * 1/2013 Shirasaki et al. ..... 399/71
2014/0079443 A1 * 3/2014 Nanai ..... 399/301

FOREIGN PATENT DOCUMENTS

JP 2002023444 A * 1/2002 ..... G03G 15/00
JP 2003-241472 8/2003
JP 2007065262 A * 3/2007 ..... G03G 15/00

(Continued)

*Primary Examiner* — Nguyen Ha
(74) *Attorney, Agent, or Firm* — Oblon, McClelland, Maier & Neustadt, L.L.P.

(57) ABSTRACT

An image forming apparatus forms, on a surface of a moving member moving in a first direction, an image under an image forming condition in accordance with image information. The image forming apparatus includes: a reflection-type optical sensor including an emission system including a plurality of light-emitting units arranged in a second direction perpendicular to the first direction and a light-receiving system including a plurality of light-receiving units that receive reflected light resulting from reflection of emission light emitted from the emission system at the surface of the moving member; and a determination device that determines whether there is an abnormality on the surface of the moving member on the basis of output signals from at least two or more light-receiving units.

15 Claims, 42 Drawing Sheets

(56) References Cited

FOREIGN PATENT DOCUMENTS

| | | | | | |
|---|---|---|---|---|---|
| JP | 2009-216930 | 9/2009 | | | |
| JP | 2010-039460 | 2/2010 | | | |
| JP | 2010-048906 | 3/2010 | | | |
| JP | 2011169955 A | * | 9/2011 | ..... | G03G 15/00 |

* cited by examiner

IMAGE FORMING APPARATUS

CROSS-REFERENCE TO RELATED APPLICATIONS

The present application claims priority to and incorporates by reference the entire contents of Japanese Patent Application No. 2012-061941 filed in Japan on Mar. 19, 2012 and Japanese Patent Application No. 2012-107861 filed in Japan on May 9, 2012.

BACKGROUND OF THE INVENTION

1. Field of the Invention

The present invention relates to an image forming apparatus that forms an image on a moving member.

2. Description of the Related Art

An image forming apparatus having an image forming unit using laser light is known as an image forming apparatus for obtaining a high resolution image. An image forming method of this image forming apparatus includes rotating a drum while using an optical scanning device to scan laser light on the photosensitive drum in an axial direction, thereby forming a latent image on a surface of the drum, and forming a toner image by causing toner to be attracted to the latent image, and transferring the toner image onto paper. In this kind of image forming apparatus, the toner image on the drum needs to be formed at an appropriate position with respect to the paper onto which the toner image is to be transferred.

In particular, in a color image forming apparatus which forms multi-image and color image by overlaying multiple toner images of which colors are different from each other, failure to adjust the toner image of each color to an appropriate position with respect to paper results in various kinds of abnormal image output. The abnormal image output includes, for example, deviation of registration which is deviation of the positions where the color images are written, deviation of magnification rate which causes size error of each color image, and deviation of color due to deviation of positions of multiple toner images relative to each other.

Therefore, when a color image is formed, it is necessary, in particular, to find and adjust appropriately the positions where the toner images are transferred, for each of the toner images for each color. In order to do this, it is necessary to detect the position of the toner image and if it is deviated from the appropriate position, it is necessary to perform control to adjust this, so that the transfer position of the toner image is maintained at the appropriate position.

A known method for appropriately controlling the position of the toner image includes a method for forming a test pattern for position detection on the moving member on which the toner image is formed, and calculating the toner image position by detecting the position of the test pattern. In this method, light is emitted onto the moving member, and calculation is performed with predetermined algorithm using detection information of reflected light from the test pattern, so that the position of the toner image is obtained. Another method is known, in which a test patch for density detection is formed on a moving member, and calculation is performed by predetermined algorithm using detection information of reflected light from the test patch (the amount of received light), so that the density of the image is obtained.

Various kinds of reflection-type optical sensors are known as sensors for receiving reflected light from "the test pattern for the position detection" and "the patch for the density detection".

For example, an image forming apparatus is known, that uses a reflection-type optical sensor of a type having one light-emitting unit (for example, LED) and one light-receiving unit (for example, PD), and can find the toner image position and the density in accordance with the above image forming method (for example, see Japanese Patent Laid-open No. 2003-241472).

The image forming apparatus of Japanese Patent Laid-open No. 2003-241472 uses a reflection-type optical sensor in order to detect the test pattern for the position detection. The test pattern detection method by the image forming apparatus is as follows. Light emitted by a light-emitting unit provided in a reflection-type optical sensor is radiated upon the test pattern for the position detection formed on a moving member (for example intermediate transfer belt), and light reflected by the portion of the moving member and the light reflected by the portion of the test pattern to which the toner is attached are detected from among the emission light.

Due to scatter and absorption by the toner, the amount of reflected light decreases in the light reflected by the portion of the test pattern. Therefore, the magnitude of an output signal of the light-receiving unit caused by the amount of reflected light in the portion of the moving member is different from the magnitude of an output signal of the light-receiving unit caused by the amount of reflected light in the portion of the test pattern. Accordingly, the test pattern can be detected by determining whether the output signal of the light-receiving unit crosses a reference threshold level (threshold value) or not.

Not only the image forming apparatus of Japanese Patent Laid-open No. 2003-241472 but also an image forming apparatus using a reflection-type optical sensor for detecting toner density required for image formation control is known (for example, see Japanese Patent Laid-open No. 2009-216930). This image forming apparatus detects the test pattern, using one LED as a light-emitting unit and causing a light-receiving unit, made of two photodiodes, to receive the reflected light of the light emitted from the LED onto the test pattern.

The image forming apparatus of Japanese Patent Laid-open No. 2009-216930 uses a reflection-type optical sensor for control of density of an image. However, when light emitted from one LED in the reflection-type optical sensor is radiated upon the patch for the density detection, and the portion of one photodiode (PD) receiving the regular-reflected light is shared, the test pattern for the position detection can be detected, and the position of the image can be controlled on the basis of the detected information. In such reflection-type optical sensor, there is only one light spot on the moving member which illuminates the test pattern, and the size thereof is 2 to 3 mm.

In general, the size of the test pattern for the position detection is 15 mm or more in a direction (main scanning direction) perpendicular to a moving direction (sub-scanning direction) of a moving member on which the test pattern is formed (for example, intermediate transfer belt). In general, the size thereof in the sub-scanning direction is about 1 to 2 mm. On the other hand, the size of the patch for the density detection is 15 mm or more in the main scanning direction, and is also 15 mm or more in the sub-scanning direction.

The size of the test pattern in the main scanning direction is 15 mm or more, which is larger than the size of the light spot in the same direction, so that even if there is relative error in the position of the test pattern and the position of the light spot, the test pattern can be illuminated with the light spot.

The relative position error is considered to include (1) emission position error in the main scanning direction caused by deviation of the light emission direction due to, e.g., attachment error of the reflection-type optical sensor and attachment error of the light-emitting unit, and (2) position error in the main scanning direction of the test pattern caused by meandering of, e.g., an intermediate transfer belt and a photosensitive drum, and test pattern formation deviation of the position.

By the way, the toner used to form the test pattern is non-affecting toner that does not affect image formation originally. Therefore, when the size of the test pattern increases, the amount of consumed non-affecting toner increases in proportional thereto, and therefore, this increases running cost relating to image formation.

Accordingly, in order to reduce the amount of consumed non-affecting toner, it is required to reduce the size of the test pattern and the like.

However, there is a limitation in reduction of the test pattern. This is because even if there is a relative error between the position where the test pattern is formed and the position of the spot of the emitted light (light spot), the size of the test pattern needs to be of a certain size or larger in order to enable the above detection. For example, the size of the test pattern in the main scanning direction needs to be larger than the light spot. In this manner, in the image forming apparatus of Japanese Patent Laid-open No. 2003-241472 and Japanese Patent Laid-open No. 2009-216930, the test pattern needs to be formed to have a certain size or larger because of the necessity of ensuring the margin for the position error of the light spot.

An image forming apparatus is known, which solves these problems (for example, see Japanese Patent Laid-open No. 2010-039460). This image forming apparatus uses a reflection-type optical sensor having three or more light-receiving units and three or more light-emitting units, thus capable of detecting an appropriate position even if the test pattern is smaller than a conventional one.

According to the position detection method of the test pattern using a reflection-type optical sensor with the image forming apparatus of Japanese Patent Laid-open No. 2010-039460, an accurate position of the test pattern can be derived from calculation even if the light spot is reduced. More specifically, reflected light from the test pattern is captured by multiple light-receiving units, and the position of the test pattern is calculated from output distribution of the multiple light-receiving units, so that even if the test pattern is small, the accurate position can be detected.

However, even with the position detection of the test pattern using the reflection-type optical sensor with the image forming apparatus described in Japanese Patent Laid-open Nos. 2003-241472, 2009-216930, and 2010-048906, there is the following drawback: when there are, e.g., a scratch or a stain on the moving member such as an intermediate transfer belt, the scratch or stain may be falsely detected as the test pattern. When light is emitted onto the scratch or stain formed on the moving member, the reflected light thereof may be attenuated like the case of the toner image.

An image forming apparatus is known, that solves the above problems (for example, see Japanese Patent Laid-open No. 2010-048906). Even when there is a scratch or stain on the moving member, the image forming apparatus has multiple threshold level set for the amounts of received lights received by multiple reflection-type sensors so as to allow appropriate detection of a pattern for position detection, and the position of the test pattern is detected by determining whether the number of test patterns for the position detection known in advance matches the number of signals crossing a threshold level.

However, there still exists a problem in the position detection of the test pattern described in Japanese Patent Laid-open No. 2010-048906. More specifically, when the attenuation of the reflected light with the test pattern is close to the attenuation of the reflected light due to a scratch or a stain of the moving member, it is impossible to determine whether the scratch or the test pattern has caused a signal crossing the threshold level, and therefore, correct determination cannot be made.

As described above, the image forming apparatus of any one of Japanese Patent Laid-open Nos. 2003-241472, 2009-216930, 2010-039460, and 2010-048906 makes false detection of the position of the test pattern due to a scratch or stain of the moving member, and cannot distinguish the test pattern from the scratch on the basis of the output signal of the light-receiving unit.

A method for making determination on the basis of a time at which the output signal crosses the threshold level, instead of relying on the intensity of the output signal (the magnitude of the amount of received light). However, when the output signal based on one light-receiving unit is greatly different from the time interval calculated from the known test pattern interval, it is impossible to determine whether this is caused by great deviation of the position or a scratch or stain.

When detection error such as false detection occurs, it is necessary to carry out the position detection again, and there is a down time. If false detection of the deviation of the position result is received and image forming condition, image is adjusted, the quality may be reduced.

In view of the above, there is a need to provide an image forming apparatus that can correctly detect a test pattern for position detection and make appropriate adjustment so as not to cause abnormal image such as color deviation even if there is a scratch or a stain on a surface of a moving member.

SUMMARY OF THE INVENTION

It is an object of the present invention to at least partially solve the problems in the conventional technology.

An image forming apparatus forms, on a surface of a moving member moving in a first direction, an image under an image forming condition in accordance with image information. The image forming apparatus includes: a reflection-type optical sensor including an emission system including a plurality of light-emitting units arranged in a second direction perpendicular to the first direction and a light-receiving system including a plurality of light-receiving units that receive reflected light resulting from reflection of emission light emitted from the emission system at the surface of the moving member; and a determination device that determines whether there is an abnormality on the surface of the moving member on the basis of output signals from at least two or more light-receiving units.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
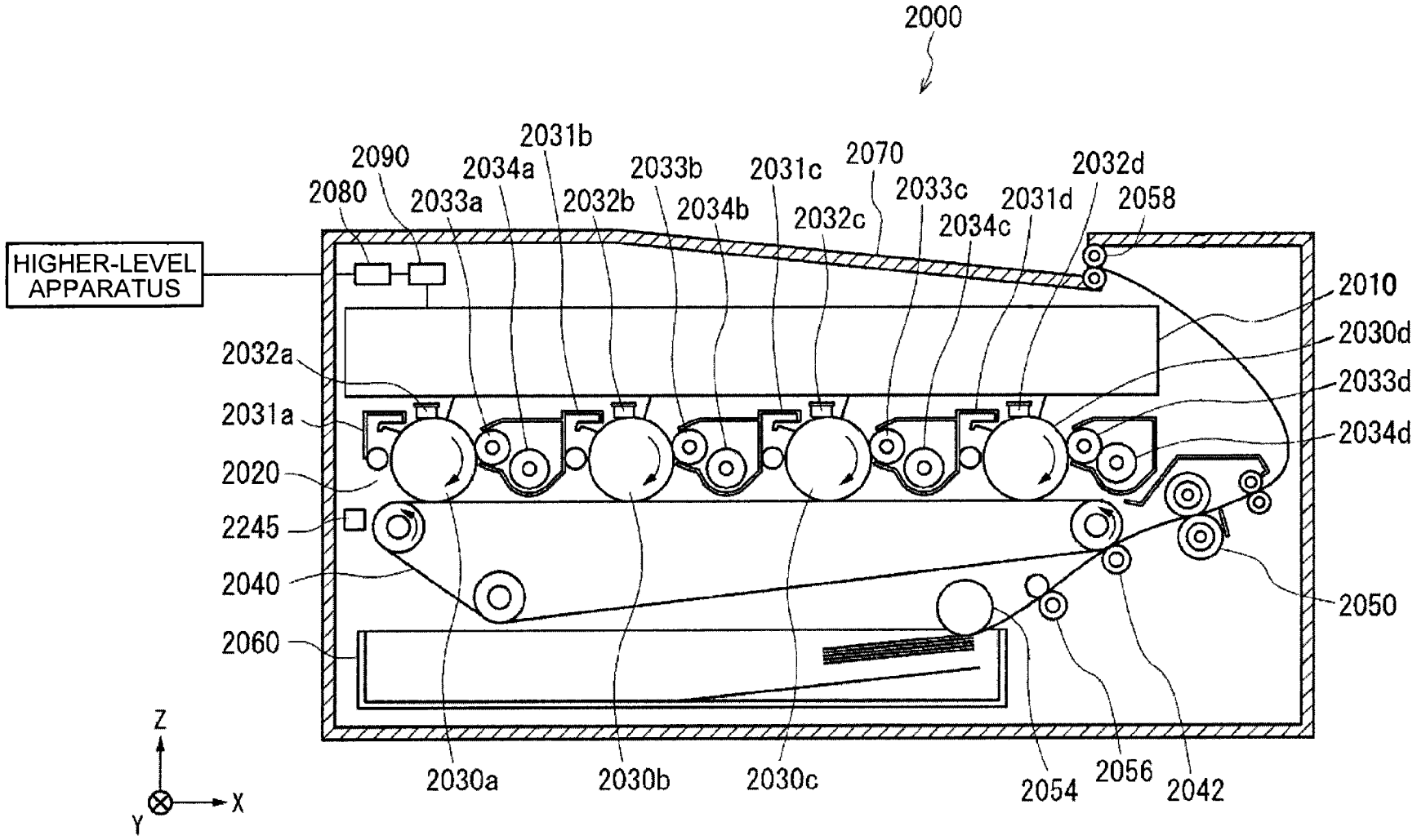
FIG. 1 is a schematic diagram illustrating an embodiment of an image forming apparatus according to the present invention.

Hereinafter, an embodiment of an image forming apparatus according to the present invention will be explained with reference to drawings. First, a configuration of a color printer which is an example of the image forming apparatus according to the present invention will be explained. FIG. 1 is a schematic diagram illustrating a configuration of a color printer 2000.

First Embodiment of Image Forming Apparatus

In FIG. 1, the color printer 2000 is a tandem-type multicolor printer for forming a full-color image by overlaying four colors (magenta, black, cyan, yellow), and includes an optical scanning device 2010, four photosensitive drums (2030*a*, 2030*b*, 2030*c*, 2030*d*), four cleaning units (2031*a*, 2031*b*, 2031*c*, 2031*d*), four charging devices (2032*a*, 2032*b*, 2032*c*, 2032*d*), four developing rollers (2033*a*, 2033*b*, 2033*c*, 2033*d*), four toner cartridges (2034*a*, 2034*b*, 2034*c*, 2034*d*), which correspond to respective colors, and includes an intermediate transfer belt 2040, transfer roller 2042, a fixing device 2050, a sheet feeding roller 2054, a registration roller pair 2056, a discharging roller 2058, a paper feed tray 2060, a discharge tray 2070, a communication control device 2080, an image sensor 2245, and a printer control device 2090 for centrally controlling each of the above units.

An image forming station 2020 is constituted by the four photosensitive drums (2030*a*, 2030*b*, 2030*c*, 2030*d*), the four cleaning units (2031*a*, 2031*b*, 2031*c*, 2031*d*), four charging device (2032*a*, 2032*b*, 2032*c*, 2032*d*), the four developing rollers (2033*a*, 2033*b*, 2033*c*, 2033*d*), and the four toner cartridges (2034*a*, 2034*b*, 2034*c*, 2034*d*), which are provided in the color printer 2000.

In the description below, when the same matter is explained in the explanation about members of each image forming station forming images of different colors, only a numeral portion of a reference symbol indicating each member is used to indicate the member, and an alphabet attached subsequent to the numeral may be omitted.

A three-dimensional coordinate system as illustrated in FIG. 1 is used as a coordinate system used to indicate relationship of the position of each member constituting the color printer 2000. The coordinate system includes X axis, Y axis, Z axis. An axis along a longitudinal direction (rotation axis direction) of the photosensitive drum 2030 is defined as a Y axis. An axis perpendicular to the Y axis along an arrangement direction of the photosensitive drum 2030 is defined as an X axis. A direction perpendicular to the Y axis and the X axis is defined as a Z axis.

The direction of the axes are denoted as "X axis direction", "Y axis direction", "Z axis direction". A direction pointed by an arrow of each axis is denoted as a positive direction, and a direction opposite to the direction pointed by the arrow of each axis is denoted as a negative direction. For example, the image sensor 2245 is indicated as being arranged in –X direction of the intermediate transfer belt 2040.

Communication Control Device

The communication control device 2080 controls bidirectional communication to/from a higher-level apparatus (for example, personal computer, scanner) via a network and the like, and controls bidirectional communication to/from an information apparatus (for example, facsimile machine) via a public line. The communication control device 2080 notifies the received information to the printer control device 2090.

Printer Control Device

Figure 2:
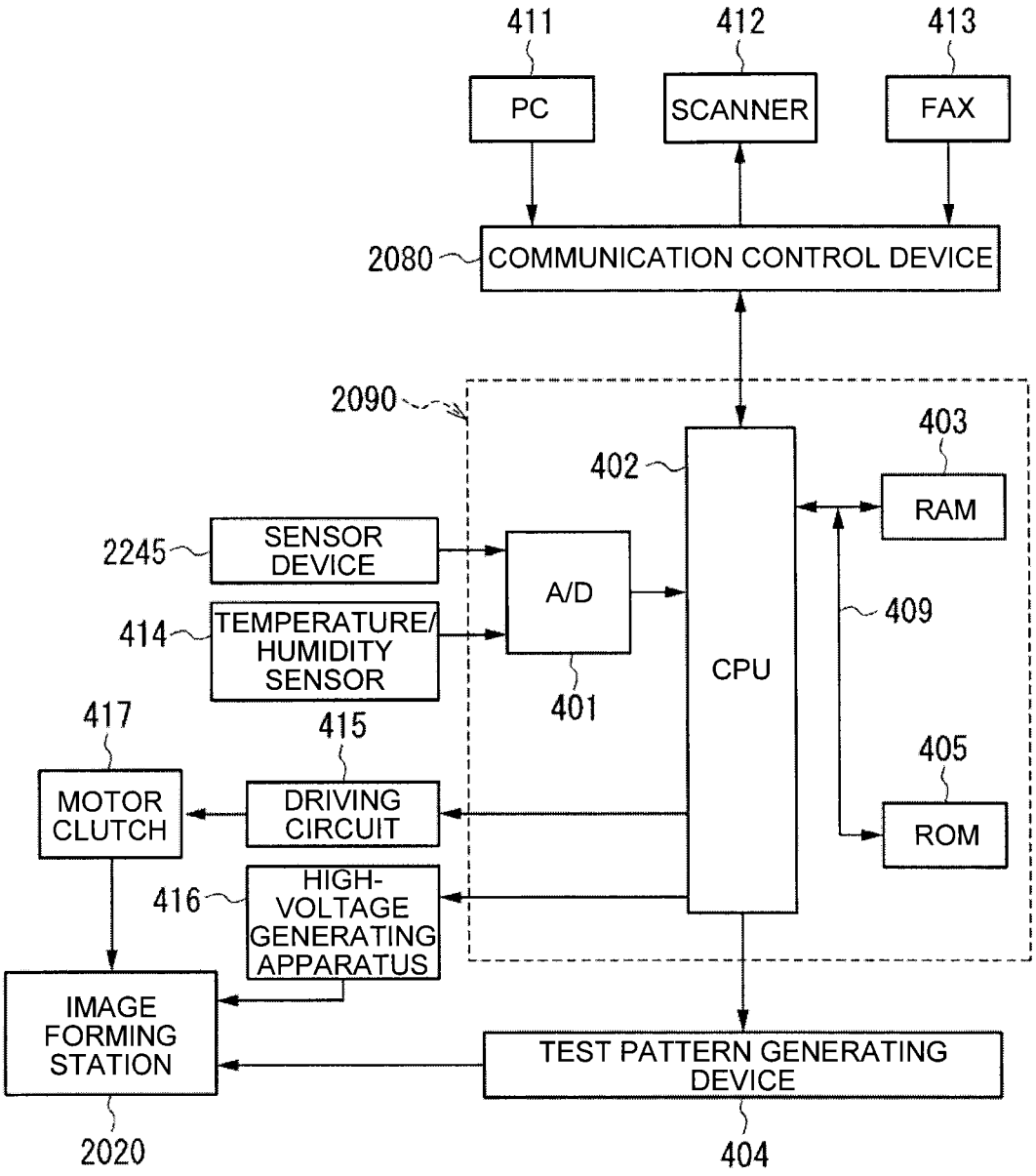
FIG. 2 is a control block diagram of a printer control device provided in the image forming apparatus.

Subsequently, an example of configuration of the printer control device 2090 will be explained with reference to FIG. 2. In FIG. 2, a printer control device 2090 as indicated by a broken line includes a CPU 402 executing driving control of various units and various calculation operations which is connected via a bus line 409 to a ROM 405 storing fixed data such as computer programs in advance and a RAM 403 serving as a storage device functioning as a work area and the like for storing various kinds of data in a rewritable manner, and includes an A/D conversion circuit 401 for converting various kinds of analogue input signals into digital signals. A first processing device and a second processing device executing various kinds of processing explained later (for example, correction processing of abnormal output, storage processing of abnormal output, and correction processing based on stored abnormal output) include the computer programs stored in the ROM 405 and the CPU 402 performing the arithmetic processing.

The ROM 405 stores forming position and density information about the test pattern required to generate the test pattern explained later, bias condition for forming the gradation of the test pattern, and density conversion information about a reflection-type optical sensor output for estimating the toner density of the test pattern. The printer control device 2090 is connected to the communication control device 2080, which transmits image information, as integrated image data, given from a higher-level apparatus such as a PC 411, a scanner 412, and a FAX 413, to the printer control device 2090.

The CPU 402 is also connected to a driving circuit 415 for driving a motor and a clutch 417, a high-voltage generating apparatus 416 for generating voltage required for image formation, and a temperature/humidity sensor 414 for detecting the temperature and the humidity in the color printer 2000.

For example, when image information given by the PC 411 is printed, a printer driver of the PC 411 is used to transmit the image information. The communication control device 2080 transmits print information from the printer driver to the CPU 402, and the CPU 402 drives the driving unit via the driving circuit 415, transmits a signal to the image forming station 2020, and the image forming station 2020 executes image forming process explained later.

An output signal of the image sensor 2245 is input into the A/D conversion circuit 401. The A/D conversion circuit 401 converts a signal from the image sensor 2245 into digital data. The CPU 401 performs detection processing of the deviation of the position explained later, using the digital data based on the output signal given by the image sensor 2245.

M (Magenta) Image Forming Station

Subsequently, detailed configuration of the image forming station 2020 provided in the color printer 2000 will be explained with reference to FIG. 1 further in details. In FIG. 1, the image forming station 2020 forming an image of magenta color includes a photosensitive drum 2030*a*, a charging device 2032*a*, a developing roller 2033*a*, a toner cartridge 2034*a*, and a cleaning unit 2031*a*. Using them as a set, the image forming station (hereinafter referred to as "M station") for forming an image of magenta color is constituted.

K (Black) Image Forming Station

The image forming station 2020 forming an image in black includes a photosensitive drum 2030*b*, a charging device 2032*b*, a developing roller 2033*b*, a toner cartridge 2034*b*, and a cleaning unit 2031*b*. Using them as a set, the image forming station (hereinafter referred to as "K station") for forming an image in black is constituted.

C (Cyan) Image Forming Station

The image forming station 2020 forming an image of cyan color includes a photosensitive drum 2030*c*, a charging device 2032*c*, a developing roller 2033*c*, a toner cartridge 2034*c*, and a cleaning unit 2031*c*. Using them as a set, the image forming station (hereinafter referred to as "C station") for forming an image of cyan color is constituted.

Y (Yellow) Image Forming Station

The image forming station 2020 forming an image in yellow includes a photosensitive drum 2030*d*, a charging device 2032*d*, a developing roller 2033*d*, a toner cartridge 2034*d*, and a cleaning unit 2031*d*. Using them as a set, the image forming station (hereinafter referred to as "Y station") for forming an image in yellow is constituted.

Subsequently, each member constituting each image forming station 2020 will be explained. As described above, the image forming station 2020 is provided to correspond to each of the four colors forming an image, and the same reference numerals are given to members having the same function and configuration. Alphabetical symbol given subsequently to the reference numerals of each member constituting the image forming station 2020 are as follows: "a" denotes a member related to the M station, "b" denotes a member related to the K station, "c" denotes a member related to the C station, and "d" denotes a member related to the Y station. In the following explanation about each member, the alphabetical symbols are omitted.

Photosensitive Drum

Each of the photosensitive drums 2030 corresponding to the colors has a photosensitive layer formed on the surface thereof. The surface of each of the photosensitive drums 2030 is a surface scanned by the optical scanning device 2010 in the optical scanning. Each photosensitive drum 2030 is rotated by a rotation driving mechanism in a clockwise direction within an X-Z plane which is seen in the Y axis direction as illustrated in FIG. 1.

Cleaning Unit

The cleaning unit 2031 removes the toner remaining on the surface of the corresponding photosensitive drum 2030 (residual toner). The surface of the photosensitive drum 2030 from which the residual toner is removed returns back to the position facing the corresponding charging device 2032.

Charging Device

The charging devices 2032 corresponding to the colors are devices for uniformly charging the surfaces of the corresponding photosensitive drums 2030.

Developing Roller

On the surface of the developing roller 2033, toner given from the corresponding toner cartridge 2034 is uniformly applied in a thin manner in accordance with the rotation of the developing roller 2033. Then, when the toner applied to the surface of the developing roller 2033 comes into contact with the surface of the corresponding photosensitive drum 2030, the toner moves to and attaches to only the portion of the surface on which the light explained later is emitted. More specifically, the developing roller 2033 is a member for development by attaching toner to the latent image formed on the surface of the corresponding photosensitive drum 2030. The image attached with the toner (toner image) moves in a direction of the intermediate transfer belt 2040 in accordance with the rotation of the photosensitive drum 2030.

Optical Scanning Device

Subsequently, the optical scanning device 2010 for forming the latent image for forming the toner image on the surface of the photosensitive drum 2030 will be explained. The optical scanning device 2010 emits light beam, which is modulated for each color, onto the surface of the corresponding photosensitive drum 2030 which has been charged, on the basis of the multi-color image information (magenta (M) image information, black (K) image information, cyan (C) image information, yellow (Y) image information) given by the printer control device 2090. With the light emitted onto the charged surface, electrical charge is lost only in the portion of the surface where the light has been emitted, so that the latent image corresponding to the image information for each color is formed. The latent image formed here moves in the direction of the corresponding developing roller 2033 in accordance with the rotation of the photosensitive drum 2030.

Intermediate Transfer Belt

In the image forming station 2020 having the above configuration, the toner image of each color formed on the photosensitive drum 2030 of each station is successively transferred onto the intermediate transfer belt 2040 with predetermined timing, and the toner images are overlaid, so that the multi-colored color image is formed. As illustrated in FIG. 1, while the intermediate transfer belt 2040 moves in −X direction, and the toner image formed is transferred thereon in the Y station, and thereafter, the toner images formed by the C station, the K station, and the M station, in this order, are successively transferred thereon. The direction in which the intermediate transfer belt 2040 moves is referred to as a sub-scanning direction. A direction which is perpendicular to the sub-scanning direction and is along the Y axis is referred to as a main scanning direction.

Paper Feed Tray

The paper feed tray 2060 contains recording sheets, and in proximity to the paper feed tray 2060, the sheet feeding roller 2054 is provided. The sheet feeding roller 2054 is a member for retrieving each recording sheet from the paper feed tray 2060, and conveying the recording sheet to the registration roller pair 2056. The registration roller pair 2056 feeds, with predetermined timing, the recording sheet to a gap between the intermediate transfer belt 2040 and the transfer roller 2042. Then, the color image on the intermediate transfer belt 2040 is transferred by the transfer roller 2042 onto the recording sheet. The recording sheet subjected to transferring here is conveyed to the fixing device 2050.

Fixing Device

The fixing device 2050 applies heat and pressure to the recording sheet. With the heat and the pressure, the toner is fixed onto the recording sheet. The recording sheet on which the toner is fixed is conveyed via the discharging roller 2058 to the discharge tray 2070, and is successively stacked on the discharge tray 2070.

Image Sensor

The image sensor 2245 is a sensor for detecting the test pattern formed on the intermediate transfer belt 2040, and is provided in proximity to the position where the intermediate transfer belt 2040 moves in the sub-scanning direction and turns back in the direction away from the photosensitive drum 2030. On the basis of the coordinate system illustrated in FIG. 1, the image sensor 2245 is provided in proximity to the end portion of the intermediate transfer belt 2040 in the −X direction. This image sensor 2245 will be explained in detail later.

Configuration of Optical Scanning Device 2010

Figure 3:
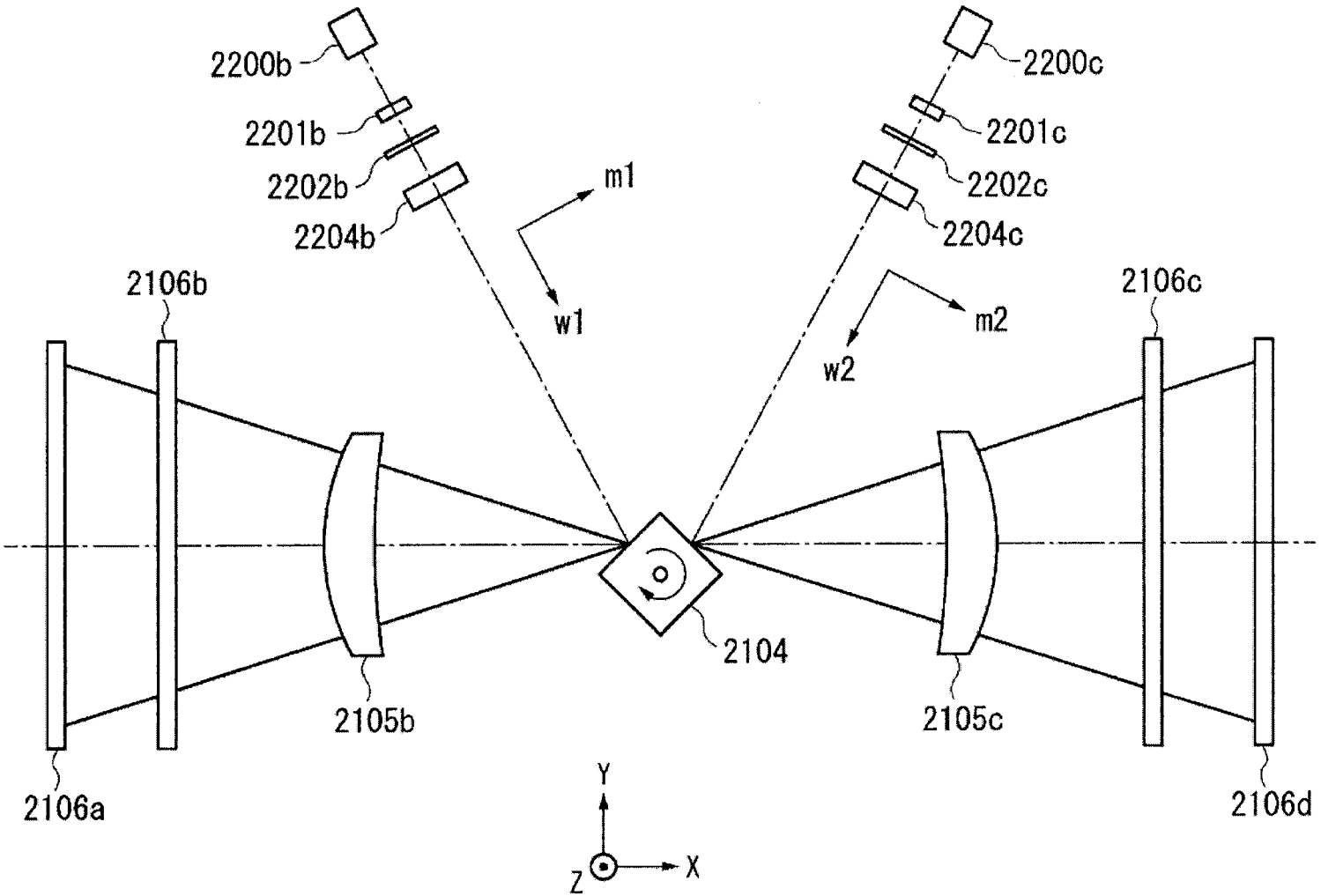
FIG. 3 is an optical arrangement diagram illustrating an optical scanning device provided in the image forming apparatus when it is seen in a main scanning direction.
Figure 4:
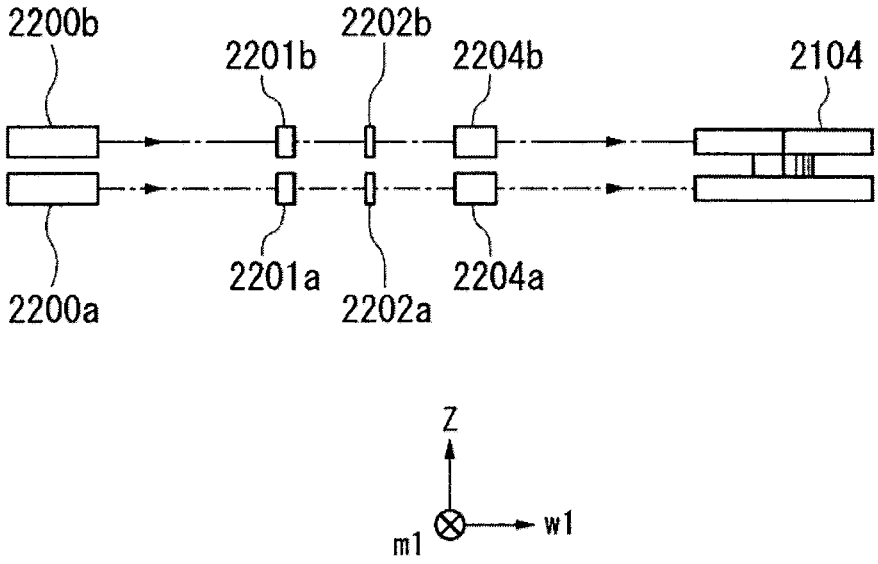
FIG. 4 is an optical arrangement diagram illustrating a portion of the optical scanning device when it is seen in a sub-scanning direction.
Figure 5:
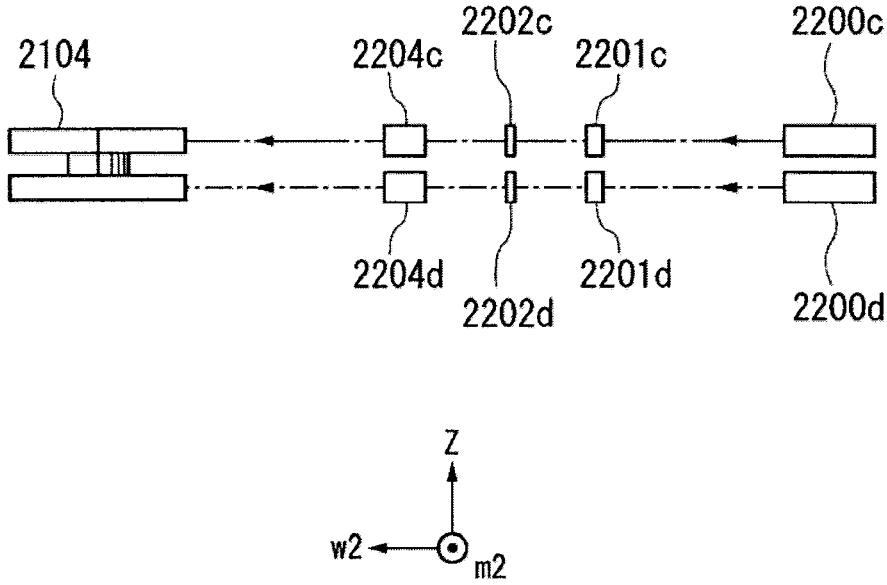
FIG. 5 is an optical arrangement diagram illustrating another portion of the optical scanning device when it is seen in a sub-scanning direction.
Figure 6:
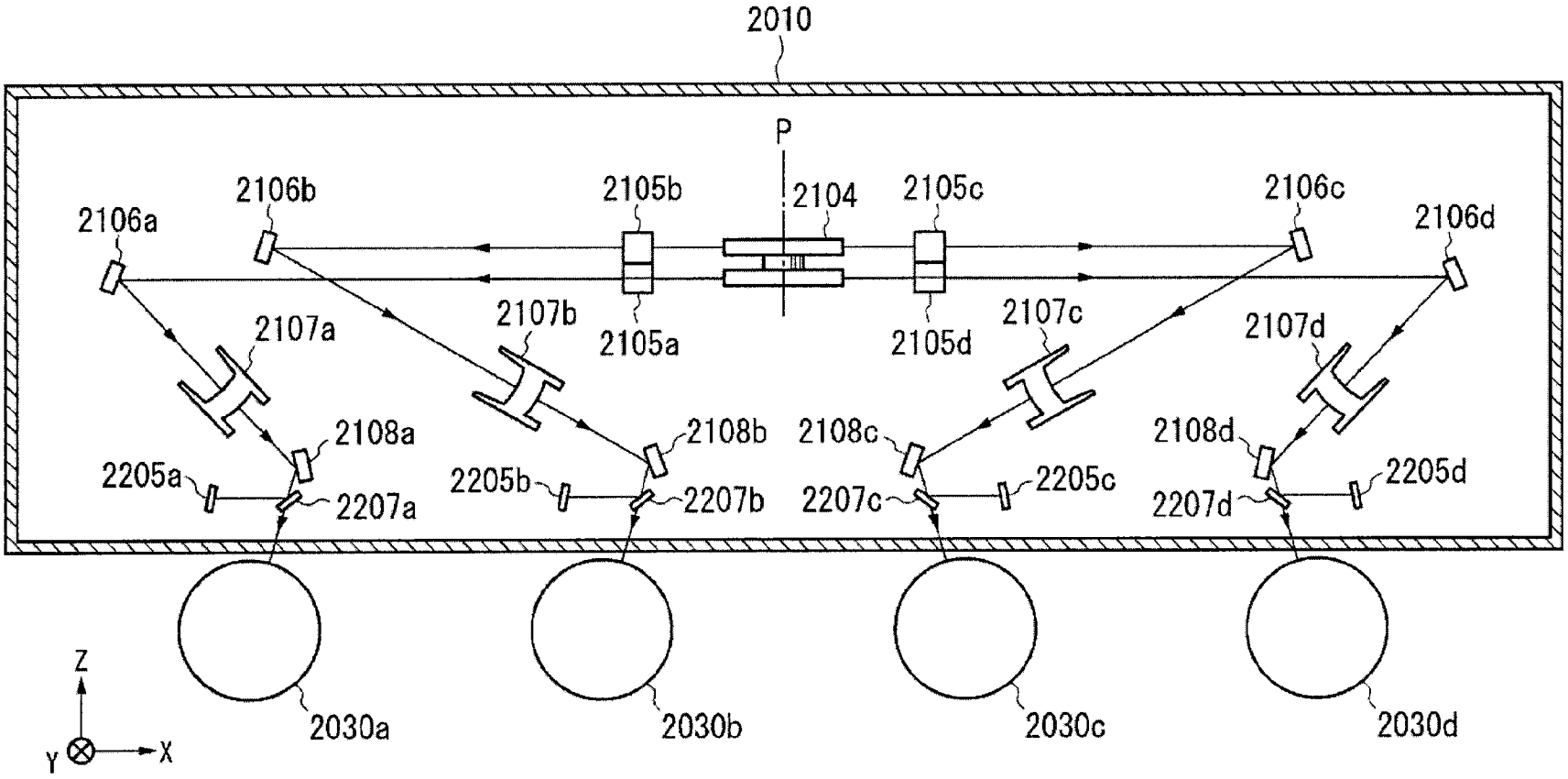
FIG. 6 is an optical arrangement diagram illustrating the entire optical scanning device when it is seen in a sub-scanning direction.

Subsequently, a detailed configuration of the optical scanning device 2010 will be explained with reference to FIGS. 3 to 6. FIG. 3 is an optical arrangement diagram of the optical scanning device 2010 when seen in the main scanning direction. FIG. 4 is an optical arrangement diagram of a portion of the optical scanning device 2010 when seen in the sub-scanning direction. FIG. 5 is an optical arrangement diagram of another portion of the optical scanning device 2010 when seen in the sub-scanning direction. FIG. 6 is an optical arrangement diagram of the entire optical scanning device 2010 when seen in the main scanning direction.

The optical scanning device 2010 includes four light sources (2200*a*, 2200*b*, 2200*c*, 2200*d*), four coupling lenses (2201*a*, 2201*b*, 2201*c*, 2201*d*), four aperture plates (2202*a*, 2202*b*, 2202*c*, 2202*d*), four cylindrical lenses (2204*a*, 2204*b*, 2204*c*, 2204*d*), a polygon mirror 2104, four deflecting device-side scanning lenses (2105*a*, 2105*b*, 2105*c*, 2105*d*), eight reflection mirrors (2106*a*, 2106*b*, 2106*c*, 2106*d*, 2108*a*, 2108*b*, 2108*c*, 2108*d*), and four image surface-side scanning lenses (2107*a*, 2107*b*, 2107*c*, 2107*d*). In addition, the optical scanning device 2010 includes a scanning control device, not illustrated, and the like.

Optical Member for Forming Latent Image of Each Color

The light source 2200*a*, the coupling lens 2201*a*, the aperture plate 2202*a*, the cylindrical lens 2204*a*, the deflecting device-side scanning lens 2105*a*, the image surface-side scanning lens 2107*a*, and the two reflection mirrors (2106*a*, 2108*a*) are optical members for forming a latent image on the photosensitive drum 2030*a*. With the optical member group, the latent image according to the toner in the magenta color is formed on the photosensitive drum 2030*a*.

The light source 2200*b*, the coupling lens 2201*b*, the aperture plate 2202*b*, the cylindrical lens 2204*b*, the deflecting device-side scanning lens 2105*b*, the image surface-side scanning lens 2107*b*, the two reflection mirrors (2106*b*, 2108*b*) are optical members for forming a latent image on the photosensitive drum 2030*b*. With the optical member group, the latent image according to the toner in the black color is formed on the photosensitive drum 2030*b*.

The light source 2200*c*, the coupling lens 2201*c*, the aperture plate 2202*c*, the cylindrical lens 2204*c*, the deflecting device-side scanning lens 2105*c*, the image surface-side scanning lens 2107*c*, and the two reflection mirrors (2106*c*, 2108*c*) are optical members for forming a latent image on the photosensitive drum 2030*c*. With the optical member group, the latent image according to the toner in the cyan color is formed on the photosensitive drum 2030*c*.

The light source 2200*d*, the coupling lens 2201*d*, the aperture plate 2202*d*, the cylindrical lens 2204*d*, the deflecting device-side scanning lens 2105*d*, the image surface-side scanning lens 2107*d*, the two reflection mirrors (2106*d*, 2108*d*) are optical members for forming a latent image on the photosensitive drum 2030*d*. With the optical member group, the latent image according to the toner in the yellow color is formed on the photosensitive drum 2030*d*.

The scanning control device controls ON/OFF of each light source.

Coupling Lens

Each coupling lens 2201 is arranged on an optical path of light beam emitted from the corresponding light source 2200, so that the light beam is made into substantially parallel light beam. Each aperture plate 2202 has an aperture portion and shapes the light beam provided from the corresponding coupling lens 2201.

Cylindrical Lens

Each cylindrical lens 2204 causes the light beam having passed through the aperture portion of the corresponding aperture plate 2202 to form an image in the Z axis direction in proximity to the deflecting reflective surface of the polygon mirror 2104.

Polygon Mirror

The polygon mirror 2104 has four-surface mirrors having two-stage structure, and each mirror serves as a deflecting reflective surface. The arrangement is such that in the four-surface mirrors of the first stage (lower stage), each of the light beam from the cylindrical lens 2204*a* and the light beam from the cylindrical lens 2204*d* is deflected, and in the four-surface mirrors of the second stage (upper stage), each of the light beam from the cylindrical lens 2204*b* and the light beam from the cylindrical lens 2204*c* is deflected.

The light beam from the cylindrical lens 2204*a* deflected by the polygon mirror 2104 is transmitted to the photosensitive drum 2030*a* via the deflecting device-side scanning lens 2105*a*, the reflection mirror 2106*a*, the image surface-side scanning lens 2107*a*, and the reflection mirror 2108*a*, so that the light spot is formed.

The light beam from the cylindrical lens 2204*b* deflected by the polygon mirror 2104 is transmitted to the photosensitive drum 2030*b* via the deflecting device-side scanning lens 2105*b*, the reflection mirror 2106*b*, the image surface-side scanning lens 2107*b*, and the reflection mirror 2108*b*, so that the light spot is formed.

The light beam from the cylindrical lens 2204*c* deflected by the polygon mirror 2104 is transmitted to the photosensitive drum 2030*c* via the deflecting device-side scanning lens 2105*c*, the reflection mirror 2106*c*, the image surface-side scanning lens 2107*c*, and the reflection mirror 2108*c*, so that the light spot is formed.

The light beam from the cylindrical lens 2204*d* deflected by the polygon mirror 2104 is transmitted to the photosensitive drum 2030*d* via the deflecting device-side scanning lens 2105*d*, the reflection mirror 2106*d*, the image surface-side scanning lens 2107*d*, and the reflection mirror 2108*d*, so that the light spot is formed.

The light spot formed on each photosensitive drum 2030 moves in the longitudinal direction of the photosensitive drum 2030 (main scanning direction) along with the rotation of the polygon mirror 2104. The scanning region of each photosensitive drum 2030 in the main scanning direction in which the image information is written is referred to as "effective scanning region", "image forming region", or "effective image region".

Details of Image Sensor

Figure 7:
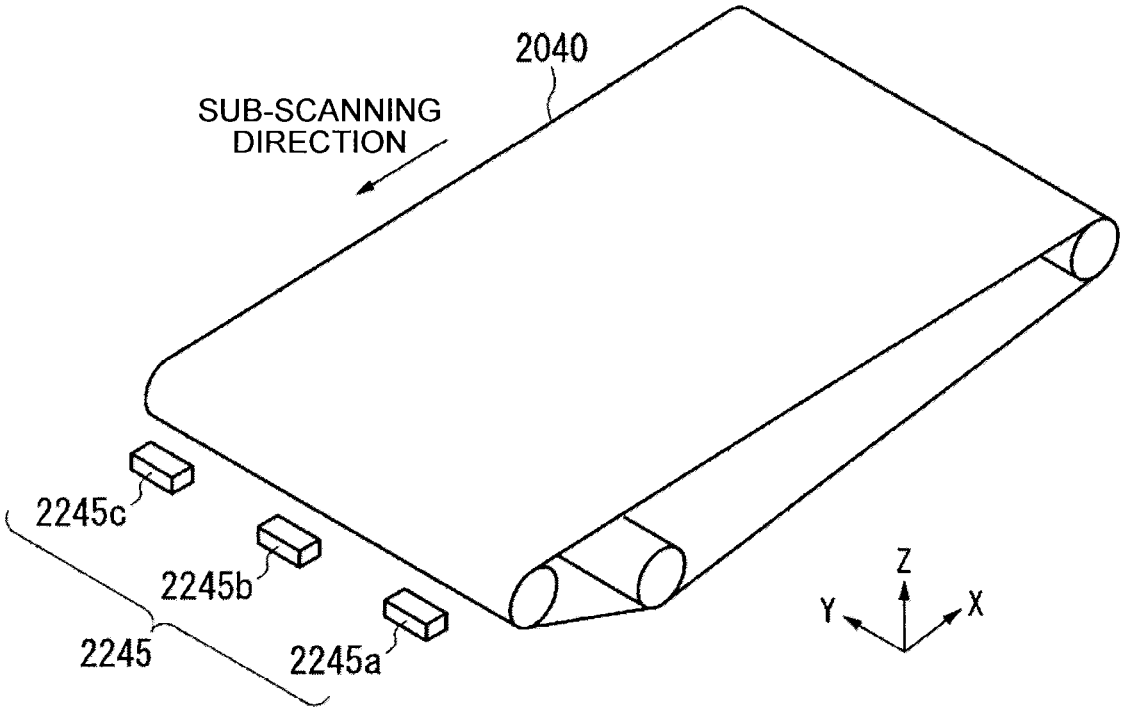
FIG. 7 is a perspective view illustrating an example of arrangement position of an image sensor provided in the image forming apparatus.

Subsequently, the image sensor 2245 will be explained. First, the arrangement of the image sensor 2245 will be explained with reference to FIGS. 7 and 8. FIG. 7 is a perspective view for explaining relationship of the positions of the image sensor 2245 and the intermediate transfer belt 2040. As illustrated in FIG. 7, the image sensor 2245 includes three reflection-type optical sensors. In the explanation below, when the three reflection optical sensors are distinguished from each other in the explanation, the three reflection optical sensors are denoted as an image sensor 2245*a*, an image sensor 2245*b*, and an image sensor 2245*c*. When it is not necessary to distinguish them from each other, they are denoted as image sensors 2245. The image sensors 2245 are arranged with a regular interval along the main scanning direction in proximity to a turning end of the intermediate transfer belt 2040 in the sub-scanning direction (−X end). The explanation will be made on the basis of the coordinate axis as illustrated in FIG. 7. From the origin point side of the Y axis, the image sensor 2245*a*, the image sensor 2245*b*, and the image sensor 2245*c* are arranged in this order along the Y axis.

Figure 8:
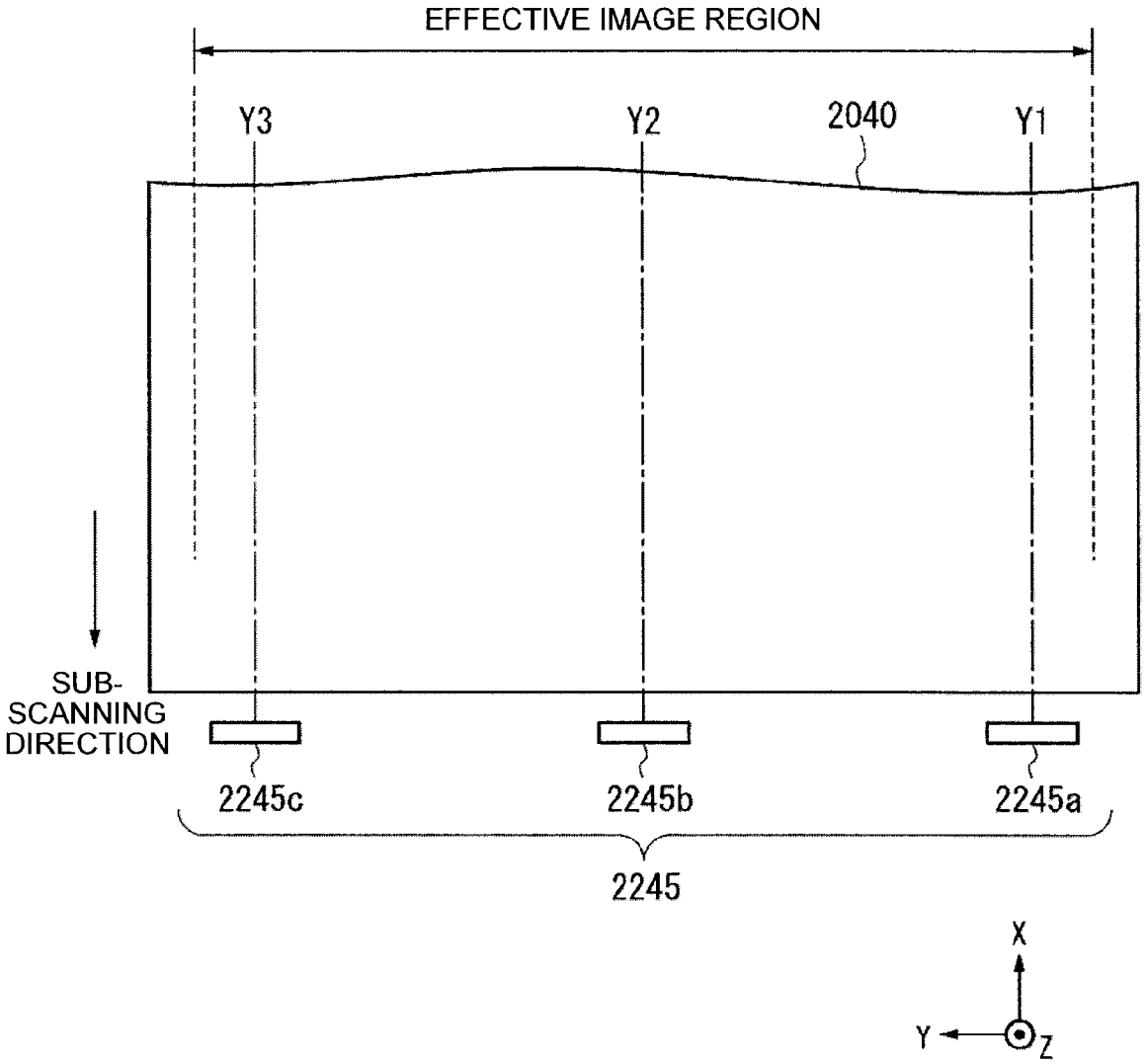
FIG. 8 is a top view illustrating an example of arrangement position of the image sensor.

FIG. 8 is a top view illustrating relationship of the positions of the image sensor 2245 and the intermediate transfer belt 2040, when seen in the Z axis direction. As illustrated in FIG. 8, the image sensor 2245*b* constituting a portion of the image sensor 2245 is arranged generally in a central portion within the effective image region of the intermediate transfer belt 2040. In the state of facing the front side of FIG. 8, the image sensor 2245*a* is arranged in proximity to the right-side end portion within the effective image region of the intermediate transfer belt 2040, and in the state of facing the front side of FIG. 8, the image sensor 2245*c* is arranged in proximity to the left-side end portion within the effective image region of the intermediate transfer belt 2040.

In the explanation below, in the main scanning direction of the intermediate transfer belt 2040, the central position of the image sensor 2245*a* is denoted as Y1, the central position of the image sensor 2245*b* is denoted as Y2, and the central position of the image sensor 2245*c* is denoted as Y3.

Structure of Image Sensor

Figure 9:
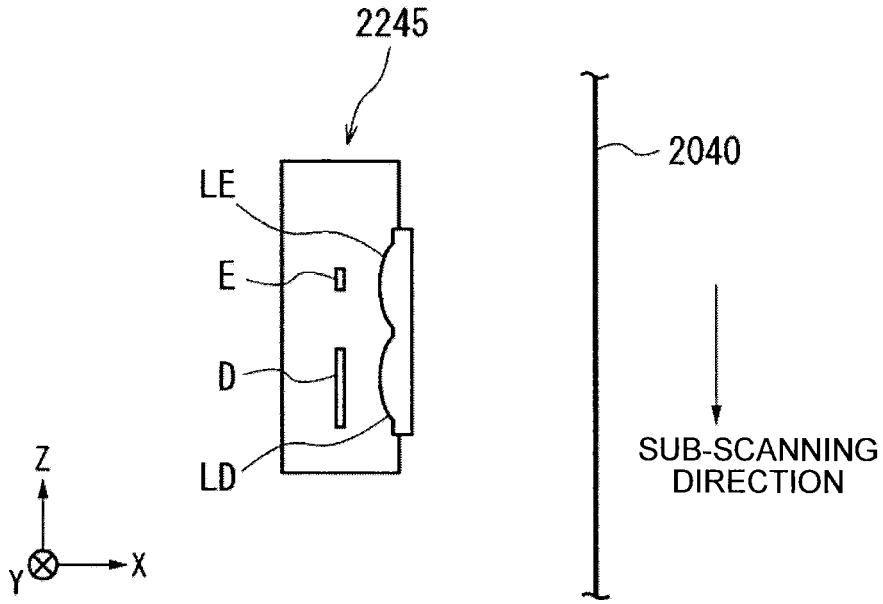
FIG. 9 is a cross sectional view illustrating an example of a structure of the image sensor.

Each of the three image sensors 2245*a*, 2245*b*, 2245*c* constituting the image sensor 2245 has the same configuration and the same structure. FIG. 9 is a cross sectional view of the image sensor 2245 in the sub-scanning direction. As illustrated in FIG. 9, the image sensor 2245 includes an illumination micro lens LE and a light-emitting unit E at a position corresponding to the illumination micro lens LE which are arranged at a side facing the intermediate transfer belt 2040, and includes a light-receiving micro lens LD and a light-receiving unit D at a position corresponding to the light-receiving micro lens LD which are arranged in parallel with the illumination micro lens LE.

In FIG. 9, the intermediate transfer belt 2040 facing the image sensor 2245 is in parallel to the Z axis, but this indicates that the image sensor 2245 is arranged at a position where the intermediate transfer belt 2040 having moved in −X direction turns in +X direction.

Figure 10:
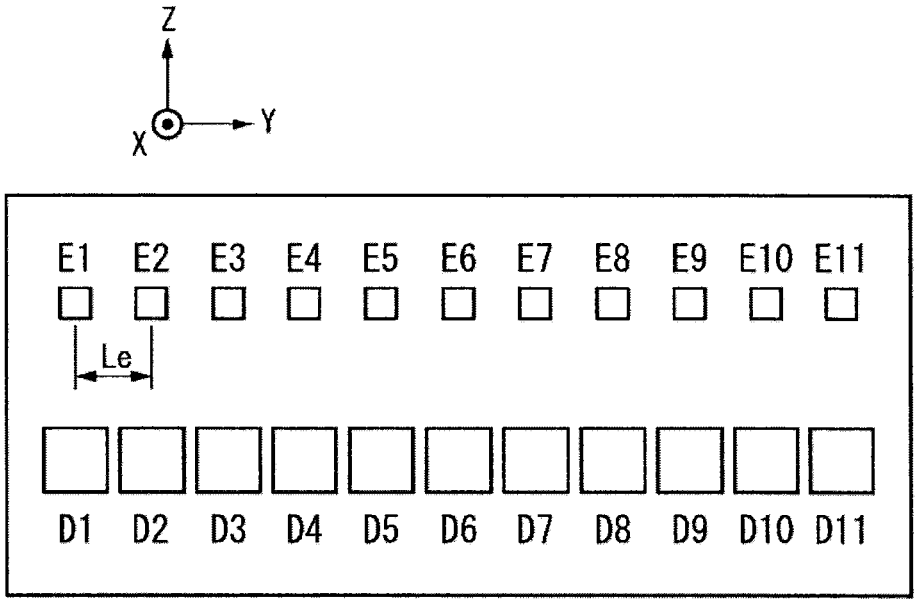
FIG. 10 is a cross sectional view illustrating an example of a structure of the image sensor.

FIG. 10 is a cross sectional view illustrates the image sensor 2245 when seen from the surface facing the intermediate transfer belt 2040. As illustrated in FIG. 10, the image sensor 2245 includes eleven light-emitting units (E1 to E11) arranged in the main scanning direction. The interval between adjacent light-emitting units are maintained at a certain interval (symbol Le). Eleven illumination micro lenses (LE1 to LE11) corresponding to the light-emitting units (E1 to E11) are arranged at the side of the intermediate transfer belt 2040 (see FIG. 9). The illumination optical system is constituted by the light-emitting unit E and the illumination micro lens LE.

Eleven light-receiving units (D1 to D11) are arranged, at the positions deviating in the sub-scanning direction, at the positions of the main scanning direction corresponding to the light-emitting units (E1 to E11), respectively. The eleven light-receiving micro lenses (LD1 to LD11) corresponding to the light-receiving units (D1 to D11), respectively, are arranged at the side of the intermediate transfer belt 2040 (see FIG. 9). The light-receiving optical system is constituted by the light-receiving unit D and the light-receiving lens LD.

In the explanation below, the light-emitting units (E1 to E11), the illumination micro lenses (LE1 to LE11), the light-receiving units (D1 to D11), and the light-receiving micro lenses (LD1 to LD11) are collectively referred to as "light-emitting unit E", "illumination micro lens LE", "light-receiving unit D", and "light-receiving micro lens LD", respectively.

Light-Emitting Unit

The light-emitting unit E may use, for example, an LED (Light Emitting Diode). In this case, for example, explanation will be continued while an interval Le between adjacent light-emitting units E is 0.4 mm.

When the interval Le between the light-emitting units E is 0.4 mm, the distance between the light-emitting unit E1 and the light-emitting unit E11 in the main scanning direction is, 4 mm (Le×10). Both of the size in the main scanning direction and the size in the sub-scanning direction of each light-emitting unit E are about 0.04 mm. Further, the wavelength of the light beam emitted from each light-emitting unit E is 850 nm.

The eleven light-emitting units (E1 to E11) are turned ON/OFF by the printer control device 2090. In the explanation below, the light-emitting unit which is turned on is abbreviated as "ON light-emitting unit".

Explanation about Light-Receiving Unit

The arrangement interval of the light-receiving unit D (arrangement pitch) is the same as the interval Le of the light-emitting unit E. Both of the size in the main scanning direction and the size in the sub-scanning direction of each light-receiving unit D are about 0.35 mm. The peak wavelength of the light-receiving sensitivity of each light-receiving unit D is around 850 nm.

Each light-receiving unit D may be made of a PD (photodiode). Each light-receiving unit D outputs an electric signal of a level according to the amount of received light.

Relationship of Light Related to Image Sensor and Intermediate Transfer Belt

Figure 11:
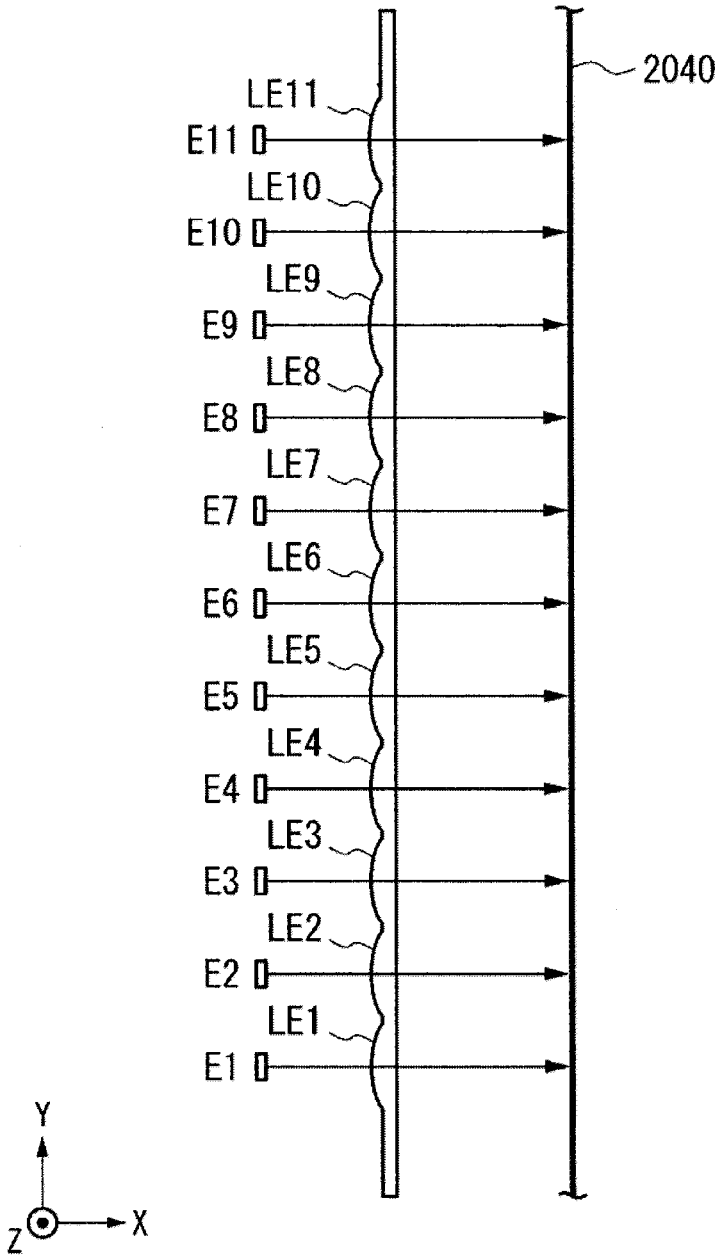
FIG. 11 is a diagram illustrating relationship between an intermediate transfer belt and light emitted from the image sensor.

FIG. 11 is a cross sectional view illustrating a portion of configuration of the image sensor 2245, and illustrates only the light-emitting unit E which is the illumination optical system, the illumination micro lens LE which is the illumination optical system, and the emission surface of the intermediate transfer belt 2040. As illustrated in FIG. 11, the eleven illumination micro lenses (LE1 to LE11) respectively correspond to the eleven light-emitting units (E1 to E11). The light emitted from the light-emitting unit E is condensed and guided by the illumination micro lens LE, and the light illuminates the intermediate transfer belt 2040. Each illumination micro lens LE has substantially the same lens diameter, the same curvature radius of the lens, and the same lens length. The optical axis of each illumination micro lens LE is parallel to the direction perpendicular to the light emitting surface of the corresponding light-emitting unit E.

Figure 12:
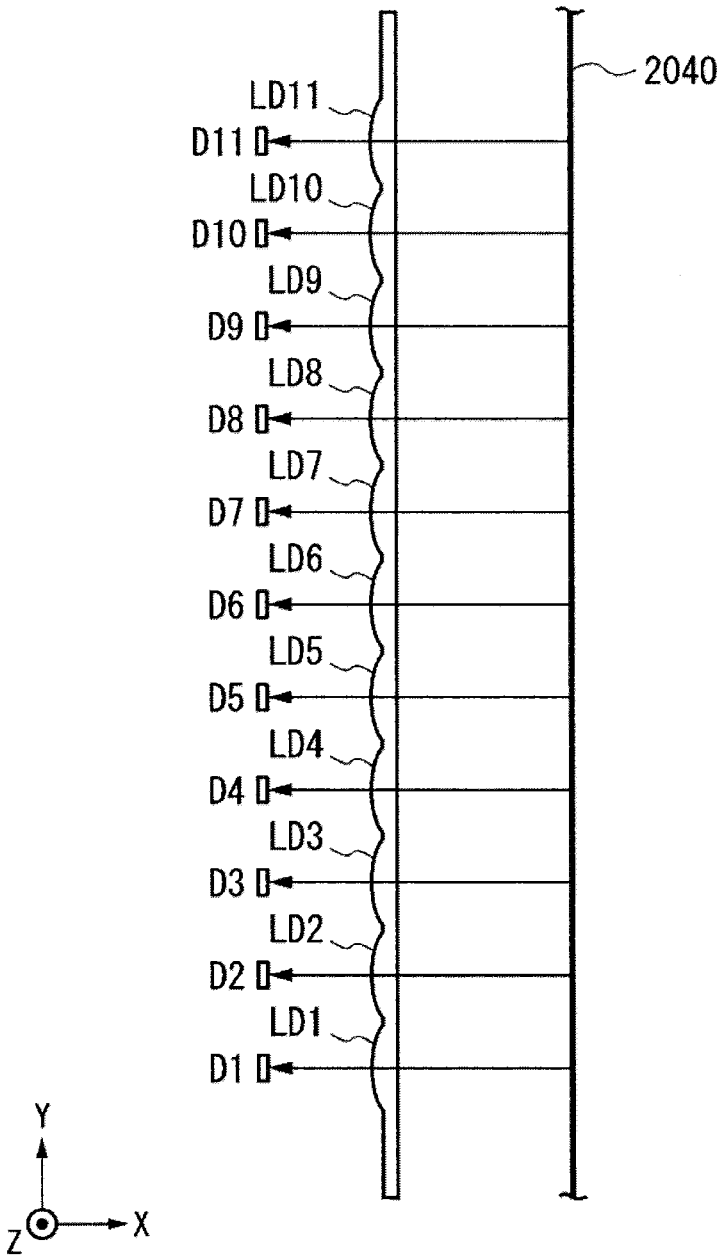
FIG. 12 is a diagram illustrating relationship between the image sensor and light reflected by the intermediate transfer belt.

FIG. 12 is a cross sectional view illustrating a portion of configuration of the image sensor 2245, and illustrates only the light-receiving unit D which is the illumination optical system, the light-receiving micro lens LD which is the light-receiving optical system, and the emission surface of the intermediate transfer belt 2040. As illustrated in FIG. 12, the light emitted from the light-emitting unit E is reflected by the intermediate transfer belt 2040, and is received by the light-receiving unit D via the light-receiving micro lens LD. The optical axis of each light-receiving micro lens LD is parallel to the direction perpendicular to the light emitting surface of the corresponding light-receiving unit D. The eleven light-receiving micro lenses (LD1 to LD11) correspond to the eleven light-receiving units (D1 to D11), respectively, and condense the detection light reflected by the intermediate transfer belt 2040 or the toner pattern. In this case, the amount of received light of each light-receiving unit can be increased. More specifically, the detection sensitivity can be enhanced. Each light-receiving micro lens LD has substantially the same lens diameter, the same curvature radius of the lens, and the same lens length.

Both or any one of the illumination micro lens LE and the light-receiving micro lens LD may made of, e.g., a spherical lens having light condensing function in the main scanning direction and the sub-scanning direction, a cylindrical lens having positive power in the sub-scanning direction, and an anamorphic lens of which power in the main scanning direction and of which power in the sub-scanning direction are different from each other.

In the present embodiment, a micro lens constituting the illumination micro lens LE and the light-receiving micro lens LD is, for example, a spherical lens. In this case, the optical surface at the incident side of each illumination micro lens LE has light-condensing power, and the optical surface at the output side does not have light-condensing power. In this case, the optical surface at the output side of each light-receiving micro lens LE has light-condensing power, and the optical surface at the incident side does not have light-condensing power.

More specifically, the lens diameter of each illumination micro lens LE is 0.414 mm, and the curvature radius of the lens is 0.430 mm, and the lens thickness is 1.229 mm.

The lens diameter of each light-receiving micro lens LD is 0.712 mm, and the curvature radius of the lens is 0.380 mm, and the lens thickness is 1.419 mm.

As described above, the lens diameter of each light-receiving micro lens LD is larger than that of the illumination micro lens LE, so that much reflected light can be received. The curvature radius of each light-receiving micro lens LD is smaller than that of the illumination micro lens LE, so that the total reflection in the lens is increased, whereby the amount of received light of the regular-reflected light can be reduced. The curvature radius of each light-receiving micro lens LD is reduced, so that it is possible to greatly refract the light beam that has passed through the light-receiving micro lens LD arranged in front of a light-receiving unit D adjacent to the light-receiving unit D corresponding to the light-emitting unit E turned ON. Accordingly, even if the reflected light from the test pattern is diffusion light, the amount of received light of the light-receiving unit D can also be expected to be increased.

Light Spot

Figure 13:
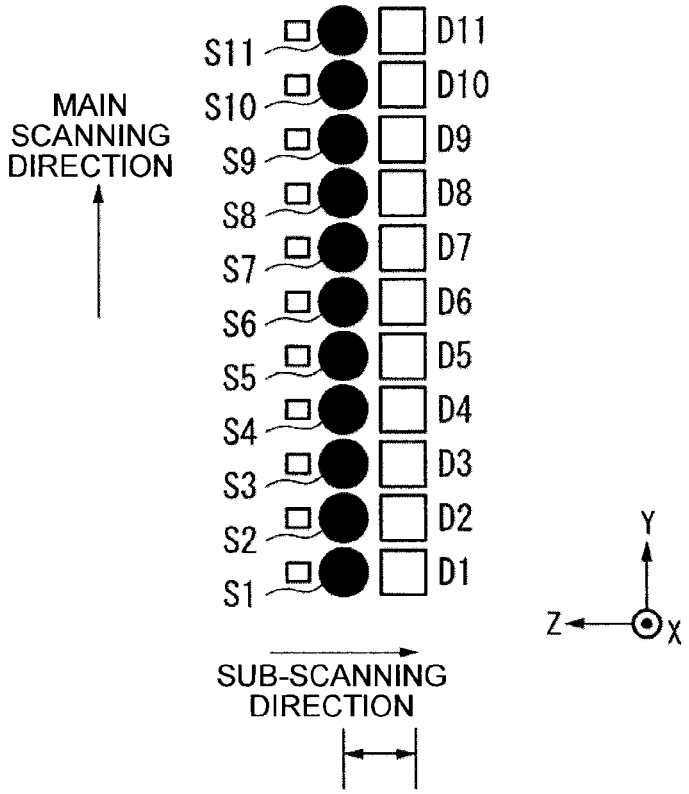
FIG. 13 is a diagram illustrating relationship of the position of a light spot formed by the image sensor.

In this case, for the sake of explanation, with only the light beam that is emitted from each light-emitting unit E and that has passed through the corresponding illumination micro lens LE, the light spots (S1 to S11) illuminating the intermediate transfer belt 2040 are formed by the detection light for detecting the test pattern. Overview of the light spot will be explained with reference to FIG. 13. As illustrated in FIG. 13, the light emitted by the light-emitting unit E is condensed by the illumination micro lens LE, and the light spots (S1 to S11) formed on the intermediate transfer belt 2040 by the condensed light are formed at the positions corresponding to around middle portion between the corresponding light-emitting unit E and the light-receiving unit D corresponding to light-emitting unit E in the sub-scanning direction.

The size (diameter) of each light spot S is, for example, 0.4 mm. This value is equal to the interval Le of the light-emitting unit E. The size (diameter) of a conventional light spot S is usually about 2 to 3 mm.

In the explanation below, the surface of the intermediate transfer belt 2040 is smooth, and almost all of the light of the light spot S formed on the surface of the intermediate transfer belt 2040 is regularly reflected.

In the present embodiment, the eleven illumination micro lenses (LE1 to LE11) and the eleven light-receiving micro lenses (LD1 to LD11) are integrated to constitute a micro lens array. This can improve the workability when each micro lens is assembled at a predetermined position. In addition, in the multiple micro lenses, the accuracy of the position between the lens surfaces can be improved. Each lens surface can be formed on a glass substrate or a resin substrate using processing method such as photolithography and molding.

In the explanation below, when it is not necessary to identify particular light-emitting unit E, it will be denoted as light-emitting unit Ei. An illumination micro lens corresponding to the light-emitting unit Ei is denoted as an illumination micro lens LEi. Light passing that is emitted from the light-emitting unit Ei and is passed through the illumination micro lens LEi and illuminates the intermediate transfer belt 2040 will be denoted as light spot Si. A light-receiving unit corresponding to the light-emitting unit Ei will be denoted as light-receiving unit Di. A light-receiving micro lens corresponding to the light-receiving unit Di will be denoted as light-receiving micro lens LDi.

Relationship Between Illumination Light and Reflected Light

Figure 14:
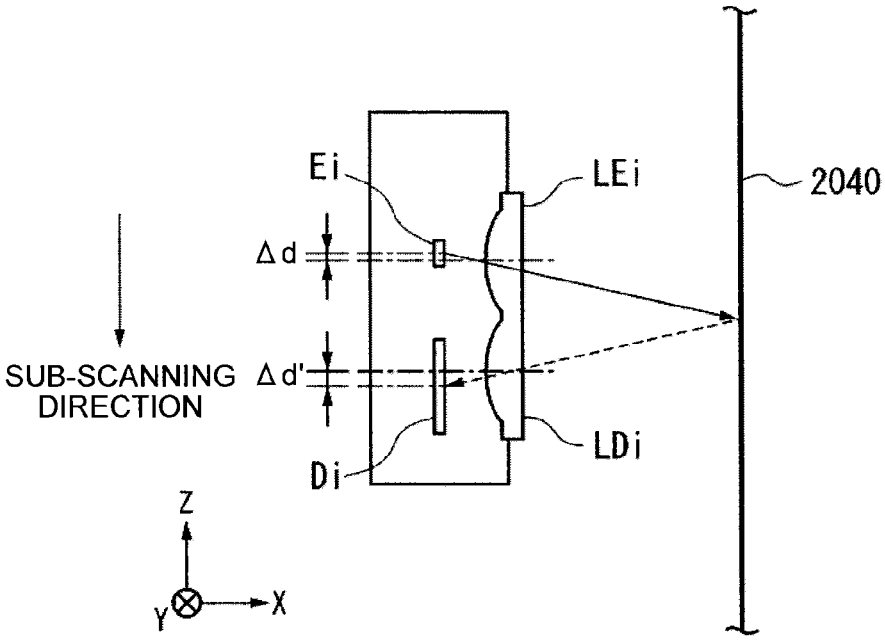
FIG. 14 is a diagram illustrating relationship between a light-receiving unit and a light-emitting unit provided in the image sensor.

Subsequently, the relationship between the illumination light from the image sensor 2245 and the light reflected by the intermediate transfer belt 2040 will be illustrated using FIG. 14. As illustrated in FIG. 14, the optical axis of the illumination micro lens LEi passes through the center of the corresponding light-emitting unit Ei, and is deviated by Δd to the side of the light-receiving system with respect to the axis perpendicular to the light-emitting unit Ei. The size of Δd is, for example, 0.035 mm.

The optical axis of the light-receiving micro lens LDi passes through the center of the corresponding light-receiving unit Di, and is deviated by Δd' to the emission system side with respect to the axis perpendicular to the light-receiving unit Di. The size of Δd' is, for example, 0.020 mm. With this configuration, much reflected light is guided to the corresponding light-receiving unit Di.

In the Z axis direction, the inter-lens distance between the illumination micro lens LEi and the light-receiving micro lens LDi is, for example, 0.445 mm, and the interval between the light-emitting unit Ei and the light-receiving unit Di is, for example, 0.500 mm. In the Z axis direction, the distance from the light-emitting unit Ei to the illumination micro lens LEi is, for example, 0.800 mm, and the distance between each micro lens and the surface of the intermediate transfer belt 2040 is, for example, 5 mm.

Test Pattern

Subsequently, the test pattern used for image forming process control of the image forming apparatus according to the present invention will be explained.

Figure 15:
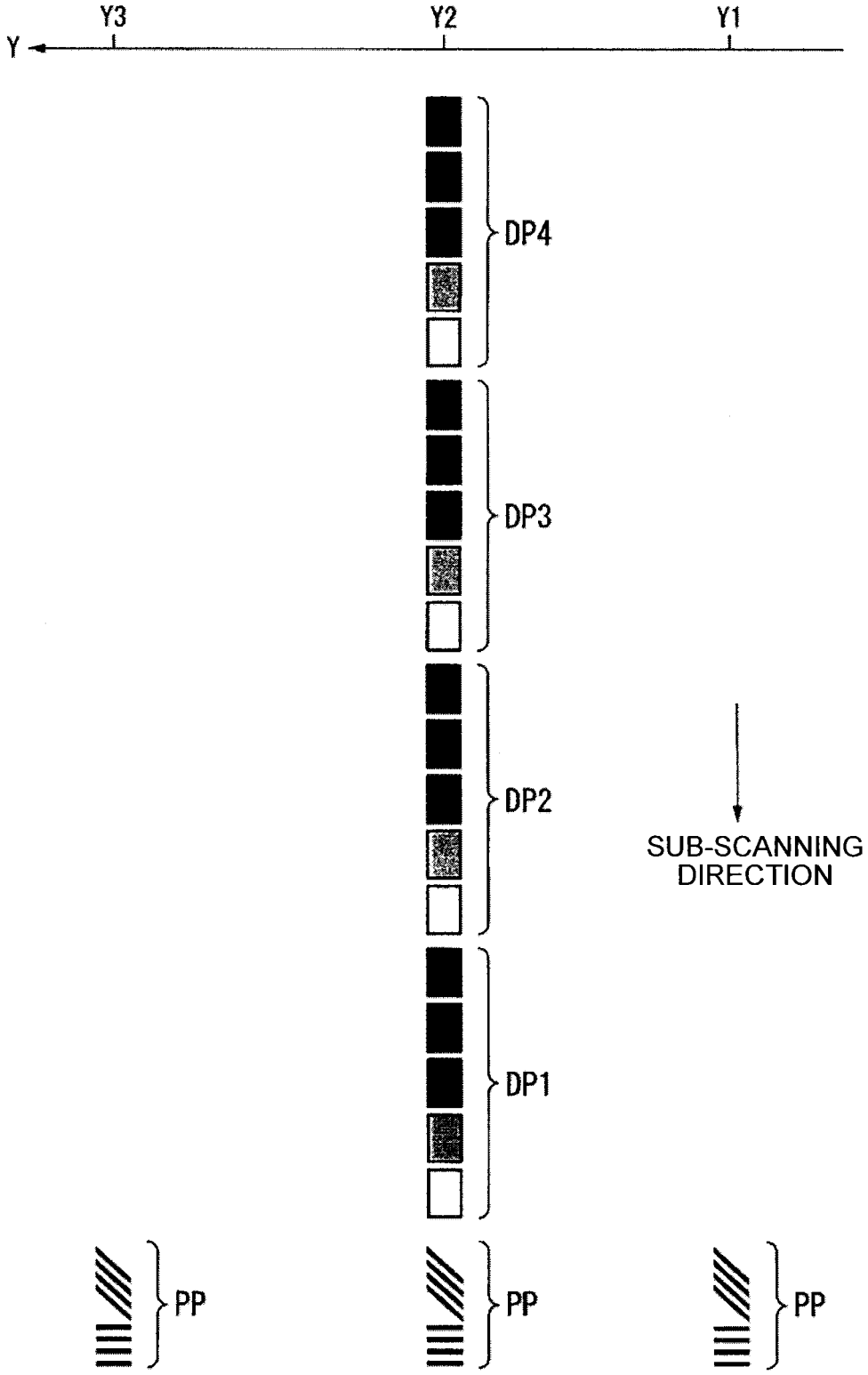
FIG. 15 is a top view illustrating relationship of the positions of the image sensor and the test pattern formed on the intermediate transfer belt.

FIG. 15 illustrates an example of test pattern according to the present embodiment. The test pattern including a pattern PP for detection of the deviation of the position and a pattern DP for toner density detection is formed on the intermediate transfer belt 2040. At a Y1 position and a Y3 position, only the pattern PP for detection of the deviation of the position is formed. At a Y2 position, the pattern PP for detection of the deviation of the position and the patterns DP1 to DP4 for density detection are formed. The patterns DP1 to DP4 for density detection correspond to four colors used for image forming.

Pattern for Detection of the Deviation of the Position

Figure 16:
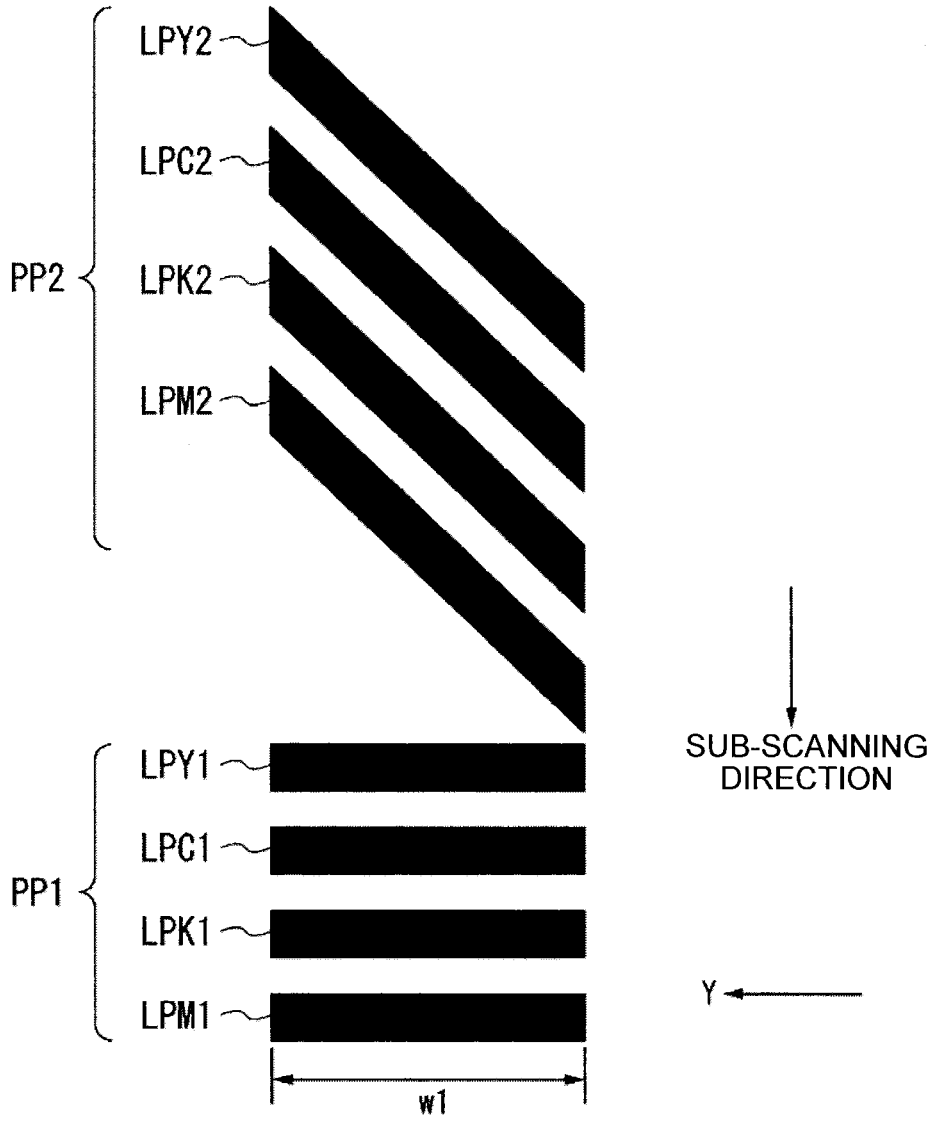
FIG. 16 is a partially enlarged view of the test pattern.

Subsequently, the pattern PP for detection of the deviation of the position will be explained with reference to FIG. 16. As illustrated in FIG. 16, the pattern PP includes a first pattern group PP1 including four line-shaped patterns (LPM1, LPK1, LPC1, LPY1) in parallel to the main scanning direction (Y axis direction) and a second pattern group PP2 including four line-shaped patterns (LPM2, LPK2, LPC2, LPY2) inclined with respect to the main scanning direction.

The line-shaped patterns LPM1 and LPM2 make a pair and are formed with magenta toner. The line-shaped patterns LPK1 and LPK2 make a pair and are formed with black toner. The line-shaped patterns LPC1 and LPC2 make a pair and are formed with cyan toner. The line-shaped patterns LPY1 and LPY2 make a pair and are formed with yellow toner. Each line-shaped pattern is a solid-filled pattern.

The first pattern group PP1 is such that a length w1 in the main scanning direction is 1 mm, and a length in the sub-scanning direction is 0.5 mm, and the interval thereof in the sub-scanning direction is 1 mm. In this case, the length of each line of the pattern PP1 in the main scanning direction can be equal to or more than "the size of light spot Si"+"the interval Le of light-emitting unit E".

The second pattern group PP2 is such that the inclination angle with respect to the main scanning direction is 45 degrees, and the length of the pattern PP2 in the main scanning direction is 1 mm (=w1), and the width of the line is 0.5 mm.

Explanation about Pattern for Density Detection

Back to FIG. 15, the pattern DP1 for density detection is formed with magenta toner, and the pattern DP2 for density detection is formed with black toner. The pattern DP3 for density detection is formed with cyan toner, and the pattern DP for density detection is formed with yellow toner.

In the description below, when it is not necessary to distinguish the patterns DP1 to DP4 for density detection from each other, they are collectively referred to as "the pattern DP for density detection".

Figure 17:
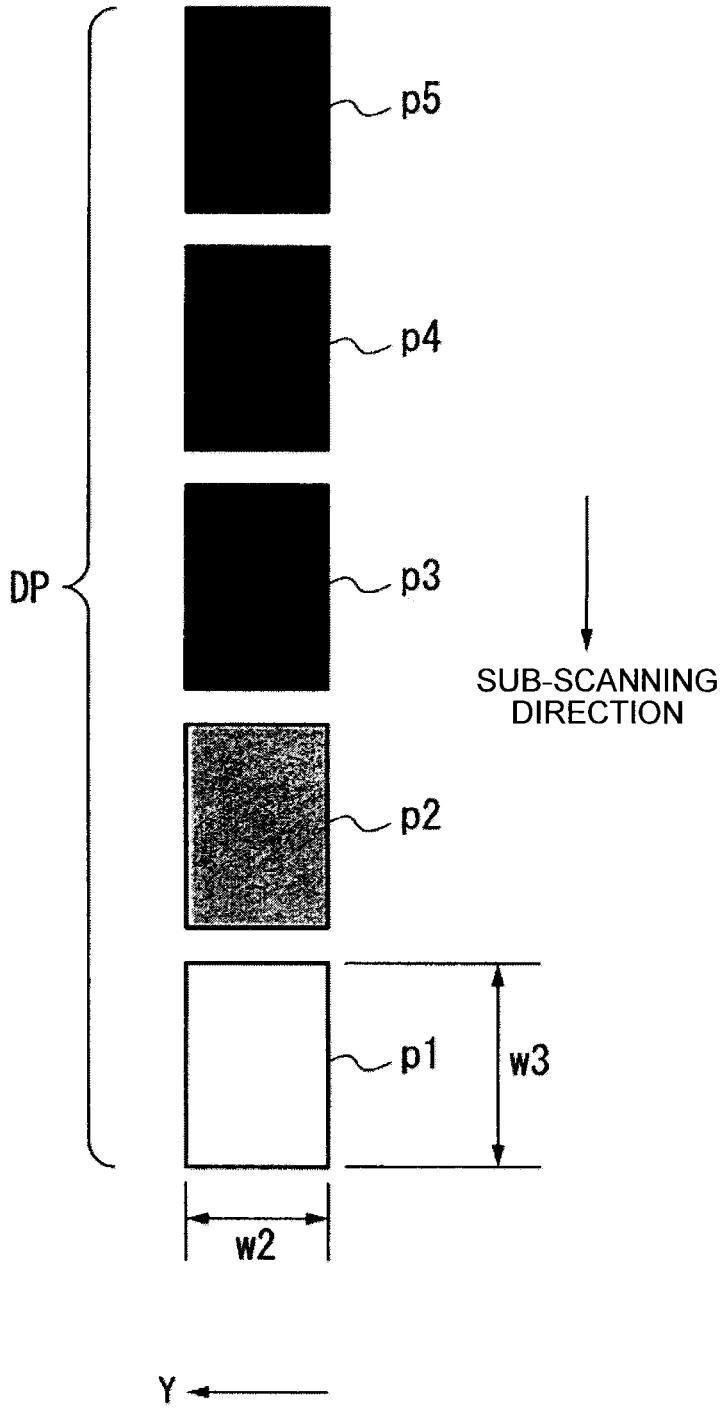
FIG. 17 is a partially enlarged view of the test pattern.

An example of pattern DP for density detection will be explained with reference to FIG. 17. As illustrated in FIG. 17, five rectangular patterns (p1 to p5) are provided. In the explanation below, patterns (p1 to p5) are collectively referred to as "rectangular patches p". The rectangular patches p are arranged in direction in which the intermediate transfer belt 2040 moves (sub-scanning direction), and when seen as a whole, the gradation of the toner density of each of them is different. In this case, they are referred to as p1, p2, p3, p4, p5, which are arranged in order starting from a rectangular patch of which toner density is low.

The size of the rectangular patch p is such that, for example, a length w2 in the main scanning direction is 1 mm, and a length w3 in the sub-scanning direction is 2 mm. In this size, the length w2 of each rectangular patch in the main scanning direction is more than a summation of the interval Le of the light-emitting unit Ei (0.4 mm) and the size of the light spot Si (0.4 mm). In this case, the light spot Si can reliably illuminate the rectangular patch p, and the efficiency of use of the light can be enhanced. In the sub-scanning direction, the interval of the centers of the two adjacent rectangular patches p is 3 mm.

In this manner, according to the image forming apparatus according to the present invention, even when the test pattern is reduced, this can be detected with a high degree of accuracy, and therefore, the amount of toner used for forming the test pattern can be about 1/100 as compared with a conventional case. More specifically, the amount of non-affecting toner can be greatly reduced. As a result, the replacement cycle of the toner cartridge can be increased.

By the way, the gradation of the toner density can be changed by adjustment of the power of the light beam emitted from the light source, adjustment of the duty of the driving pulse provided to the light source, and adjustment of charge bias and developing bias. Alternatively, the gradation of the toner density can also be changed by changing the ratio of areas of halftone dots.

Position Detection Method with the Pattern

Figure 18A:
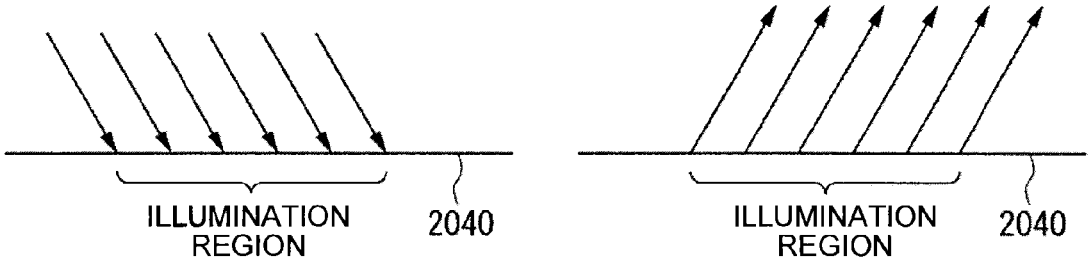
FIGS. 18A and 18B are figures for explaining the state of reflection of light emitted from the light-emitting unit provided in the image sensor.
Figure 18B:
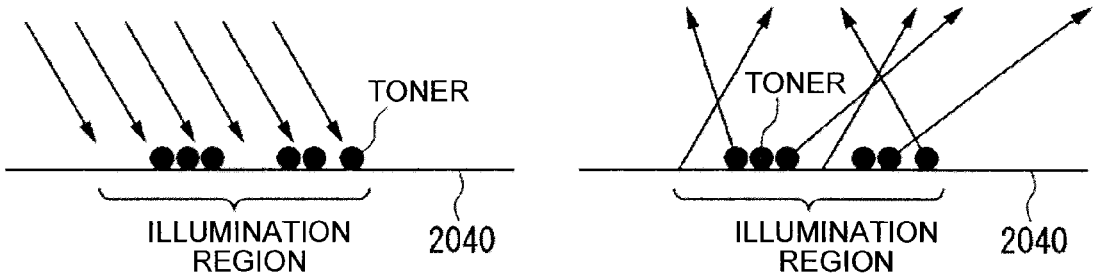

By detecting the test pattern explained above, the deviation of the position of the formed image can be detected, and the density can be detected, so that correction can be made appropriately. In this case, the detection of the test pattern will be explained with reference to FIGS. 18A and 18B. FIGS. 18A and 18B are schematic diagrams illustrating how the light emitted from the image sensor 2245 is reflected by the intermediate transfer belt 2040 which is the illumination target. As illustrated in FIG. 18A, when the light illuminating the test pattern illuminates only the intermediate transfer belt 2040, almost all of the reflected light is regularly reflected by the surface of the intermediate transfer belt 2040.

On the other hand, as illustrated in FIG. 18B, the light illuminating the test pattern reaches the toner forming the test pattern and the surface of the intermediate transfer belt 2040 which is the foundation of the test pattern and is reflected thereby, the reflected light thereof includes light regularly reflected by the surface of the intermediate transfer belt 2040 and light scattered when the light is reflected and refracted by the toner at least once.

The scattered light includes light scattered in the same direction as the direction in which the light is regularly reflected from the surface of the intermediate transfer belt 2040, but the amount of light is low, and it cannot be distinguished from the light regularly reflected from the surface of the intermediate transfer belt 2040, and therefore, it may be disregarded.

More specifically, the light caused by the intermediate transfer belt 2040 is denoted as regular reflection-based portion, and the light caused by the test pattern is denoted as diffusion reflection-based portion. As described above, the light spot Si illuminating the pattern is regularly reflected and diffusely reflected.

Image Forming Process

Figure 19:
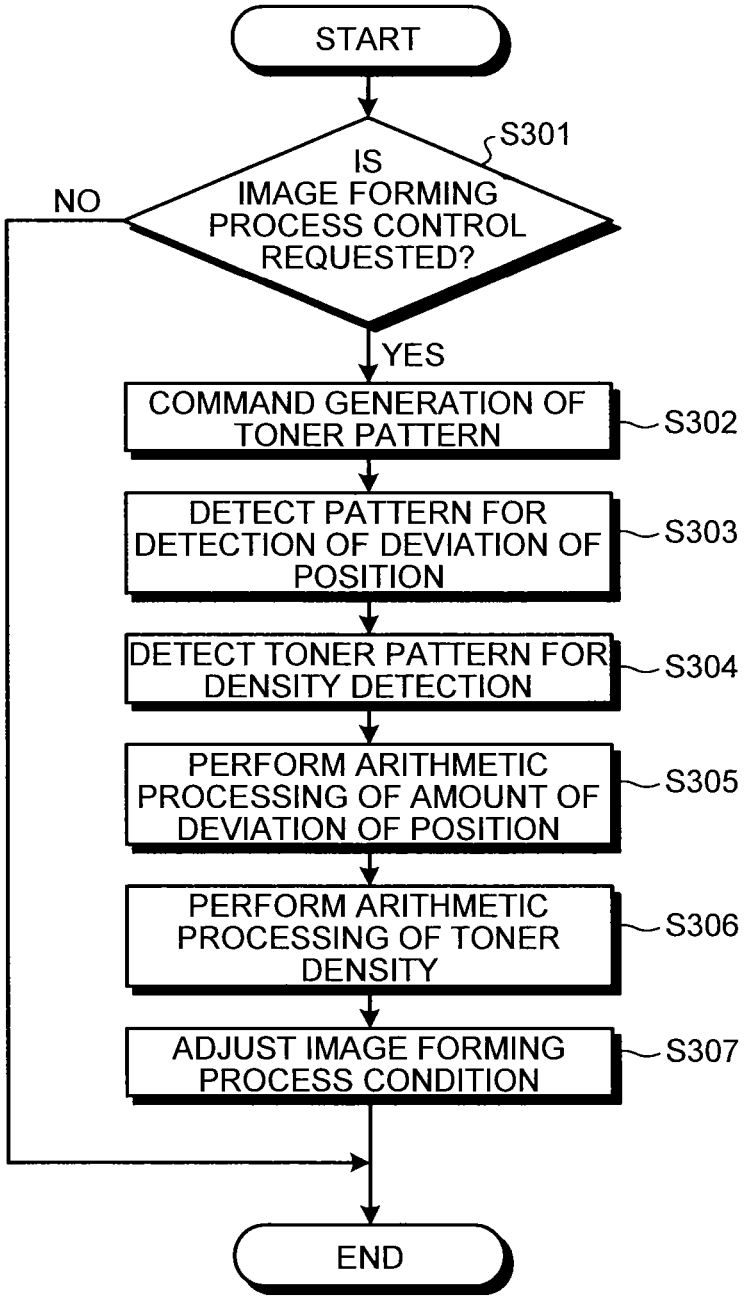
FIG. 19 is a flowchart illustrating a flow of an image forming process control processing executed by the image forming apparatus.

Subsequently, an example of flow of image forming process control processing with the test pattern detection by the image sensor 2245 will be explained with reference to a flowchart as illustrated in FIG. 19. In FIG. 19, the processing steps are denoted as S301, S302 . . . .

First, in step S301, a determination is made as to whether image forming process control is requested or not. In this case, an image forming process control flag is set (YES in S301), processing S302 is subsequently performed, and when the image forming process control flag is not set (NO in S301), the processing is terminated.

The image forming process control flag is a flag that is set under various kinds of conditions. For example, immediately after the power is turned on, the image forming process control flag is set in the following cases: (1) the photosensitive drum 2030 stops for six hours or more, (2) the temperature in the color printer 2000 changes by 10 degrees Celsius or more, and (3) a relative humidity in the color printer 2000 changes by 50% or more. For example, during printing, the image forming process control flag is set in the following cases: (4) a predetermined number of sheets have been printed, (5) the number of rotations of the developing roller 2033 attains a predetermined number of rotations, and (6) the travel distance of the intermediate transfer belt 2040 attains a predetermined distance.

In step S302, a command is given to the scanning control device to generate a toner pattern which is a basis of the test pattern. Accordingly, the scanning control device controls each station so as to form the toner pattern at a predetermined position of each photosensitive drum.

A density conversion LUT (look up table) of the output of the reflection-type optical sensor for estimating "forming position information of pattern", "density information", "bias condition corresponding to each gradation of the pattern for density detection", and "toner density" required to form the test pattern are stored in advance in a memory of the scanning control device. The pattern PP for detection of the deviation of the position is formed under the same image forming condition (exposure power, charge bias, developing bias, and the like).

The toner pattern formed in step S302 is transferred to the intermediate transfer belt 2040 with predetermined timing.

Figure 20:
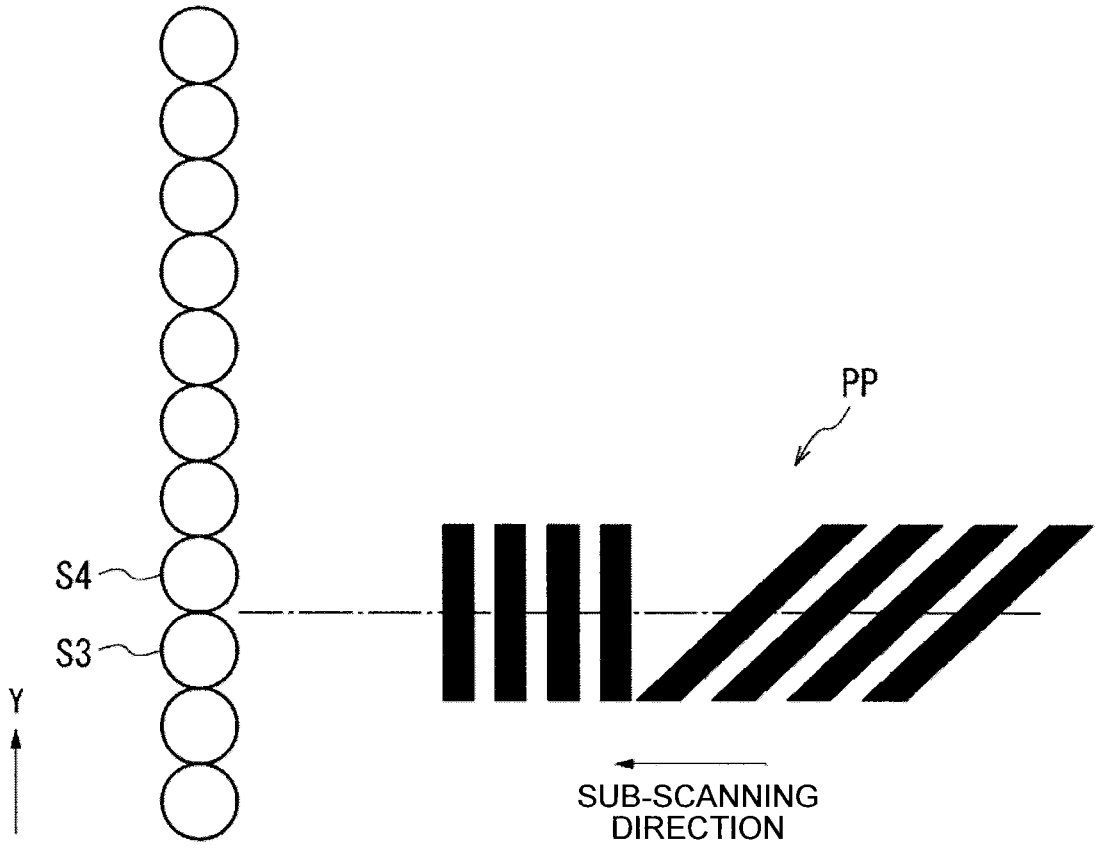
FIG. 20 is a top view for explaining relationship of the positions of the test pattern and the light spot formed by the image sensor.

Subsequently, in step S303, the image sensor 2245 performs detection processing of the deviation of the position. In this case, as illustrated in FIG. 20, in the main scanning direction, the position of the pattern PP is substantially the same as the central position of the light spots S3 and S4.

The pattern PP moves in the sub-scanning direction, and moves closer to the illumination regions (S1 to S11). The timing when the pattern PP is formed is already known. The position and the size of the formed pattern PP are known. Therefore, when the pattern PP is formed with the normal position and the normal size, the ON-control of the light-emitting units E3 and E4 is started with the timing of normal detection.

Figure 21:
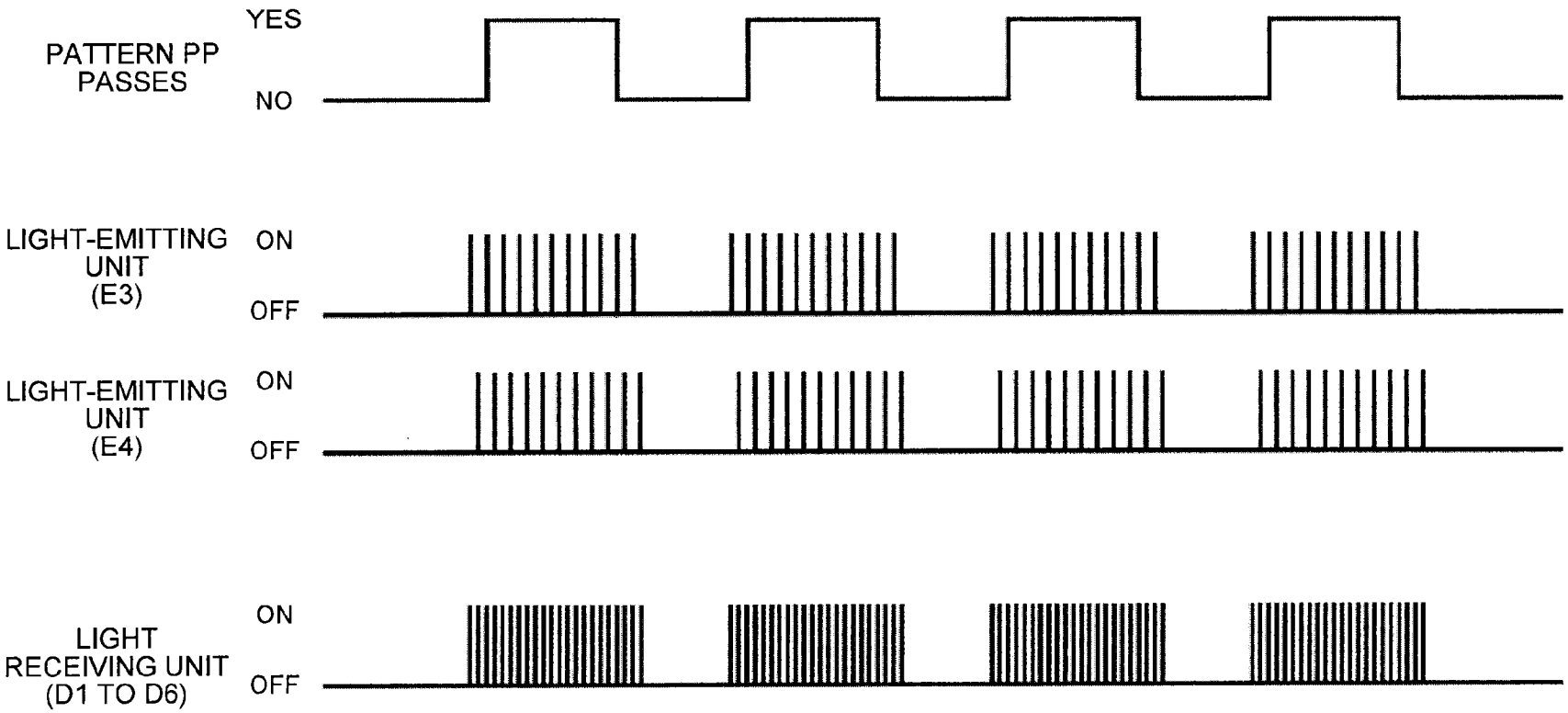
FIG. 21 is a timing chart illustrating an example of light emission timing of the image sensor.

In this case, FIG. 21 illustrates an example of timing when the pattern PP passes the illumination region, the light emission pattern of the light-emitting units E3 and E4, and the light-receiving pattern of the light-receiving units (D1 to D6). As illustrated in FIG. 21, in synchronization with the timing when the pattern PP on the intermediate transfer belt 2040 passes the illumination region, the light-emitting unit E3 and the light-emitting unit E4 emit light. The light emitted from the light-emitting unit E3 and the light-emitting unit E4 is reflected by the intermediate transfer belt 2040, and the reflected light is received by the light-receiving units (D1 to D6), and therefore, the light-receiving pattern is in synchronization with the light emission pattern.

The light spot S3 formed on the intermediate transfer belt 2040 by the light emission of the light-emitting unit E3 is substantially regularly reflected by the surface of the intermediate transfer belt 2040, and the light is received by the three light-receiving units D2 to D4, but the light is not received by the remaining light-receiving units. The light spot S4 formed on the intermediate transfer belt 2040 by the light-emitting unit E4 is substantially regularly reflected by the surface of the intermediate transfer belt 2040, and the light is received by the three light-receiving units D3 to D5, but the light is not received by the remaining light-receiving units. The amount of received light of each light-receiving unit can be obtained in a relative manner from the output level of each light-receiving unit.

More specifically, when the light spot Si from the light-emitting unit Ei is emitted onto the surface of the intermediate transfer belt 2040 and is regularly reflected, the reflected light is received by only the light-receiving unit Di corresponding to the light-emitting unit Ei and the light-receiving unit Di±1 adjacent thereto.

Distribution of the Amount of Received Light

Figure 22:
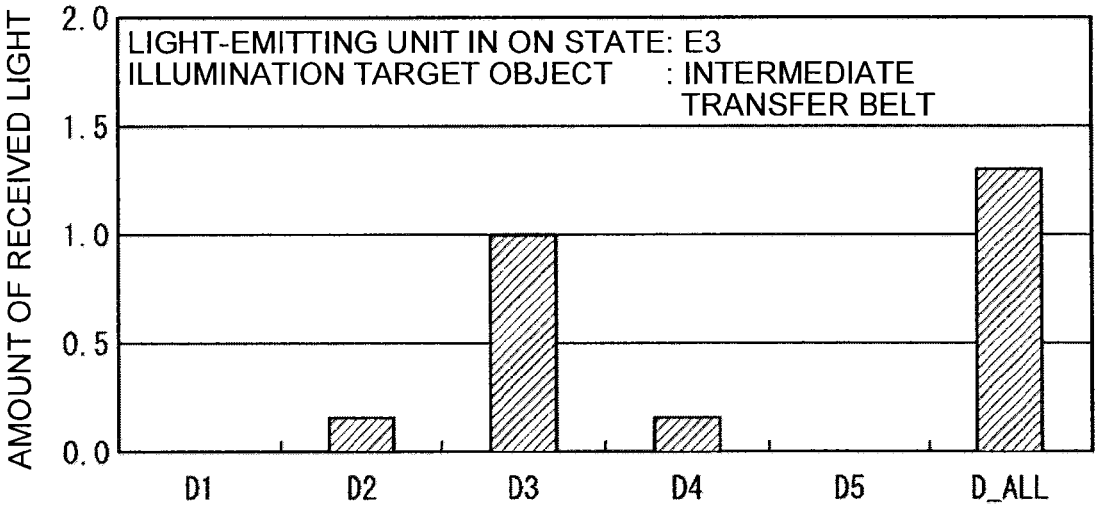
FIG. 22 is a graph illustrating an example of the amount of received light of the light-receiving unit of the image sensor.

Subsequently, the distribution of the amount of received light of the light-receiving units D1 to D5 with the ON state of the light-emitting unit E3 will be explained. FIG. 22 is a graph in which the horizontal axis denotes the light-receiving units for receiving the reflected light of the light emitted from the light-emitting unit E3, and the vertical axis denotes the amount of received light of the light-receiving unit, and illustrates the amount of received light of each light-receiving unit when only the light reflected by the surface of the intermediate transfer belt 2040 that is not formed with the pattern PP is received. The amount of received light of each light-receiving unit is represented as a ratio in a case where the amount of received light of the light-receiving unit D3 is one. "D_ALL" in the horizontal axis denotes a summation value of the amounts of received light of the light-receiving units D1 to D5.

The light spot S4 illuminating the line-shaped pattern LPM1 (see FIG. 16) is deviated by 0.4 mm in the main scanning direction with respect to the light spot S3. However, the distribution of the amounts of received light of the light-receiving units D2 to D6 with the ON state of the light-emitting unit E4 is deemed as substantially the same as the distribution of the amounts of received light of the light-receiving units D1 to D5 with the ON state of the light-emitting unit E3 (FIG. 22). Therefore, it is not illustrated in the figure.

As described above, after the timing when only the intermediate transfer belt 2040 is illuminated, the line-shaped patterns LPM1 to LPY2 constituting the pattern PP (see FIG. 16) are illuminated with predetermined timing, and the amounts of received light of the light-receiving units D1 to D6 due to the reflected light from the pattern PP are obtained successively.

Figure 23:
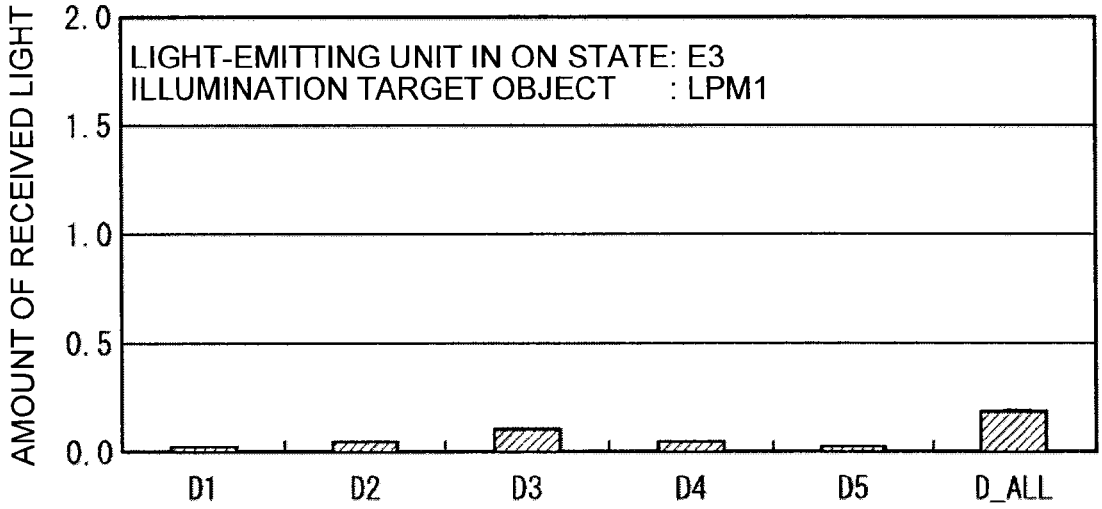
FIG. 23 is a graph illustrating another example of the amount of received light of the light-receiving unit of the image sensor.

Now, FIG. 23 illustrates an example of the distribution of the amounts of received light of the light-receiving units D1 to D5 when the line-shaped pattern LPM1 is illuminated with the ON state of the light-emitting unit E3. The reflected light from the line-shaped pattern LPM1 is received by the light-receiving units D1 to D5.

Figure 24:
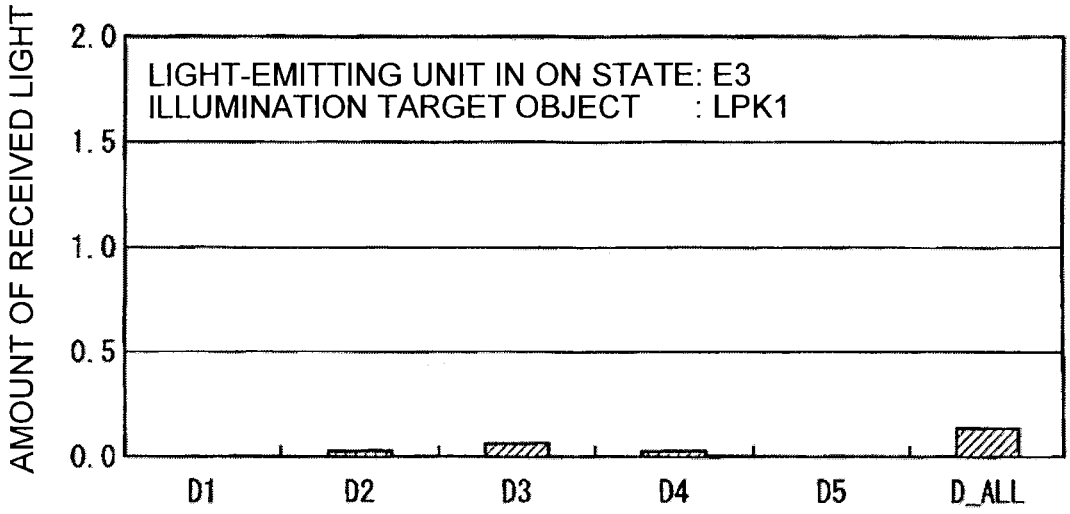
FIG. 24 is a graph illustrating still another example of the amount of received light of the light-receiving unit of the image sensor.

FIG. 24 illustrates an example of the distribution of the amounts of received light of the light-receiving units D1 to D5 when the line-shaped pattern LPK is illuminated with the ON state of the light-emitting unit E3. The reflected light from the line-shaped pattern LPK1 is received by the light-receiving units D2 to D4.

In this case, the distribution of the amount of received light of the light-receiving units D2 to D6 when the line-shaped pattern LPM1 is illuminated and the line-shaped pattern LPK1 is illuminated with the ON state of the light-emitting unit E4 is deemed as being substantially the same as the distribution of the amount of received light of the light-receiving units D1 to D5 with the ON state of the light-emitting unit E3 (FIG. 23, FIG. 24), and are omitted from the drawings.

Figure 25:
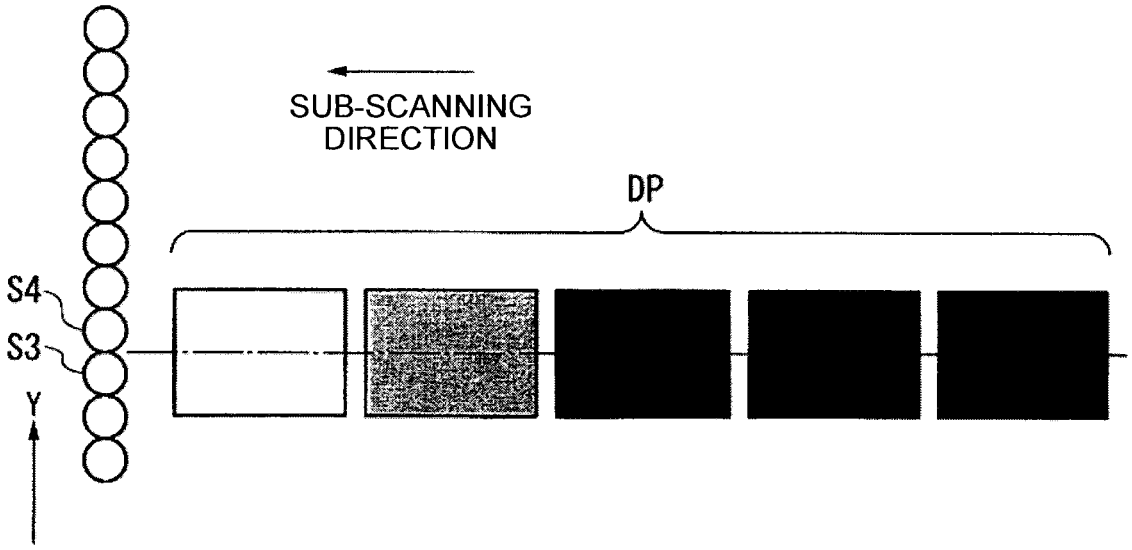
FIG. 25 is a top view for explaining relationship of the positions of the test pattern and the light spot formed by the image sensor.

Subsequently, in step S304, the detection processing of the toner the pattern DP for density detection is performed. In this case, only the image sensor 2245*b* is used. As illustrated in FIG. 25, in the main scanning direction, the central position of the rectangular pattern group (patch DP) is substantially the same as the position of the border between the light spot S3 and the light spot S4.

The toner the pattern DP for density detection moves in the sub-scanning direction along with the rotation of the intermediate transfer belt 2040, and it moves closer to the emission region of the light spot Si formed by the image sensor 2245*b*. The timing when the initial pattern DP for density detection moves closer to the emission region can be estimated from the elapsed time from when the pattern DP1 is formed. Then, with any timing when the pattern DP1 moves closer to the emission region, the light-emitting unit E3 and the light-emitting unit E4 are turned on in order.

First, before the rectangular patch p1 of the pattern DP1 (see FIG. 17), the amount of received light of each light-receiving unit is obtained when the illumination target object is the intermediate transfer belt 2040.

Figure 26:
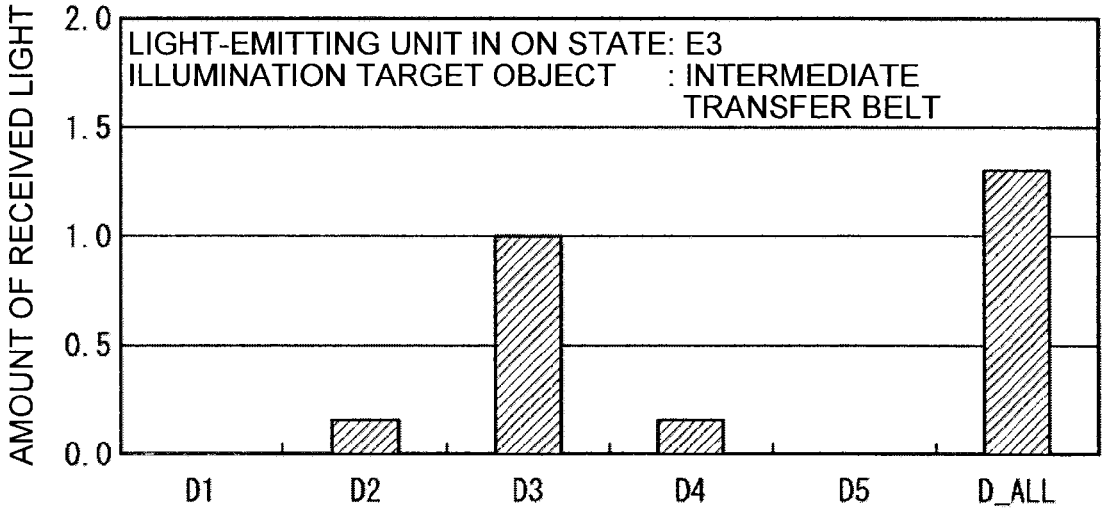
FIG. 26 is a graph illustrating an example of the amount of received light of the light-receiving unit of the image sensor.
Figure 27:
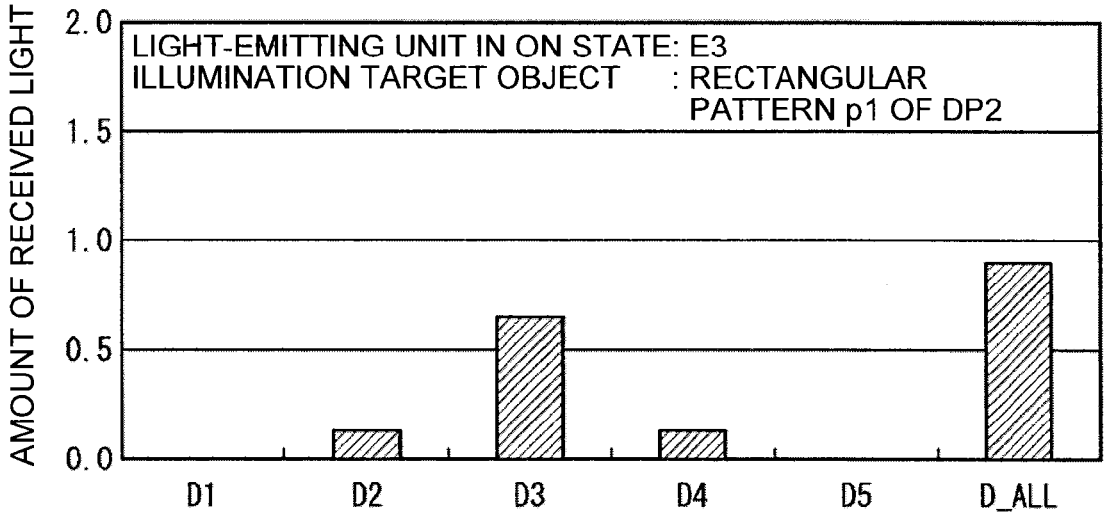
FIG. 27 is a graph illustrating another example of the amount of received light of the light-receiving unit of the image sensor.
Figure 28:
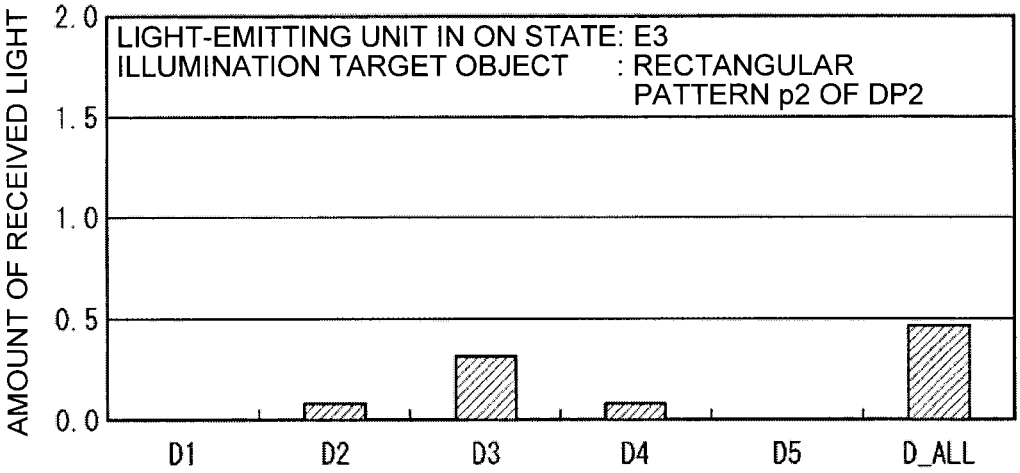
FIG. 28 is a graph illustrating still another example of the amount of received light of the light-receiving unit of the image sensor.
Figure 29:
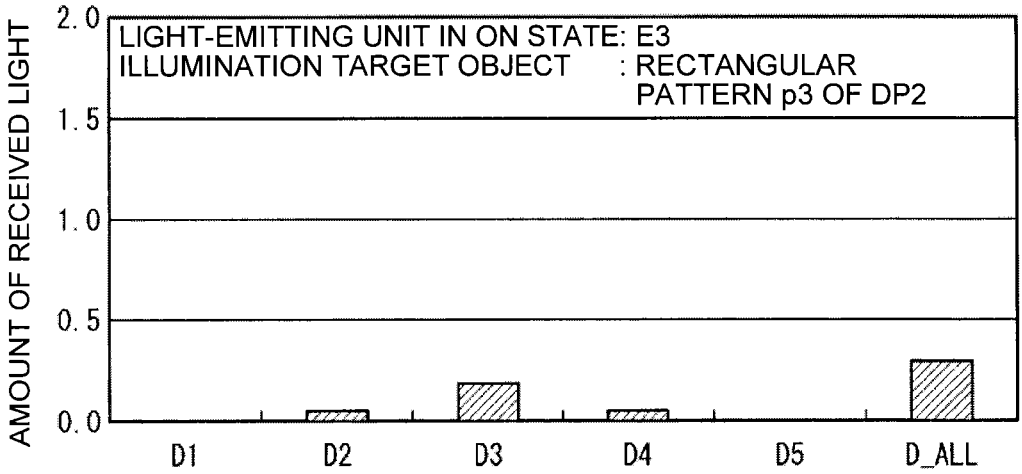
FIG. 29 is a graph illustrating still another example of the amount of received light of the light-receiving unit of the image sensor.
Figure 30:
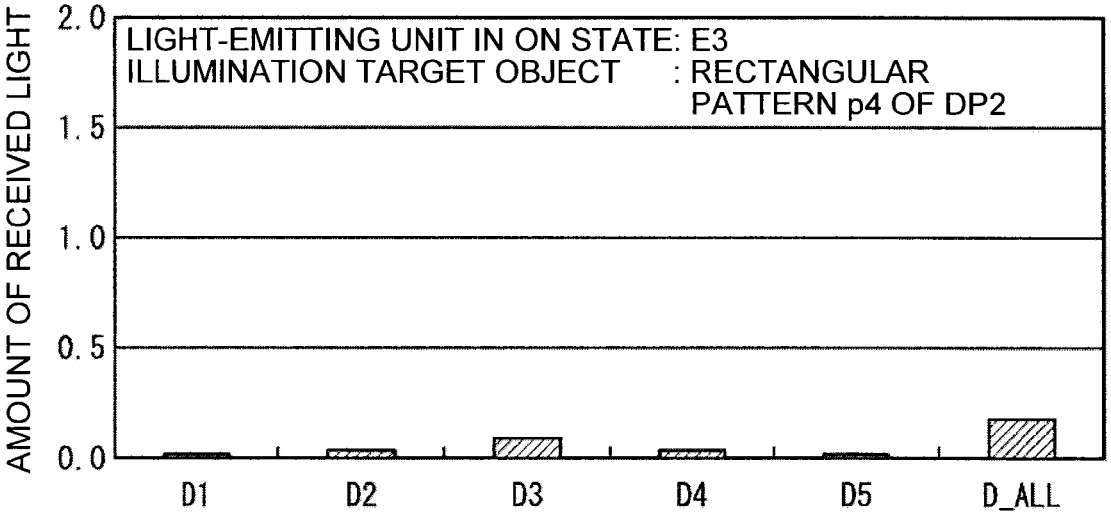
FIG. 30 is a graph illustrating still another example of the amount of received light of the light-receiving unit of the image sensor.
Figure 31:
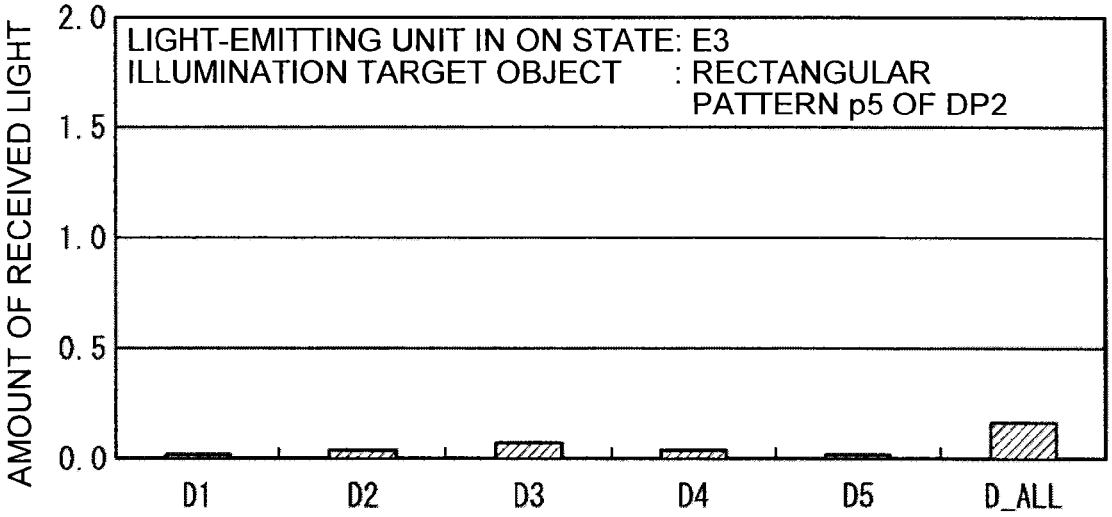
FIG. 31 is a graph illustrating still another example of the amount of received light of the light-receiving unit of the image sensor.

FIG. 26 is a graph in which the horizontal axis denotes the light-receiving units for receiving the reflected light of the light emitted from the light-emitting unit E3, and the vertical axis denotes the amount of received light of the light-receiving unit, and illustrates the amount of received light of each light-receiving unit when only the light reflected by the surface of the intermediate transfer belt 2040 that is not formed with the rectangular patch p1 is received. The amount of received light of each light-receiving unit is represented as a ratio in a case where the amount of received light of the light-receiving unit D3 is one. "D_ALL" in the horizontal axis denotes a summation of the amounts of received light of the light-receiving units D1 to D5. It should be noted that the distribution of the amount of received light of the light-receiving units D2 to D6 when the light-emitting unit E4 is turned on is deemed as being substantially the same as FIG. 26.

As described above, after the timing when only the intermediate transfer belt 2040 is illuminated, the rectangular patches p1 to p4 constituting the pattern DP (see FIG. 17) are illuminated with predetermined timing, and the amounts of received light of the light-receiving units D1 to D6 due to the reflected light from the pattern DP are obtained successively.

Subsequently, the amounts of received light of the light-receiving units D1 to D6 when the rectangular patches p1 to p5 are illuminated are successively obtained. In this case, in accordance with the timing when each rectangular patch p passes the illumination region, the light-emitting unit E3 and the light-emitting unit E4 are turned on in order, and with the timing when the rectangular patch p passes a portion close to the center of the illumination region, sampling is performed once by the light-receiving units D1 to D6.

FIGS. 27 to 31 illustrate an example of the amounts of received light of the light-receiving units D1 to D5 when the rectangular patches p1 to p5 of the pattern DP2 are illuminated by the light spot S3 with the ON state of the light-emitting unit E3.

The amounts of received light of the light-receiving units D2 to D6 when the rectangular patterns p1 to p5 of the pattern DP for density detection are illuminated by the light spot S4 with the ON state of the light-emitting unit E4 can be deemed as being the same as FIGS. 27 to 31.

Back to FIG. 19, subsequently, step S305, arithmetic processing for calculating the amount of the deviation of the position is performed on the basis of the detection result of the pattern PP for detection of the deviation of the position. This arithmetic processing may be a method using the regular-reflected light and a method using the diffusely reflected light. The method using the regular-reflected light is generally available, and therefore, in this case, the method using the regular-reflected light is used for the explanation.

Figure 32:
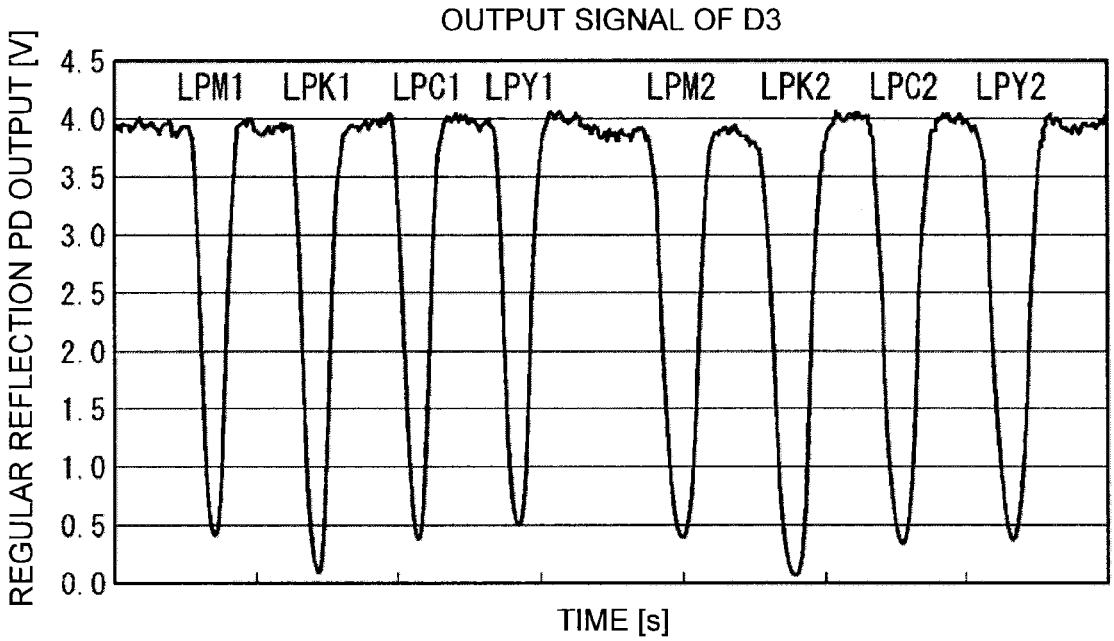
FIG. 32 is a graph illustrating an example of an output signal of the light-receiving unit of the image sensor.
Figure 33:
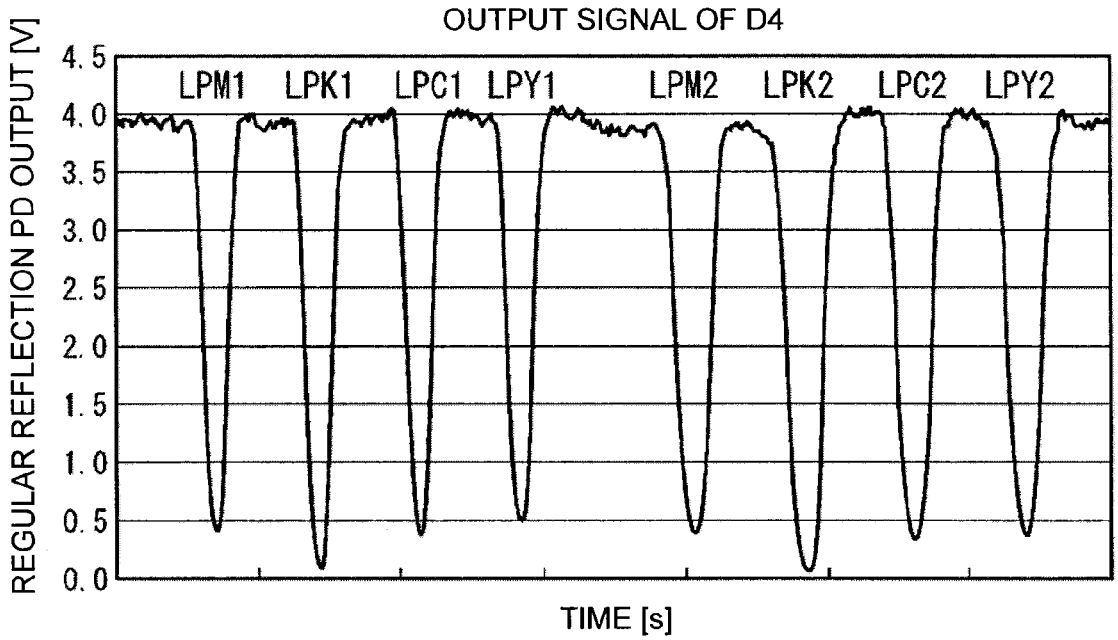
FIG. 33 is a graph illustrating another example of an output signal of the light-receiving unit of the image sensor.

When the light-emitting unit Ei is turned on, the regular-reflected light is received by three light-receiving units (Di−1, Di, Di+1). However, in order to simplify the arithmetic processing, only the amount of received light of the light-receiving unit Di is used. This is because, no matter whether the illumination target object is the intermediate transfer belt 2040 or the line-shaped pattern (LPM2 to LPY2), the amounts of received light of the light-receiving unit Di−1 and the light-receiving unit Di+1 are extremely small as compared with the amount of received light of the light-receiving unit Di as illustrated in FIGS. 22 to 24 when the regular-reflected light is considered. Therefore, no problem would be caused when the arithmetic processing for detecting the deviation of the position of the pattern PP is performed with only the amount of received light of the light-receiving unit Di. Detection processing of the deviation of the position of the pattern PP In this case, the detection of the deviation of the position of the pattern PP will be explained using the waveform pattern of the output signal which is output when the light-receiving units D3 and D4 receive the reflected light of the light emitted from the light-emitting unit Ei will be explained. FIG. 32 illustrates an example of an output signal pattern of the light-receiving unit D3. FIG. 33 illustrates an example of an output signal pattern of the light-receiving unit D4.

In both of FIGS. 32 and 33, the horizontal axis denotes time (s), and the vertical axis denotes output level (v) of the light-receiving unit D3 or D4. Numerical values attached to the vertical axis are illustrated as examples, and the output values of the light-receiving unit of the image sensor 2245 is not limited thereto. A time in the horizontal axis denotes an elapsed time since a predetermined time. This is used to indicate that, as the elapsed time when the light-emitting unit E3 or E4 are turned on in order, each pattern PP is detected, and the output signal of the light-receiving unit Di varies.

In FIG. 32, the power of light emission of the light-emitting unit E3 is adjusted so that the output of the light-receiving unit D3 becomes about 4 V when the illumination target object is the intermediate transfer belt 2040. As illustrated in FIG. 33, the output signal of the light-receiving unit D4 is the same. The power of light emission is adjusted by controlling an electric current value supplied to the light-emitting unit Ei.

When the illumination target object becomes the pattern PP, the level of the output signal of the light-receiving unit D3 decreases. In FIG. 32, first, the output signal changes due to the first pattern group PP1. More specifically, when the four line-shaped patterns LPM1, LPK1, LPC1, LPY1 constituting the first pattern group PP1 (see FIG. 16) become the illumination target object, the amount of reflected light of the light spot S3 illuminating each pattern decreases due to the absorption of the pattern PP. As a result, the amount of received light of the light-receiving unit D3 decreases, and the level of the output signal from the light-receiving unit D3 decreases. The level of the output signal of the light-receiving unit D3 decreases more greatly when the illumination target object is black toner than when it is color toner. The level of the output signal of the light-receiving unit D3 decreases more greatly when the illumination target object is the second pattern group PP2 than when it is the first pattern group PP1.

As illustrated in FIG. 33, the output signal of the light-receiving unit D4 also changes with substantially the same tendency as the output signal of the light-receiving unit D3. However, the light-emitting unit E3 and the light-emitting unit E4 are turned on in order, and therefore, because of the delay of light emission time 6T of the light-emitting unit E4 with respect to the light-emitting unit E3, the output signal of the light-emitting unit E4 is delayed by δT with respect to the output signal of the light-emitting unit E3 as a whole.

Figure 34:
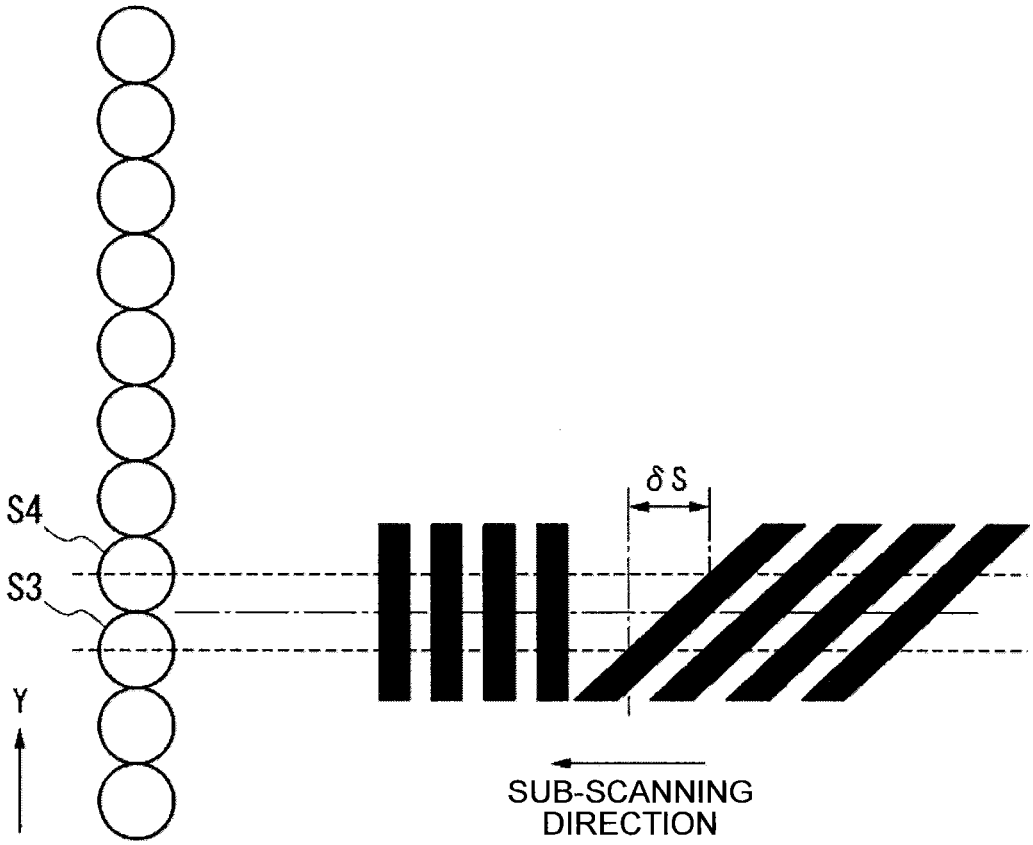
FIG. 34 is a top view for explaining relationship of the positions of the test pattern and the light spot formed by the image sensor.

When the second pattern group PP2 is considered, there is greater difference in the output signals of the light-emitting unit E3 and the light-emitting unit E4. This will be explained with reference to FIG. 34. As illustrated in FIG. 34, the second pattern group PP2 is inclined with respect to the row of the light spot Si. In this case, the difference between the time when the light-emitting unit E3 illuminates the second pattern group PP2 and the time when the light-emitting unit E4 illuminates the second pattern group PP2 is a time difference obtained by subtracting the distance corresponding to δS from the moving speed of the intermediate transfer belt 2034. More specifically, the illumination of the light-emitting unit E4 is delayed by δS with respect to the illumination with the light-emitting unit E3. It should be noted that the first pattern group PP1 is parallel to the main scanning direction, and therefore, the delay corresponding to δS is not caused.

As described above, the difference of the waveform in time that is caused by the delay of light emission time δT is known.

For example, suppose that each of the light-emitting unit E3 and the light-emitting unit E4 emits light a 50 kHz, i.e., the light is emitted at totally 100 kHz. The delay of light emission time δT at this occasion is 10 μs. On the other hand, when the deviation of the light-emitting unit position in the main scanning direction is 0.4 mm, and the moving speed of the intermediate transfer belt is 280 mm/s, the delay of the output signal between the first pattern group PP1 and the second pattern group PP2 is 1.4 ms.

More specifically, when the variations of the output signal of the light-receiving units D3 and D4 based on the reflected light from the pattern PP illuminated by the light-emitting unit E3 and the light-emitting unit E4 are used in order to detect the position of the pattern PP, the deviation of the output signal of each light-receiving unit in terms of time is known. Therefore, by considering the deviation thereof in terms of time, the position of the pattern PP based on each output signal can be detected with a high degree of accuracy.

Figure 35:
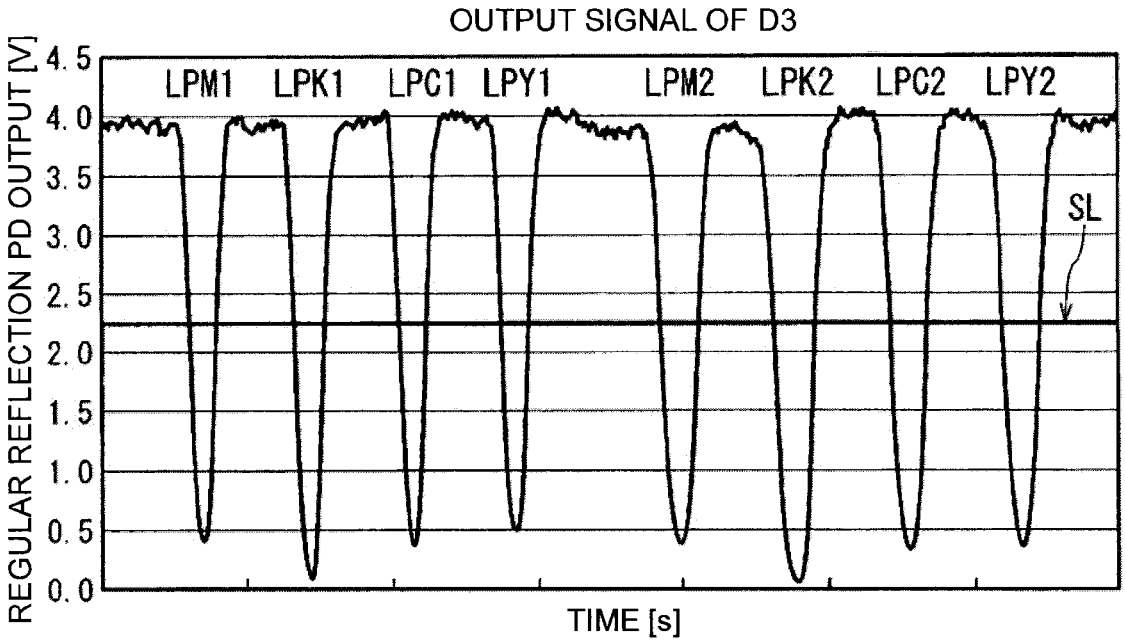
FIG. 35 is a graph illustrating an example of an output signal of the light-receiving unit of the image sensor.

Subsequently, the detection method of each line-shaped pattern constituting the pattern PP using the output signals of the light-receiving units D3 and D4 will be explained. As illustrated in FIG. 35, a threshold level SL serving as a predetermined threshold value is set for the output signal as illustrated in FIG. 32, and the center of the two points where the output signal crosses the threshold level SL is defined as a detection time T of each line-shaped pattern. It should be noted that the threshold level SL may be set at any level, but in this case, it is 2.25 V which is an average value of 4.0 V which is Vsg level and 0.5 V which is the minimum value of LPM1, LPK1, LPC1, LPY1 when the light is attenuated by the line-shaped pattern.

Figure 36:
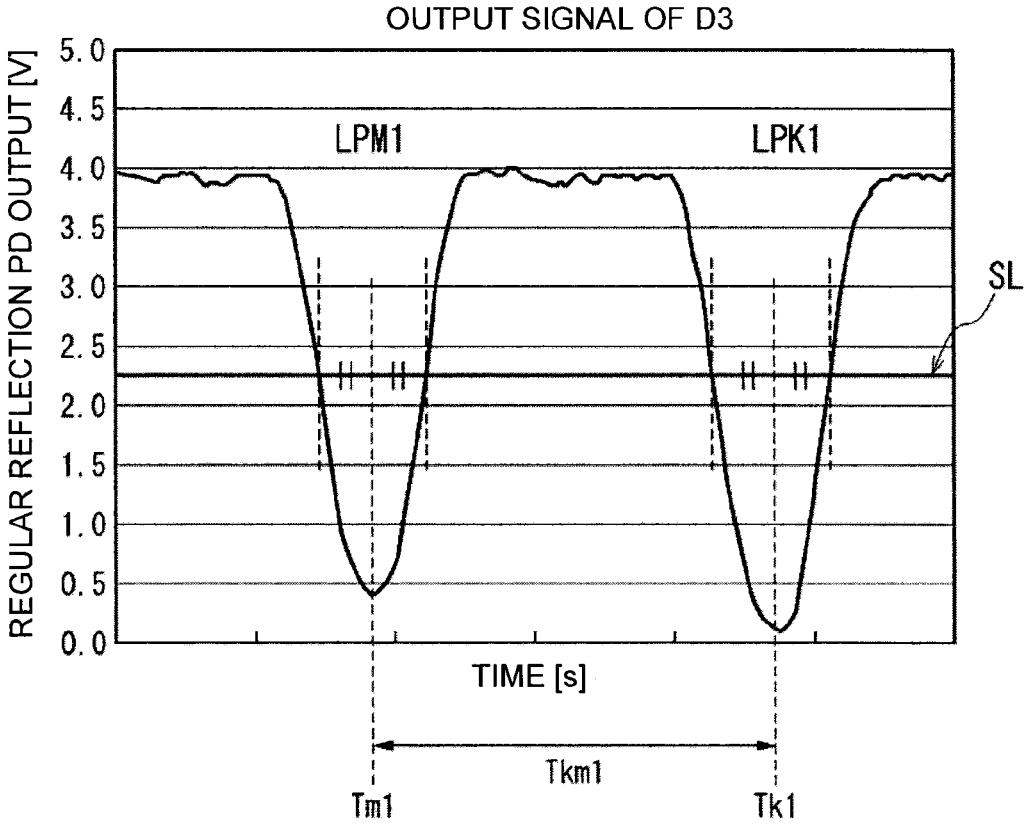
FIG. 36 is an enlarged graph illustrating a portion of an example of the output signal of the light-receiving unit of the image sensor.

The detection time of the pattern PP will be explained in detail. FIG. 36 is a signal pattern diagram which enlarges and illustrates a portion of the output signal pattern as illustrated in FIG. 35. As illustrated in FIG. 36, each of times at two points where the output signal of the portion of the line-shaped pattern LPM1 crosses the threshold level SL can be detected. The timing according to which the pattern PP is formed is known, and therefore, normal positions where LPM1, LPK1, and the like are formed are known. Therefore, the timing according to which the pattern PP is formed is adopted as a reference time, and the elapsed time since there and the time when the output signal of the light-receiving unit D3 crosses SL are obtained, whereby the time Tm1 of the center of these two points can be calculated. Likewise, a time of the center of the two points where the output signal of the portion of the line-shaped pattern LPK1 crosses the threshold level SL is calculated as Tk1. A time difference Tkm1 between Tk1 and Tm1 is calculated using them.

Figure 37:
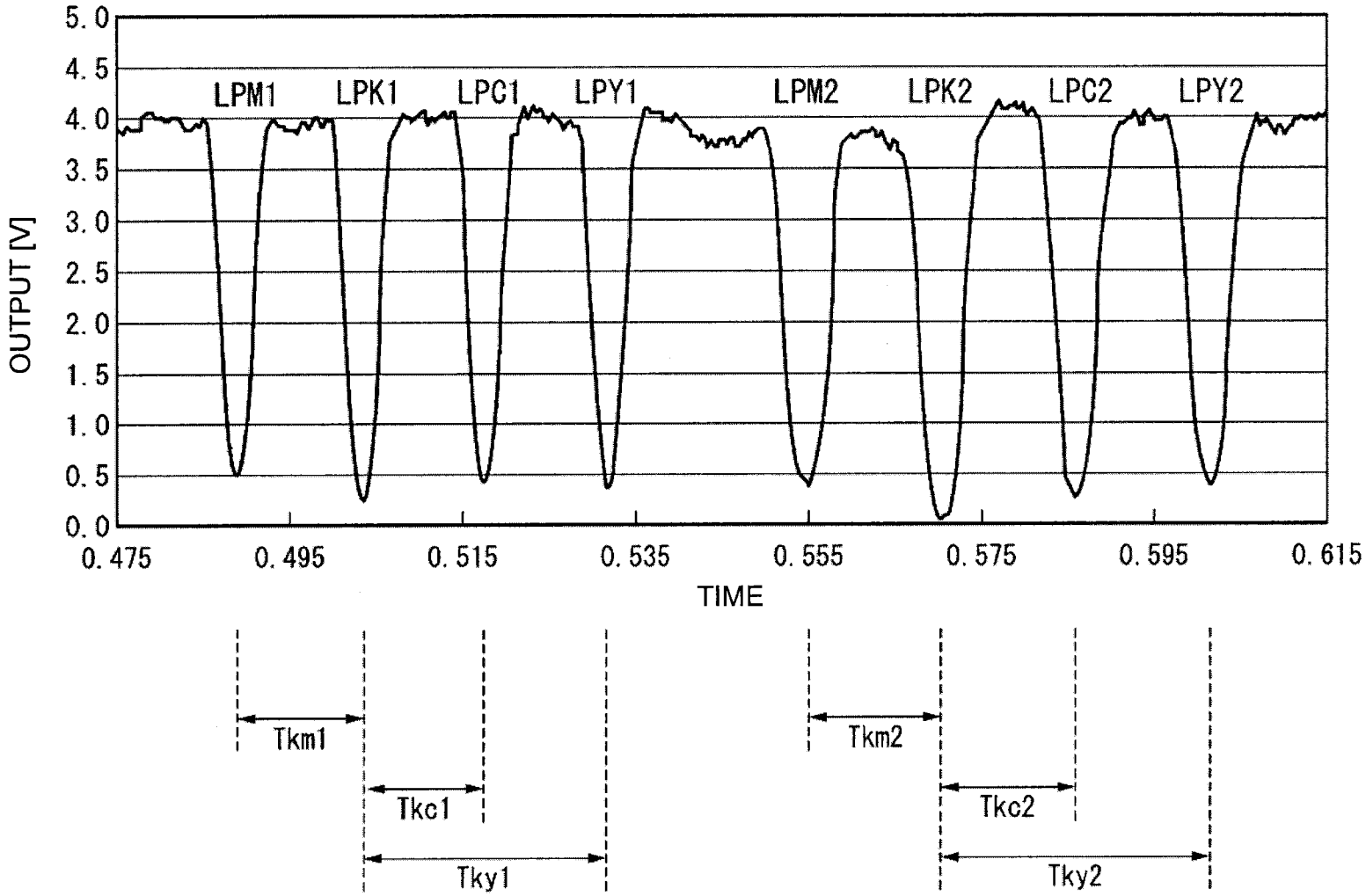
FIG. 37 is a graph illustrating an example of an output signal of the light-receiving unit of the image sensor.

The portions of the other line-shaped patterns (LPC1, LPY1) can also be calculated as follows. As illustrated in FIG. 37, when the time Tk1 is adopted as a reference, a time Tkc1 from when the line-shaped pattern LPK1 is detected to when the line-shaped pattern LPC1 is detected and a time Tky1 from when the line-shaped pattern LPK1 is detected to when the line-shaped pattern LPY1 is detected can be calculated.

Likewise, a time from when the line-shaped pattern LPM2 is detected to when the line-shaped pattern LPK2 is detected can be calculated as Tkm2, a time from when the line-shaped pattern LPK2 is detected to when the line-shaped pattern LPC2 is detected can be calculated as Tkc2, and a time from when the line-shaped pattern LPK2 is detected to when the line-shaped pattern LPY2 is detected can be calculated as Tky2.

Figure 38A:
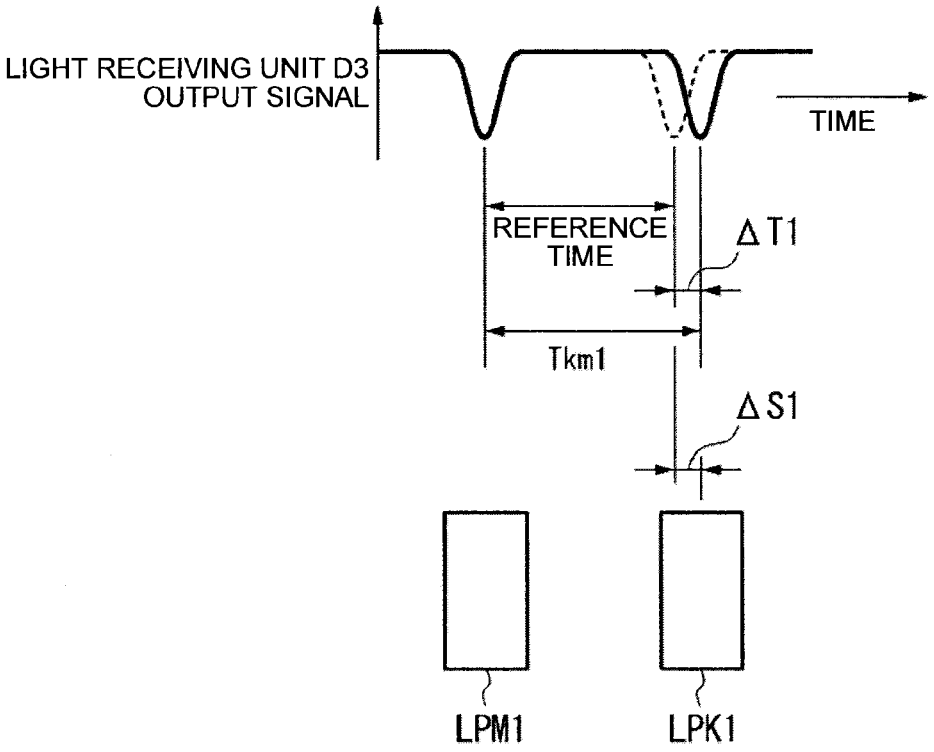
FIGS. 38A and 38B are enlarged graphs illustrating a portion of an example of the output signal of the light-receiving unit of the image sensor.

Calculation Method of the Amount of the Deviation of the Position of the Image of Each Color As described above, by calculating the difference of the detection times of the line-shaped patterns, the amount of the deviation of the position of the toner image of each color forming the pattern PP can be calculated. As illustrated in FIG. 38A, the time Tkm1, the time Tkc1, and the time Tky1 are compared with each reference time obtained in advance, and the time difference ΔT1 is calculated. Because the moving speed V of the intermediate transfer belt 2040 is known, a value obtained by multiplying V and ΔT1 (V·ΔT1) is the amount of positional deviation ΔS1 of magenta (line-shaped pattern LPM1), cyan (line-shaped pattern LPC1), and yellow (line-shaped pattern LPY1) in the sub-scanning direction, with respect to the toner image of black serving as the reference (line-shaped pattern LPK1).

Figure 38B:
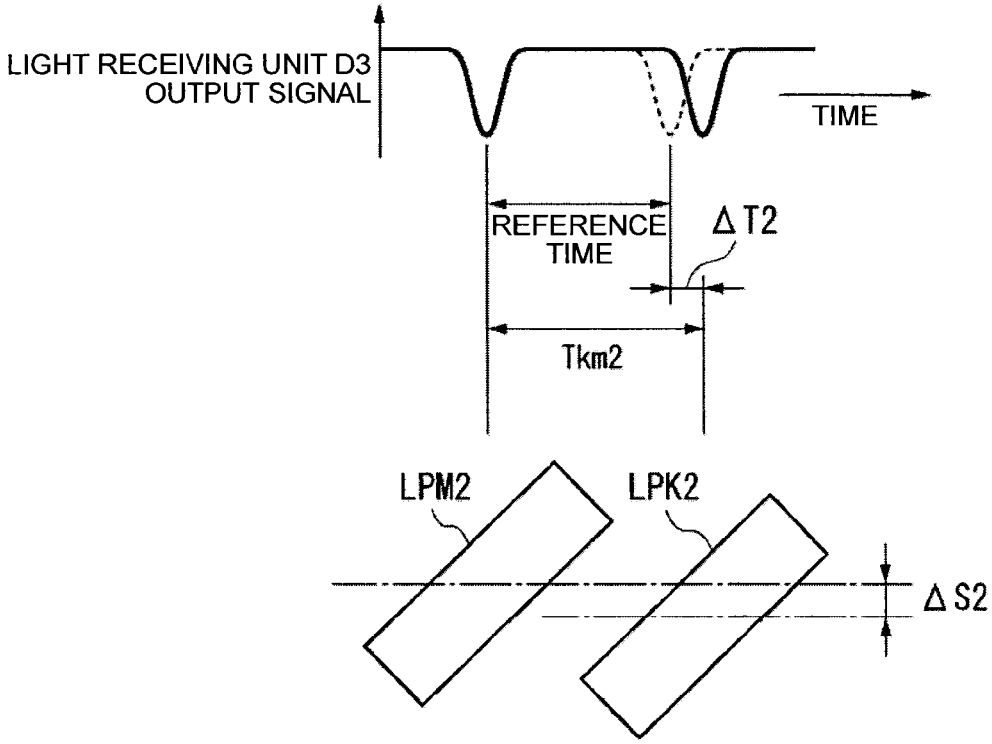

In the second pattern group PP2, as illustrated in FIG. 38B, the time Tkm2, the time Tkc2, and the time Tky2 are compared with each reference time obtained in advance, and the time difference ΔT2 is calculated. Because the moving speed V of the intermediate transfer belt 2040 is known, a value obtained by multiplying a value obtained by multiplying V and ΔT2 by a value of cosine of the inclination angle θ of the second pattern group PP2 with respect to the main scanning direction (V·ΔT2·cos θ) is the amount of positional deviation ΔS2 of magenta (line-shaped pattern LPM2), cyan (line-shaped pattern LPC2), and yellow (line-shaped pattern LPY2) in the main scanning direction, with respect to the toner image of black serving as the reference (line-shaped pattern LPK2).

By detecting the pattern PP as described above, the size and the direction of the deviation of the position can be calculated.

Back to FIG. 19, subsequently, in step S306, the arithmetic processing of the toner density is performed on the basis of the detection result of the toner pattern for density detection.

Subsequently, in step S307, the condition of the image forming process is adjusted. In this case, first, on the basis of the amount of the deviation of the position detected in the detection processing of the deviation of the position (S303), adjustment is made such that the amount of deviation of black in the sub-scanning direction with respect to the toner image becomes zero. For example, the scanning control device is commanded to change the write timing of the image of the K station. Alternatively, for example, the scanning control device is commanded to make phase adjustment of pixel blocks in the K station, so that the amount of deviation of black in the main scanning direction with respect to the toner image becomes zero. Similar processing is performed for the M station, the C station, and the Y station.

Subsequently, on the basis of the toner density obtained in the density detection processing (S306), the amount of deviation of the toner density is obtained for each color of toner. Then, various kinds of adjustments related to the toner density are made so that the amount of deviation of the toner density becomes zero or the amount of deviation of the toner density is within an allowable range.

For example, in accordance with the amount of deviation of the toner density, in the corresponding image forming station, at least one of the power of the light beam emitted from the light source, the duty, the charge bias, and the developing bias of the driving pulse supplied to the light source.

By the way, the image density control for maintaining the image density includes development potential control and gradation control. In the development potential control, in order to ensure desired image density (for example, solid-fill density), the development potential (developing bias-solid-fill exposure potential) is controlled. More specifically, a development y and a development start voltage Vk are obtained from the development potential and the toner density obtained from the toner the pattern DP for density detection.

The development potential [−kV] required to ensure the desired image density is determined from desired image density (toner density) [mg/cm2]/developing y [(mg/cm2)/(−kV)]+development start voltage Vk [−kV]. On the basis of this development potential, image forming conditions (exposure power, charge bias, developing bias) are determined.

When the amount of charge of the toner and the development potential are constant, the development y is substantially maintained, but in an environment where the temperature and the humidity change, the amount of charge of the toner inevitably changes, and the characteristics of the gradation in the middle gradation region are changed. The gradation control is performed to correct this. The gradation control may also use the same pattern DP for density detection as the development potential control.

In the gradation control, a gradation correction LUT (look up table) is changed as necessary, so that there is no deviation between the target characteristics of the gradation and the characteristics of the gradation obtained. More specifically, there are a method for rewriting the gradation correction LUT with a new gradation correction LUT on every occasion and a method for selecting an appropriate one from multiple gradation correction LUTs prepared in advance.

Abnormality Determination Method on Moving Member

In the correction processing of the amount of the deviation of the position explained above, it is necessary to detect the pattern PP with a high degree of accuracy. However, when a fine scratch or stain attaches to the intermediate transfer belt 2040 formed with the pattern PP, it is impossible to correctly detect the pattern PP with only the above processing. Accordingly, in the image forming apparatus according to the present invention, the detection processing of the pattern PP explained below is used, so that even when there is a fine scratch or stain on the intermediate transfer belt 2040, the pattern PP is detected with a high degree of accuracy, and as described above, the accuracy of correction of the condition related to the image forming process is enhanced.

When a scratch or a stain occurs on the intermediate transfer belt 2040, the color printer 2000 according to the present embodiment can determine whether there is any abnormal output superimposed on the reflected light output from the pattern PP for detection of the deviation of the position, and the pattern PP can be detected correctly.

Figure 39:
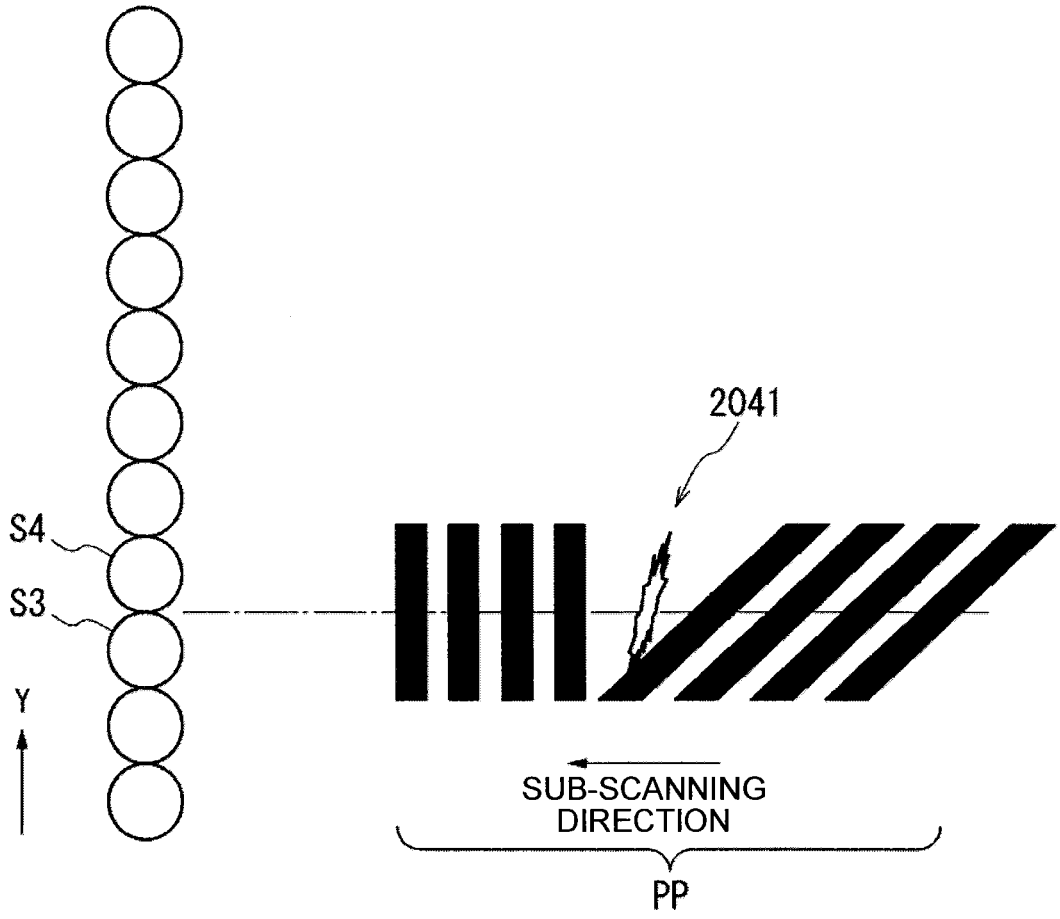
FIG. 39 is a top view for explaining relationship of the positions of the test pattern and the light spot formed by the image sensor.

FIG. 39 is a schematic diagram illustrating an example of a state where there is a scratch 2041 at a position where the pattern PP on the intermediate transfer belt 2040 is formed. In FIG. 39, the scratch 2041 is made between the first pattern group PP1 and the second pattern group PP2. Among the light spots Si arranged along the main scanning direction, the central position of the pattern PP in the main scanning direction exists in proximity to the border, in the main scanning direction, between the light spot S3 formed by the light-emitting unit E3 and the light spot S4 formed by the light-emitting unit E4. In many cases, the size of the scratch made in the surface of the intermediate transfer belt 2040 is actually extremely small as compared with the size of the pattern PP. In FIG. 39, the size of the scratch 2041 is exaggerated for the sake of explanation.

Figure 40:
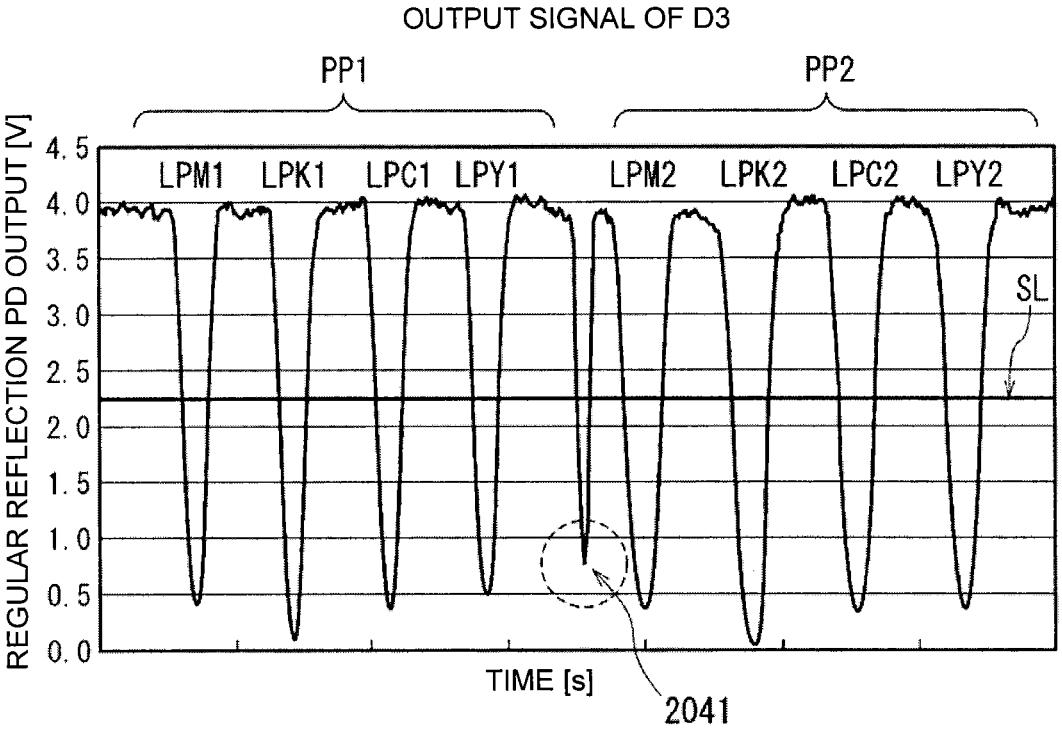
FIG. 40 is a graph illustrating an example of an output signal of the light-receiving unit of the image sensor.

As already explained above, in accordance with the timing when the pattern PP passes the position where the light spot Si is formed, the light-emitting unit E3 and the light-emitting unit E4 are turned on in order, and in synchronization with this ON state, sampling of the output signal is performed with the light-receiving units D1 to D6. FIG. 40 illustrates an example of output signal of the light-receiving unit D3 in synchronization with this ON state of the light-emitting unit E3. The output signal level is reduced between the first pattern group PP1 and the second pattern group PP2, and this reduction of the output signal level is not caused by the pattern PP. This is the reduction of the output signal level caused by the scratch 2041.

The pattern PP includes the eight line-shaped test patterns, and therefore, when the center of the two points where the output signal of the light-receiving unit D3 crosses the threshold level SL is defined as a detection time of the pattern PP, the number of times the pattern PP is detected is counted on the basis of the number of times the output signal crosses the threshold level SL. Then, the variation of the output signal due to the scratch 2041 is falsely detected as the variation caused by the line-shaped pattern LPM2. Moreover, because of this false detection, the eighth line-shaped test pattern LPY2 is not counted.

In order to cope with this, for example, the threshold level SL may be reduced (for example, 0.7 V), so that the output signal due to the scratch 2041 does not come across the threshold level SL, but at an upper portion (around 4 V) and a lower portion (around 0.5 V) of the output signal waveform due to the pattern PP is likely to change as it is be affected by the change of the density of the pattern PP itself, and this may result in instability of the output signal waveform. In general, the threshold level SL is close to the center of the upper portion and the lower portion of the output signal waveform (corresponding to 50%, and in this case, it is 2.25 V), and is preferably set at around 40 to 60%. Therefore, the reduction of the threshold level SL is not effective for preventing the false detection as described above.

Figure 41:
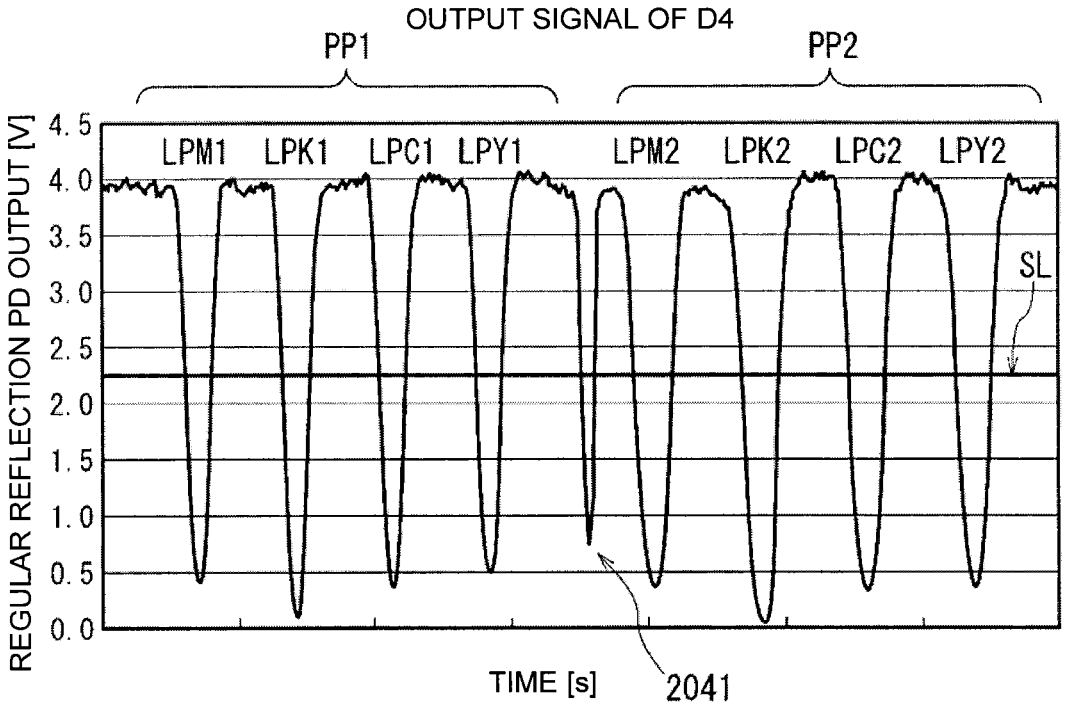
FIG. 41 is a graph illustrating an example of an output signal of the light-receiving unit of the image sensor.

FIG. 41 illustrates an example of the output signal pattern of the light-receiving unit D4 when the light-emitting unit E4 is turned on. As already explained above, the output signal of the light-receiving unit D4 is delayed in terms of time with respect to the output signal of the light-receiving unit D3, but the time difference thereof is known. Therefore, by correcting the time difference between the output signal of the light-receiving unit D3 and the output signal of the light-receiving unit D4, both of them are considered to be made into substantially the same output signal pattern.

More specifically, when the difference of the output signal of the light-receiving unit D3 and the output signal of the light-receiving unit D4 includes an abnormality, this means that the light is reflected light that is different from the reflected light from the position detection pattern PP (the first pattern group and the second pattern group).

In other words, the difference between the output signal of D3 and the output signal of D4 is known, and therefore, when the time position of any one of the output signals is corrected with a known value, and the difference from the other of them is adopted, then, the value of the signal corresponding to the difference becomes zero. It is to be understood that the reflected lights from the pattern PP for position detection and the moving member are not completely the same value, and therefore, the value does not become completely zero.

However, when there is the scratch 2041, even if the time difference of the output signal of the light-receiving unit D3 and the output signal of the light-receiving unit D4 is corrected, there remains difference in the output signal patterns of them both. This is because the light-receiving units D3 and D4 receive the reflected light caused by a reason (scratch 2041) that is different from the pattern PP (the first pattern group and the second pattern group) detected with the reflected light by the light spot S3 or the light spot S4, and this is superimposed on the output signal of each of them.

Figure 42:
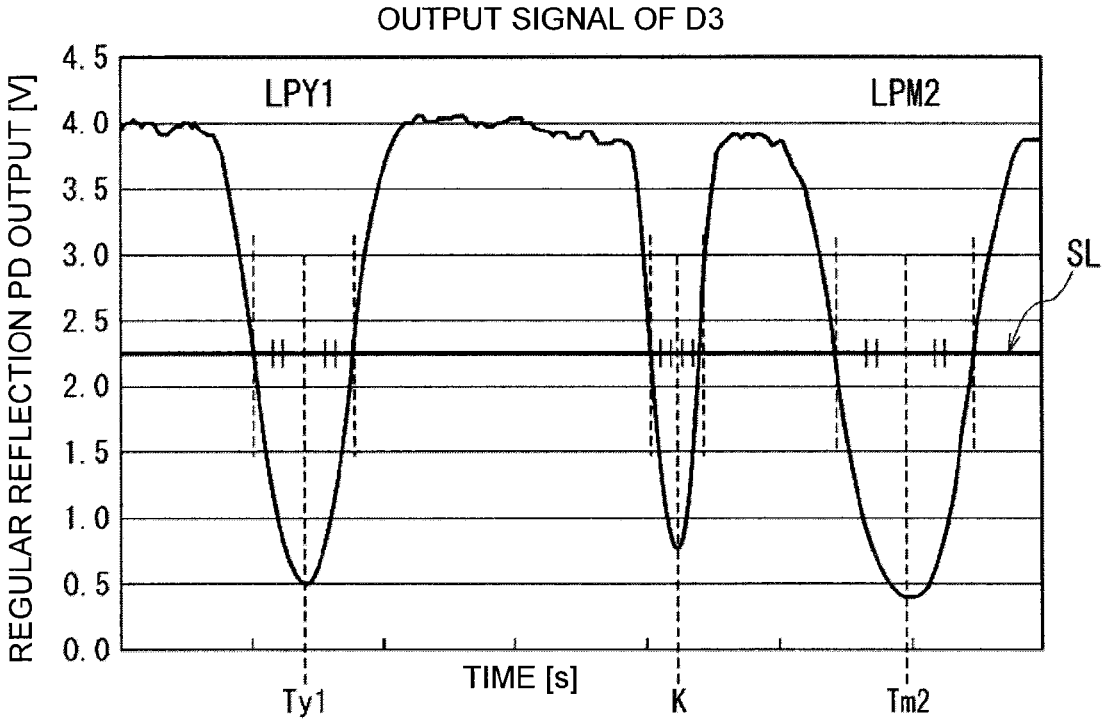
FIG. 42 is an enlarged graph illustrating a portion of an example of the output signal of the light-receiving unit of the image sensor.
Figure 43:
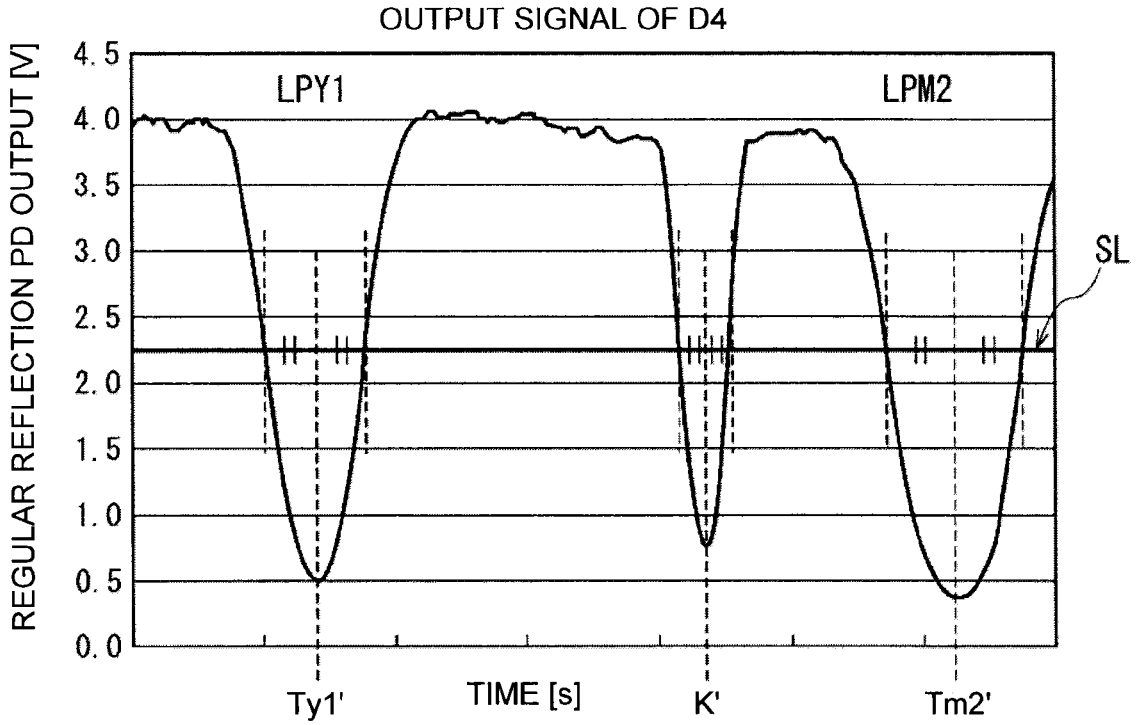
FIG. 43 is an enlarged graph illustrating a portion of an example of the output signal of the light-receiving unit of the image sensor.

FIGS. 42 and 43 illustrate diagrams which enlarge the output signal of a portion related to the line-shaped patterns LPY1 and LPM2 of the output signal as illustrated in FIGS. 40, 41. As described above, using the output signal of the light-receiving unit D3, detection times Ty1 and Tm2 of the line-shaped patterns LPY1 and LPM2 can be calculated. Likewise, the detection time K of the scratch 2041 can be calculated. Likewise, in the output signal of the light-receiving unit D4, detection times Ty1' and Tm2' of the line-shaped patterns LPY1 and LPM2 can be calculated, and a detection time K' of the scratch 2041 can be calculated.

The time difference between the time Ty1 and the time Ty1' which are the detection times of the first pattern group PP1 is known, and the time difference between the time Tm2 and the time Tm2' which are the detection times of the second pattern group is known. This means that, by calculating the difference (time) of these times and comparing them with known times, the variation of the output signal can be determined to be caused by the pattern PP for detection of the deviation of the position. However, the difference between the detection time K and the detection time K' due to the scratch 2041 is unknown. Therefore, by calculating the difference (time) of these times and comparing them with known times, it is possible to determine that they are different times. In this manner, it is possible to determine abnormality (abnormal output) in the output signal caused by the scratch 2041.

Second Embodiment of Image Forming Apparatus

Figure 44:
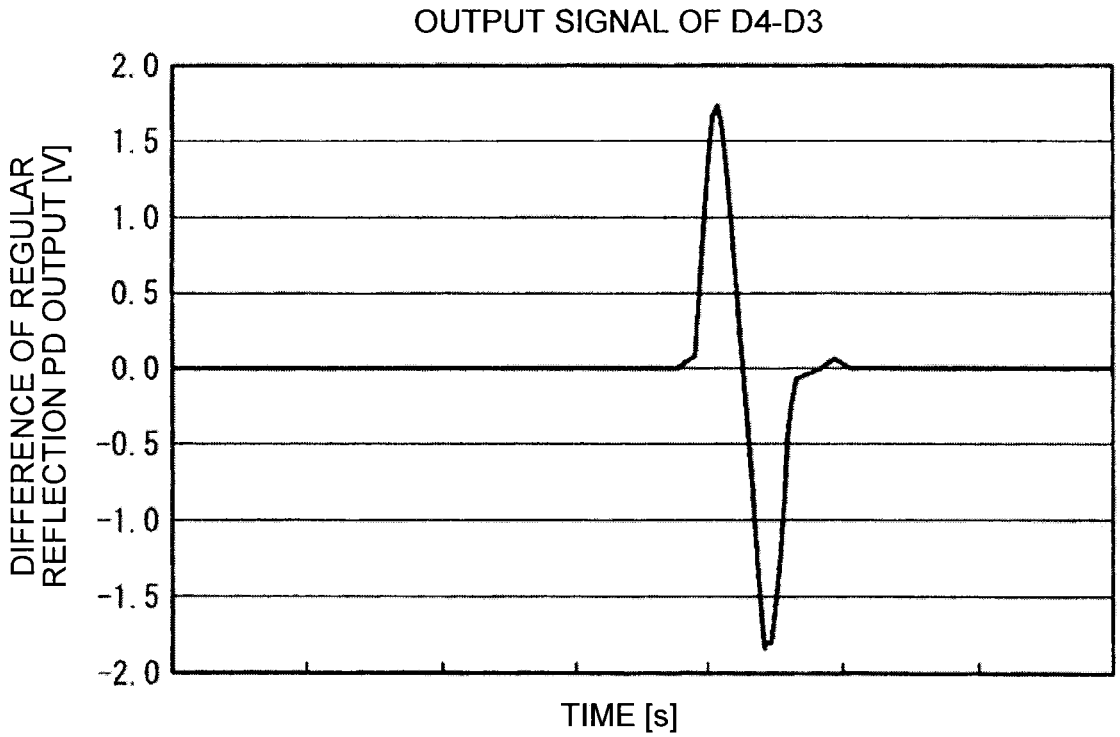
FIG. 44 is a graph illustrating an example of a difference of the output signal of the light-receiving unit of the image sensor.

Subsequently, another embodiment of an image forming apparatus according to the present invention will be explained with reference to FIG. 44. FIG. 44 is an example of a difference of the output signal of the light-receiving unit D3 and the output signal of the light-receiving unit D4, wherein delays of times are corrected using known values for the output signal of the light-receiving unit D3 as illustrated in FIG. 42 and the output signal of the light-receiving unit D4 as illustrated in FIG. 43.

As illustrated in FIG. 44, concerning the variation of the output signal caused by the line-shaped pattern LPY1 and the line-shaped pattern LPM2, the delays of times are corrected using the known values, so that the difference thereof becomes substantially zero. However, the portion corresponding to the detection time of the scratch 2041 clearly appears as a high signal intensity. As described above, using the difference of the output signals of the two light-receiving units D3 and D4, the reflected light from the pattern PP and the reflected light from an unknown scratch 2041 can be clearly separated and distinguished from each other. Accordingly, a determination can be made as to whether there is abnormal output from the light-receiving unit caused by the scratch 2041.

As described above, according to the color printer 2000 of the present embodiment, abnormal signal output of the light-receiving unit caused by the scratch can be determined even if the scratch 2041 exists in the intermediate transfer belt 2040 which is the moving member. When the abnormal output can be determined, the effect of the abnormal output can be eliminated in the correction processing of the deviation of the position explained above, and the correction processing of the deviation of the position can be performed accurately.

Third Embodiment of Image Forming Apparatus

Subsequently, still another embodiment of an image forming apparatus according to the present invention will be explained. As described above, with the light spots S3 and S4 formed by the lights emitted from the light-emitting unit E3 and the light-emitting unit E4, abnormal output caused by the scratch 2041 is determined using the difference of the output signals of the light-receiving units D3 and D4, and in addition, abnormal output may be determined including the difference of the times when the pattern PP is detected. In this case, the reliability of the detection of the scratch 2041 can be enhanced. When abnormal output due to the scratch 2041 is determined using only one of the difference of the times when the pattern PP is detected and the difference of the output signals, this can reduce the chance of failing to determine the scratch 2041.

Fourth Embodiment of Image Forming Apparatus

Subsequently, still another embodiment of an image forming apparatus according to the present invention will be explained. As illustrated in FIGS. 42 and 43, even when the difference between a time K and a time K' when the scratch 2041 is detected is unknown, the effect of abnormal signal output can be eliminated. More specifically, ΔK which is the time difference between the time K and the time K' is calculated, and on the basis of ΔK, any one of the output signal of the light-receiving unit D3 and the output signal of the light-receiving unit D4 is shifted by AK, whereby the times of K and K' are made to be the same.

When the detection times of the scratch 2041 is made to be the same, the detection time difference of the pattern PP is an unknown time difference. Accordingly, the detection time of the scratch 2041 based on the output signal of the light-receiving unit D3 and the detection time of the scratch 2041 based on the output signal of the light-receiving unit D4 are made to be the same, and the difference between the output signal of the light-receiving unit D3 and the output signal of the light-receiving unit D4 is calculated. Then, the output signal from which the abnormal output caused by the scratch 2041 is eliminated can be obtained. Using the output signal thus obtained, the detection processing of the pattern PP as explained above is performed, so that even when there is a scratch or stain on the intermediate transfer belt 2040, the deviation of the position can be adjusted accurately.

Further, using the output signal obtained by subtracting the output signal caused by the scratch 2041 (output signal obtained by correcting, with ΔK, the output signal of any one of the light-receiving units D3 and D4), the amount of the deviation of the position is calculated as explained above, and in accordance with the result, the image forming condition is adjusted, whereby the image forming condition can be adjusted with a still higher degree of accuracy.

Fifth Embodiment of Image Forming Apparatus

Subsequently, still another embodiment of an image forming apparatus according to the present invention will be explained. In the embodiments explained above, the output signals of the two adjacent light-receiving units (D3 and D4) to determine whether there is any abnormal output due to the scratch 2041 superimposed on the output signal. The present embodiment is not limited to the use of only the adjacent light-receiving units.

The output signals of two light-receiving units at positions away from each other (for example, a light-receiving unit D2 and a light-receiving unit D5) may be used to determine whether there is any abnormal output due to the scratch 2041. In this case, in accordance with the number of light-receiving units causing abnormal output, it is possible to determine not only whether there is the scratch 2041 or not but also the range where the scratch 2041 extends, and therefore, the size of the scratch in the main scanning direction can also be roughly determined.

The number of light-emitting units Ei which are to be turned on is determined on the basis of the size of the scratch 2041 which is the determined detected object, and using multiple output signals from the light-receiving units Di corresponding to the light-emitting units Ei which are turned on, the amount of the deviation of the position is calculated as described above, and by adjusting the image forming condition in accordance with the result, the image forming condition can be adjusted with a still higher degree of accuracy.

In each of the above embodiments, when the size of the scratch 2041, i.e., the detected object, on the intermediate transfer belt 2040 is detected, information about the size may be stored to a storage unit, not illustrated, and when the size of the scratch 2041 detected over time is more than a predetermined threshold value or the difference from the size of the scratch 2041 detected in the past is more than a predetermined threshold value, it may be possible to notify that the scratch 2041 is becoming larger, using a notification unit, not illustrated, provided with the image forming apparatus 2000. Accordingly, even when it is possible to disregard a small scratch 2041, abnormality can be notified by detecting the change of the size of the scratch 2041 in advance if the scratch 2041 becomes larger over time.

According to the image forming apparatus of the embodiments explained above, when optical detection unit is used to correct the positional deviation of the toner image, the effect of the scratch or the like can be eliminated even if abnormal output of the reflected light caused by the scratch or stain in the detection portion is superimposed on the output signal of the normal reflected light. Therefore, even color deviation that cannot be corrected in the past can be corrected, and the accuracy of adjustment of the image forming condition can be enhanced.

Abnormality Determination Method 2 on Moving Member

Subsequently, still another embodiment of abnormality determination method on a moving member with the image forming apparatus according to the present invention will be explained. As explained above, with the change of the output signal of the image sensor 2245, it is possible to determine whether there is an abnormality, e.g., a scratch or a stain on the intermediate transfer belt 2040 which is the moving member. When the abnormality determination processing is performed outside of the detection timing of the pattern PP, whether there is an abnormality on the intermediate transfer belt 2040 can be determined in advance before the pattern PP is formed.

The abnormality determination processing may be carried out, for example, immediately after the power is turned on or before step S303 of the image forming process control processing (see FIG. 19). It is impossible to know, in advance, the timing when the scratch or stain attaches to the intermediate transfer belt 2040, and therefore, it is desired to increase the frequency of abnormality determination processing in order to determine the abnormality with a high degree of accuracy. However, while the abnormality determination processing is performed, image forming processing (for example, print processing) cannot be executed, and therefore, if the frequency of the abnormality determination processing is too high, the yield would be reduced. Accordingly, in accordance with the yield and the state of use of the image forming apparatus, it is preferable to configure the frequency of the abnormality determination processing.

Figure 48:
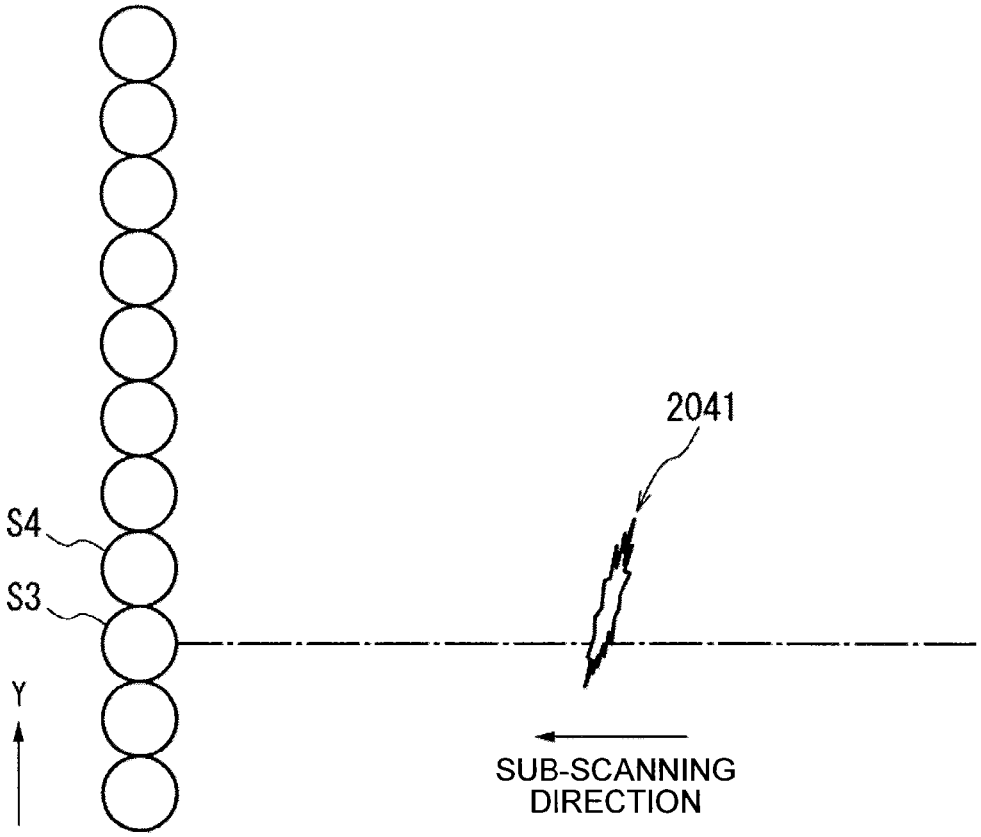
FIG. 48 is a top view for explaining relationship of the positions of an abnormality generated in the intermediate transfer belt and the light spot formed by the image sensor.

FIG. 48 illustrates an example of scratch 2041 generated before the pattern PP for detection of the deviation of the position is formed on the intermediate transfer belt 2040. The central position in the main scanning direction where the pattern PP is formed is known, and therefore, the reflected light with the light spots S3 and S4 used for detecting the pattern PP may be used to detect the scratch 2041.

As illustrated in FIG. 48, suppose that the scratch 2041 is attached to the position, in the main scanning direction, of the light spot S3 formed by the light-emitting unit E3 and the light spot S4 formed by the light-emitting unit E4. In FIG. 48, the size of the scratch 2041 is exaggerated for the sake of explanation.

With predetermined timing when the pattern PP is not formed, the light-emitting unit E3 and the light-emitting unit E4 are turned on in order while the intermediate transfer belt 2040 is rotated. In synchronization with the ON state, sampling is performed for the output signals of the light-receiving units D1 to D6.

Figure 49:
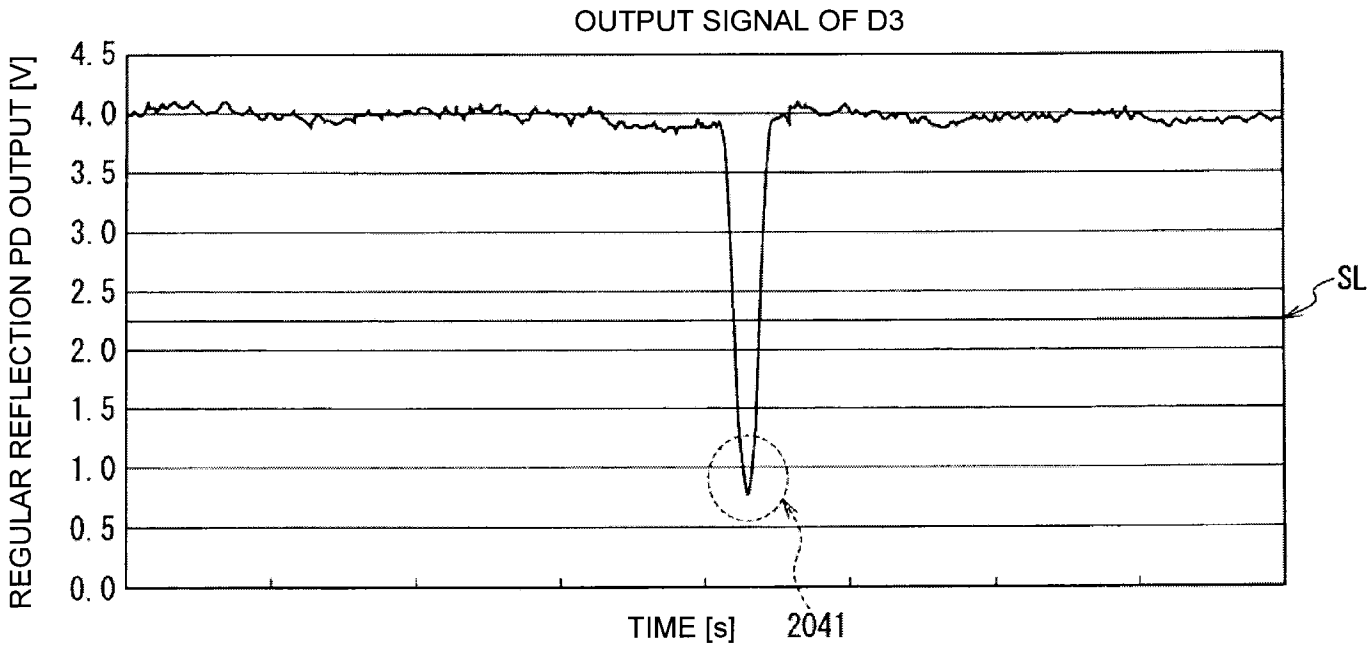
FIG. 49 is a graph illustrating another example of an output signal of the light-receiving unit of the image sensor.
Figure 50:
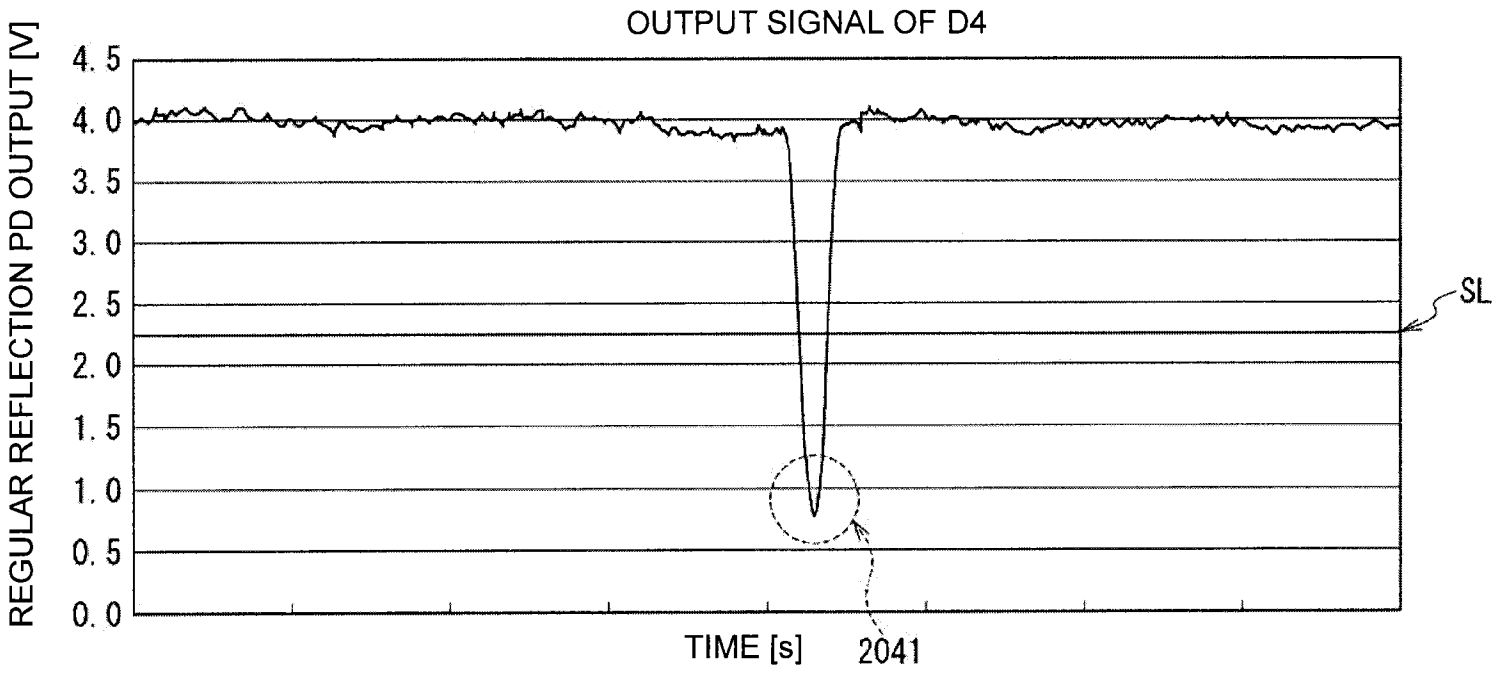
FIG. 50 is a graph illustrating still another example of an output signal of the light-receiving unit of the image sensor.

FIG. 49 illustrates an example of an output signal sampled by the light-receiving unit D3 when the light-emitting unit E3 is turned on. Unless there is an abnormality on the intermediate transfer belt 2040, the output signal of the light-receiving unit D3 becomes substantially constant. In FIG. 49, the output signal level of the light-receiving unit D3 caused by the reflected light from the non-abnormal portion on the intermediate transfer belt 2040 is about 4 v. With the timing when the reflected light from the scratch 2041 is received, the level of the output signal is reduced. Likewise, FIG. 50 illustrates an example of an output signal sampled by the light-receiving unit D4 when the light-emitting unit E4 is turned on. Unless there is an abnormality on the intermediate transfer belt 2040, the output signal of the light-receiving unit D4 becomes substantially constant, but with the timing when the reflected light from the scratch 2041 is received, the level of the output signal of the light-receiving unit D4 is reduced.

As already explained above, the light-emitting unit E3 and the light-emitting unit E4 are turned on in order with a predetermined time difference, and therefore, the output signal of the light-receiving unit D4 is delayed in terms of time with respect to the output signal of the light-receiving unit D3. Therefore, the waveform of the output signal of the light-receiving unit D3 (FIG. 49) and the waveform of the output signal of the light-receiving unit D4 (FIG. 50) are difference in terms of time. However, the time difference is known, and therefore, the time position of any one of the output signal of the light-receiving unit D3 and the output signal of the light-receiving unit D4 is corrected using the known time difference, and then, a difference between the output signal of the light-receiving unit D3 and the output signal of the light-receiving unit D4 is derived. When there is no abnormality on the intermediate transfer belt 2040, the difference is considered to be zero. It is to be understood that the reflected lights from the intermediate transfer belt 2040 which is a moving member are not completely in the same state, and therefore, even if the time position is corrected, the difference of the output signals of the light-receiving unit D3 and the light-receiving unit D4 is not completely zero.

More specifically, the time difference between the output signal of the light-receiving unit D3 and the output signal of the light-receiving unit D4 is corrected and the difference is derived, and if the differential signal thereof is not substantially zero, it can be determined that there is an abnormality on the intermediate transfer belt 2040.

Figure 51:
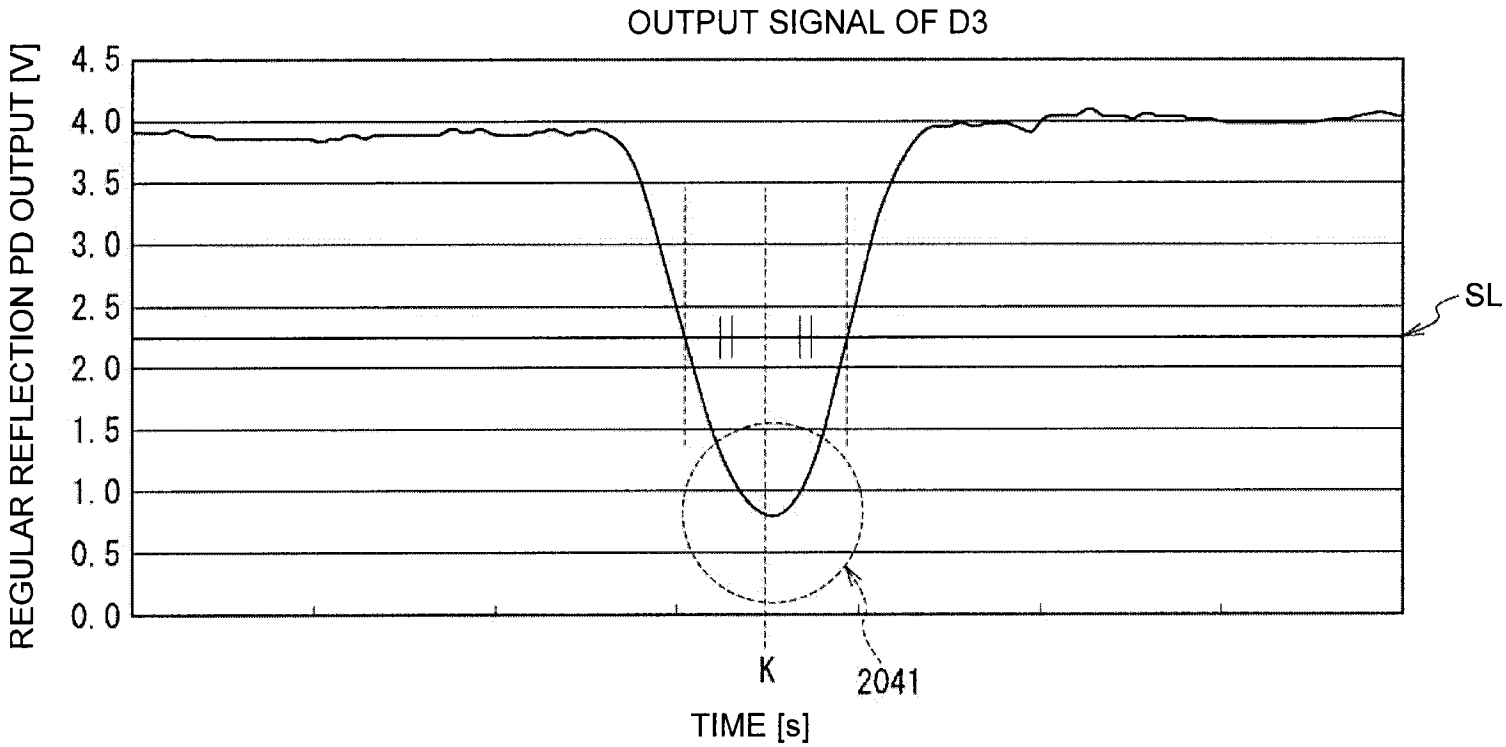
FIG. 51 is an enlarged graph illustrating a portion of another example of the output signal of the light-receiving unit of the image sensor.
Figure 52:
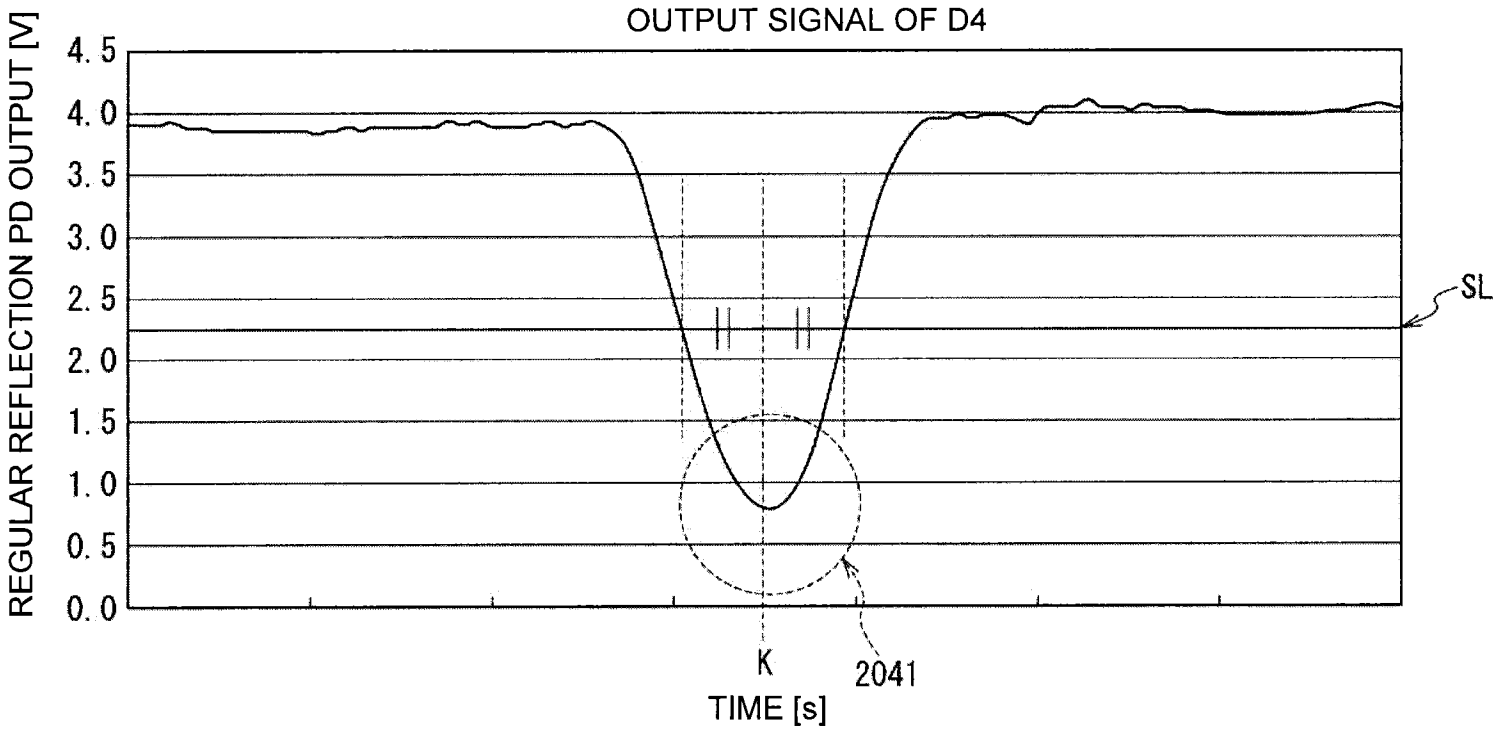
FIG. 52 is an enlarged graph illustrating a portion of another example of the output signal of the light-receiving unit of the image sensor.

FIGS. 51 and 52 illustrate diagrams which enlarge the output signal of a portion related to the scratch 2041 of the output signal as illustrated in FIGS. 49 and 50. Since the light emission timing of the light-emitting unit E3 and the light-emitting unit E4 is known, a detection time K related to the output signal of the light-receiving unit D3 when the reflected light by the scratch 2041 is received can be calculated. Likewise, a detection time K related to the output signal of the light-receiving unit D4 when the reflected light by the scratch 2041 is received can be calculated.

Now, an output signal obtained when the intermediate transfer belt 2040 is changed or deformed (tendency of curling) will be considered. When the intermediate transfer belt 2040 is changed or deformed, the amount of reflected light from the intermediate transfer belt 2040 is changed due to the effect of the change and deformation. However, in a direction perpendicular to the rotation direction of the intermediate transfer belt 2040 (main scanning direction), the change and deformation (tendency of curling) of the intermediate transfer belt 2040 occur at the same time. More specifically, the output signals of the light-receiving unit D3 and the light-receiving unit D4 in synchronization with the ON state of the light-emitting unit E3 and the light-emitting unit E4 are different in the waveforms in terms of time, the difference thereof is known. More specifically, the delay of light emission time δT of the light-emitting unit E3 and the light-emitting unit E4 is the time difference of the output signals of the light-receiving unit D3 and the light-receiving unit D4. More specifically, when the scratch 2041 as illustrated in FIG. 48 is parallel to the Y axis, the time difference between the detection times K and K' of the scratch 2041 is δT. However, the chance of the scratch 2041 generated in parallel to the Y axis is extremely low, and therefore, actually, no problem would be caused if determination is made as to whether it is the scratch 2041 or not on the basis of the time difference between the detection times K and K' of the scratch 2041.

Figure 53:
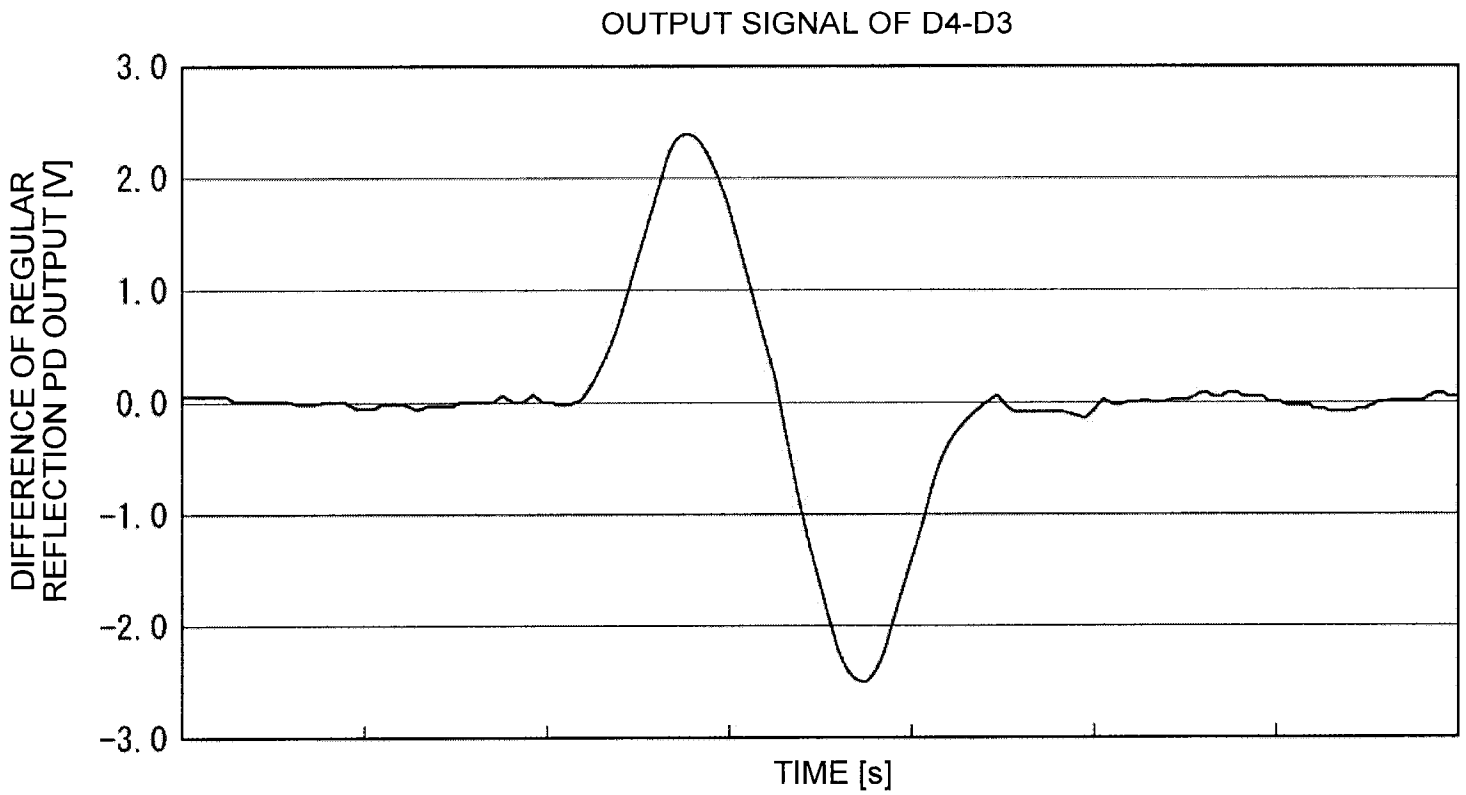
FIG. 53 is a graph illustrating another example of a difference of the output signal of the light-receiving unit of the image sensor.

FIG. 53 is an example of a differential signal of the output signal of the light-receiving unit D3 as illustrated in FIG. 51 and the output signal of the light-receiving unit D4 as illustrated in FIG. 52, and is a differential signal calculated after, with the delay of light emission time δT of the light-emitting unit E3 and the light-emitting unit E4, the time delay of them both is corrected and made the same.

As illustrated in FIG. 53, a portion of the output signal related to the reflected light from the intermediate transfer belt 2040 is almost zero as a result of subtraction. However, a portion of the output signal related to the reflected light from the scratch 2041 clearly appears as a high signal intensity. Using the output signals of the two light-receiving units as described above, the reflected light from the intermediate transfer belt 2040 can be clearly separated from the output of the reflected light from an unknown scratch 2041. For this reason, determination can be made as to whether there is abnormal output or not due to the unknown scratch 2041.

The difference of the detection time and the difference of the signal intensity are calculated, and when they are determined to be abnormal (i.e., when the difference is substantially zero), it may be determined that the scratch 2041 is generated. As described above, using the detection time difference and the signal intensity difference, the reliability of the abnormality determination can be enhanced. On the other hand, when at least one of the detection time difference and the signal intensity difference is determined to be abnormal, it is determined to be the scratch 2041, so that in this case, this can reduce the chance of failing to determine the scratch.

As described above, on the basis of the output signals of multiple light-receiving units Di, the scratch or stain on the intermediate transfer belt 2040 can be determined appropriately. The timing when the intermediate transfer belt 2040 is replaced may be determined on the basis of this determination result in a rational manner, and as a result, it is possible to provide the image forming apparatus that prevents abnormal image such as color deviation.

It should be noted that when it is determined that there is an abnormality on the intermediate transfer belt 2040, the output signals of the light-receiving unit D3 and the light-receiving unit D4 may be stored to a RAM 403 (see FIG. 2) which is a storage device.

Figure 54:
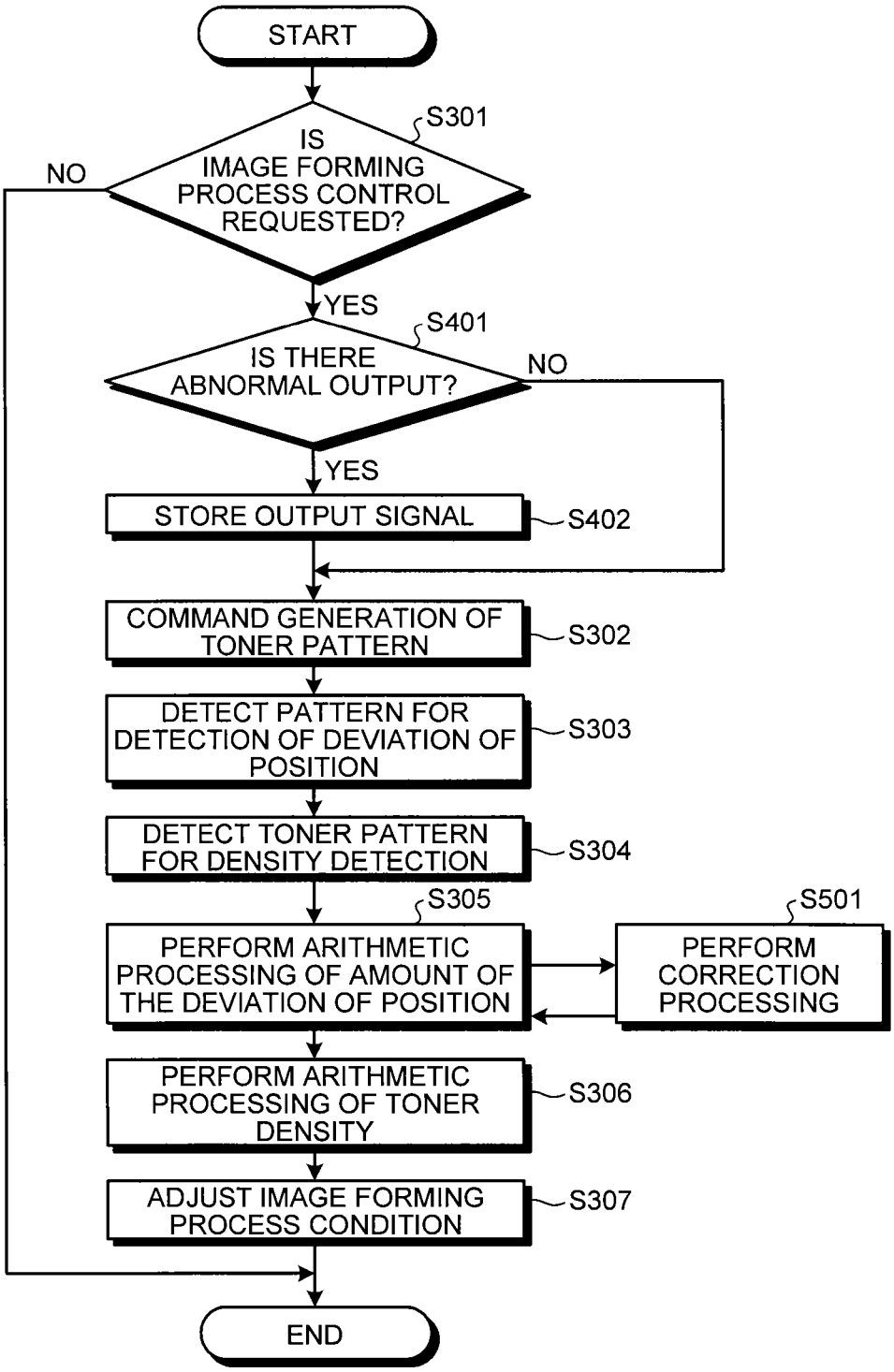
FIG. 54 is a flowchart illustrating another example of an image forming process control processing executed by the image forming apparatus.

Subsequently, still another example of image forming process control processing executed by the image forming apparatus according to the present invention will be explained with reference to a flowchart in FIG. 54. The image forming process control processing according to the present embodiment includes the same processing as the processing already explained with reference to FIG. 19. In the explanation below, the same symbols are used for the same processing as the processing already explained, and detailed description thereabout is omitted. In step S301, a determination is made as to whether the image forming process control is requested or not. When the image forming process control flag is determined to be set (YES in S301), the image forming process control flag is reset, and step S401 is subsequently performed. When the image forming process control flag is determined not to be set (NO in S301), the processing is terminated.

In step S401, determination is made as to whether there is an abnormality or not from the output signals of the light-receiving unit D3 and the light-receiving unit D4 on the basis of the processing already explained. When it is determined that there is "no abnormality" (NO in S401), step S303 is subsequently performed. On the other hand, when it is determined that there is an "abnormality" in step S401 (Yes in S401), S402 is subsequently performed. In step S402, processing is performed to store the output signal of the light-receiving unit Di to the storage device (RAM 403). After the output signal is stored to the light-receiving unit Di, step S302 is subsequently performed.

Now, an example of output signal stored in the RAM 403 will be explained. For example, the light-emitting unit E3 and the light-emitting unit E4 are turned on in order while the intermediate transfer belt 2040 moves one cycle (time Ta) in the state where the pattern PP for detection of the deviation of the position is not formed, sampling is performed for the output signals of the light-receiving units D1 to D6.

When it is determined that there is an "abnormality" in the determination processing already explained, the output signals from the light-receiving units Di in this period (one cycle of the intermediate transfer belt 2040) are stored to the RAM 403. The abnormality determination is made using the output signals for one cycle of the intermediate transfer belt 2040 thus stored, so that a determination can be made as to which timing it is determined that there is "abnormality". More specifically, it is possible to determine which position of the intermediate transfer belt 2040 the abnormality exists.

Still another example will be explained. The intermediate transfer belt 2040 is rotated for a predetermined number of times in the state where the pattern PP for position detection is not formed. For example, the light-emitting unit E3 and the light-emitting unit E4 are turned on in order at the same time Tb (<Ta) as the time when the pattern PP is detected, whereby sampling is performed for the output signals of the light-receiving unit D1 to the light-receiving unit D6. When it is determined that there is an "abnormality" as a result of the determination processing using the sampled output signals, the output signals from the light-receiving units Di in this period are stored to the RAM 403. In this case, which position of the intermediate transfer belt 2040 the time Tb at which the light-emitting unit Ei is turned on corresponds to may be separately detected and stored with an encoder provided in a driving roller and the like of the intermediate transfer belt 2040. This allows determining which position of the intermediate transfer belt 2040 the abnormality exists.

As described above, according to the image forming process control processing of the present embodiment, the output signals of the light-receiving system (light-receiving units Di) are stored to the storage device (RAM 403), so that not only whether or not there is an abnormality on the intermediate transfer belt 2040 which is the moving member but also the position of the intermediate transfer belt 2040 where the abnormality exists can be determined. When the pattern PP is formed with the result of the abnormality determination reflected, the pattern PP can be formed while avoiding abnormality in advance (S302).

After the pattern PP is formed (S302), the detection processing of the pattern PP for detection of the deviation of the position is performed (S303). Subsequently, the detection processing of the pattern DP for toner density detection is performed (S304). Subsequently, on the basis of a result of detection processing of the pattern PP for detection of the deviation of the position (S303), arithmetic processing for calculating the amount of the deviation of the position is performed (S305).

When it is determined that there is "no abnormal" in the arithmetic processing of the amount of the deviation of the position (S305), 5306 is subsequently performed. On the other hand, when it is determined that there is an "abnormality", S501 is subsequently performed. In step S501, the output signal related to the abnormal output stored in the RAM 403 is looked up, the correction processing of the output signals related to the pattern PP is performed.

The output signal as well as information associated with the position of the intermediate transfer belt 2040 are stored in the RAM 403. Accordingly, a determination is made as to whether the position where the pattern PP for detection of the deviation of the position overlaps the position of the abnormality detected in advance (scratch 2041). More specifically, a determination can be made as to whether the output signal related to the abnormality (scratch 2041) is superimposed on the output signal related to the pattern PP of the output signals of the light-receiving units Di.

In step S302, using information concerning the abnormality stored in step S402, the toner pattern may be generated while avoiding the position where the abnormality (scratch 2041) exists. However, according to the generation timing of the toner pattern defined in advance, the toner pattern is formed at the position of the abnormality (scratch 2041), so that when this is avoided, there may be waiting time. In this case, even when the toner pattern is formed with predetermined timing, and the toner pattern is superimposed on the abnormality (scratch 2041) in step S302, the output signal related to the abnormality is eliminated in the correction processing (S501). As a result, the arithmetic processing of the amount of the deviation of the position can be performed with a high degree of accuracy.

Figure 55:
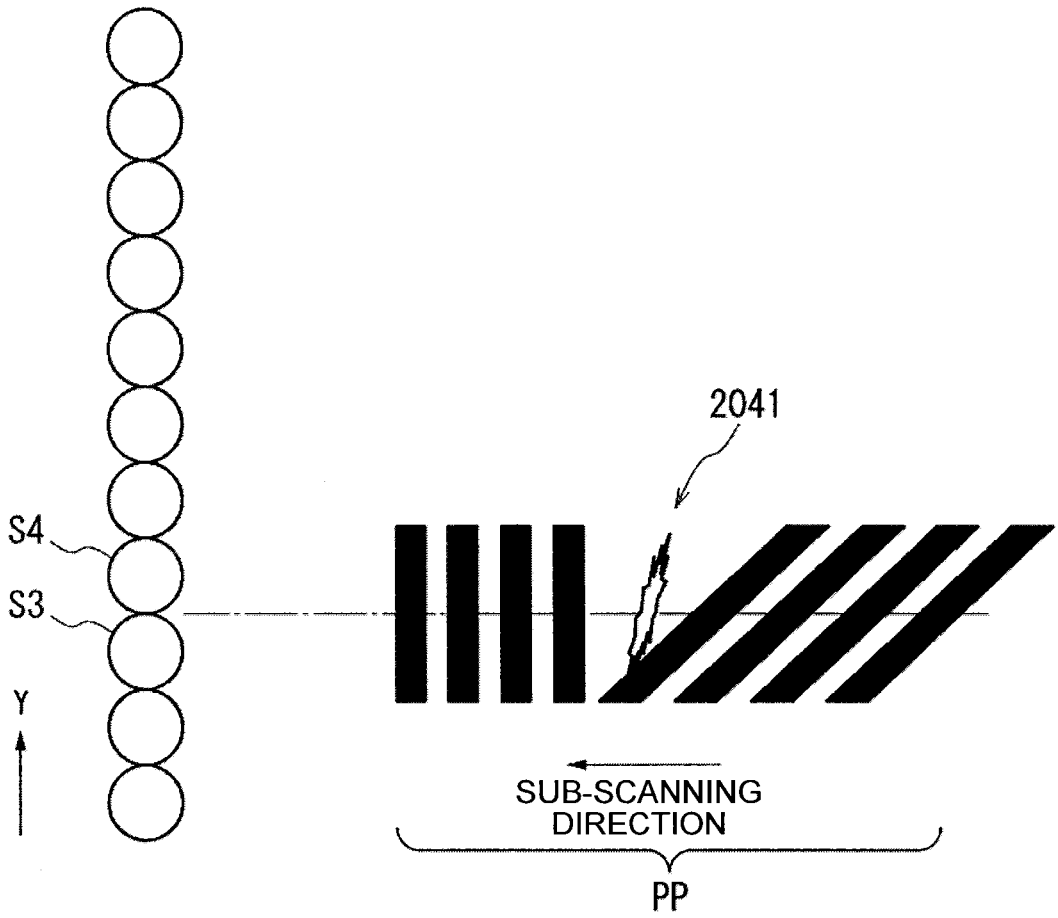
FIG. 55 is a top view for explaining relationship of the positions of the test pattern and the light spot formed by the image sensor.
Figure 56:
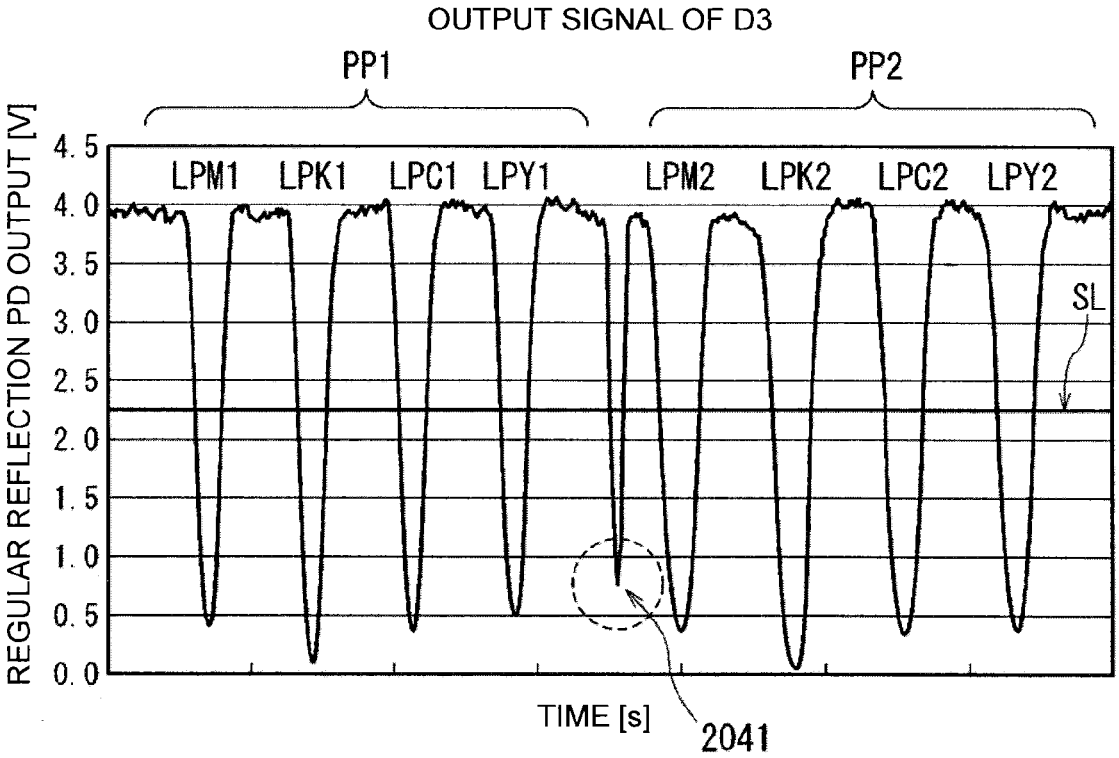
FIG. 56 is a graph illustrating still another example of an output signal of the light-receiving unit of the image sensor.

An example of correction of the output signal will be explained. Suppose that the output signal illustrated in FIG. 49 is stored to the RAM 403 which is the storage device. FIG. 55 illustrates an example of state where the image forming process control processing is executed and the pattern PP for detection of the deviation of the position formed in step S303 is superimposed on the scratch 2041. FIG. 56 illustrates an example of output signal of the light-receiving unit D3 that is obtained by sampling the output signals of the light-receiving units D1 to D6 by turning on the light-emitting unit E3 and the light-emitting unit E4 in order in synchronization with the timing when the pattern PP passes the illumination region. The output signal level is reduced between the first pattern group PP1 and the second pattern group PP2, and this reduction of the output signal level is not caused by the pattern PP. This is the variation of the output level due to the scratch 2041.

Figure 57:
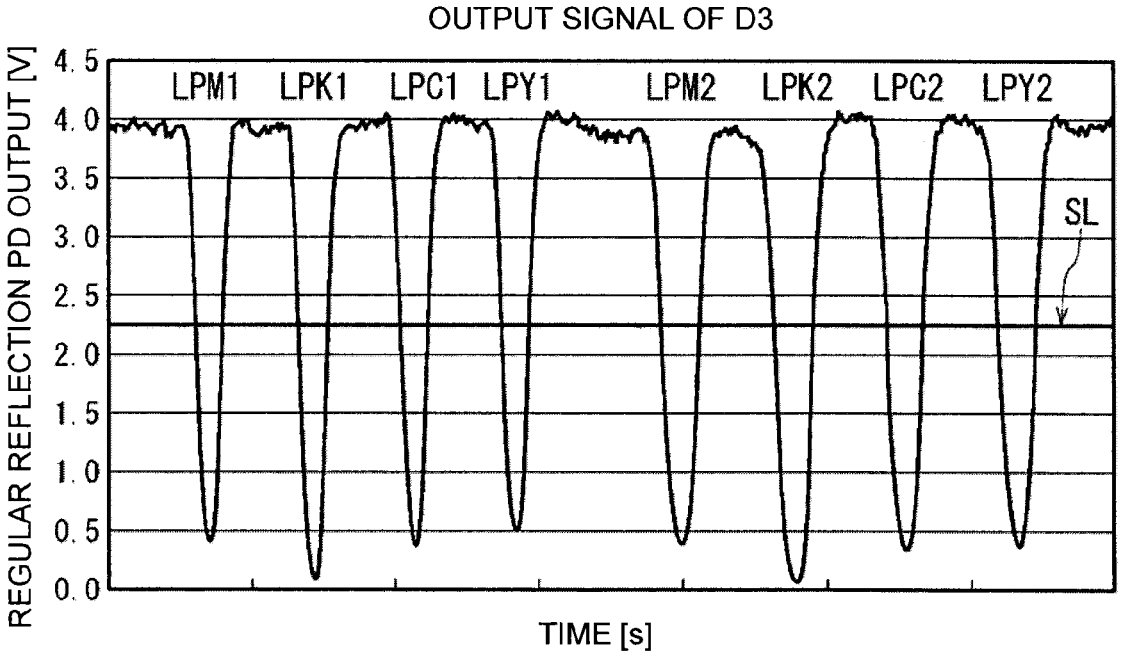
FIG. 57 is a graph illustrating an example of a light-receiving unit output signal corrected by the image forming process condition adjustment processing.

In this case, in step S305, the arithmetic processing of the amount of the deviation of the position is executed, and then it is determined that there is an "abnormality". Then, step S501 is subsequently performed, the abnormal output signal (FIG. 49) stored in the storage device (RAM 403) looked up on the basis of the output signal (FIG. 56) superimposed on the abnormal output, and the correction processing is performed to subtract the abnormal output signal (FIG. 49) from the output signal (FIG. 56) (S501). FIG. 57 illustrates an example of output signal obtained in the correction processing. As illustrated in FIG. 57, the portion of the abnormal output due to the scratch 2041 disappears, and using the corrected output signal, the amount of the deviation of the position of the pattern PP is calculated in step S305.

The image forming process condition is adjusted in S307 in accordance with the amount of the deviation of the position thus calculated. As described above, according to the color printer 2000 of the present embodiment, the effect of the scratch 2041 superimposed on the pattern PP for detection of the deviation of the position is eliminated appropriately, and the amount of the deviation of the position can be detected accurately.

In each of the above embodiments, the moving member is the intermediate transfer belt 2040, and the abnormal output related to the scratch 2041 on the intermediate transfer belt 2040 is determined, but the cause of the abnormal output is not only the scratch but also a smear caused by attached paper particles, toner, and foreign objects. When dust may enter between the intermediate transfer belt 2040 and the roller rotating the intermediate transfer belt 2040, and the scratch is made on the roller, the abnormal output may be generated. According to the embodiments explained above, abnormal output different from the reflected light of the pattern PP for position detection can also be determined.

According to each of the above embodiments, the surface of the intermediate transfer belt 2041 is considered to be smooth, and the reflection by the surface of the intermediate transfer belt 2041 is considered to be only regular reflection. However, the image forming apparatus according to the present invention is not limited thereto, and the surface of the intermediate transfer belt 2041 may diffusely reflect the emitted light. When scratch, stain, or the like has diffusion reflection characteristics which are different from the intermediate transfer belt 2040, detection can be made with the regular-reflected light. Therefore, in this case, an image sensor for detecting the diffusely reflected light may be used.

Figure 45:
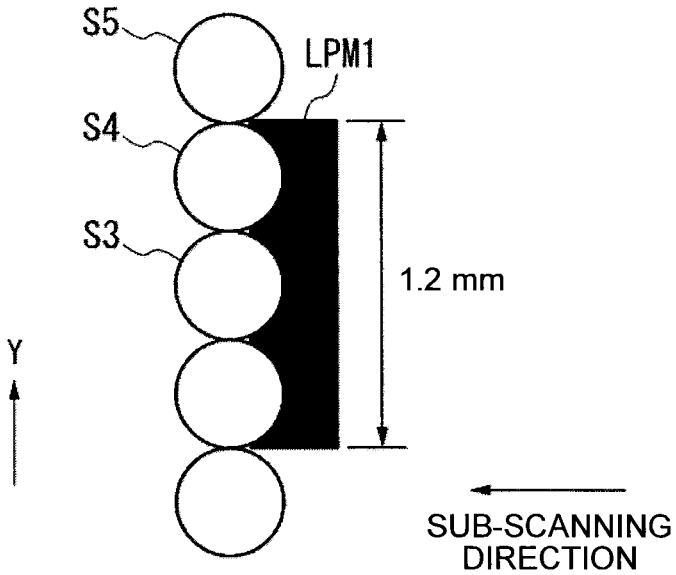
FIG. 45 is a diagram illustrating an example of a light spot formed by the image sensor.

In the explanation about each of the above embodiments, the length of the pattern PP for position detection in the main scanning direction is 1 mm. However, the image forming apparatus according to the present invention is not limited thereto. For example, as illustrated in FIG. 42, the length of the pattern PP in the main scanning direction is 1.2 mm. In this case, as illustrated in FIG. 45, the pattern PP may be detected using the reflected lights of the light spots S3, S4, S5 formed by the lights emitted from the three light-emitting units (for example, E3, E4, E5).

Figure 46:
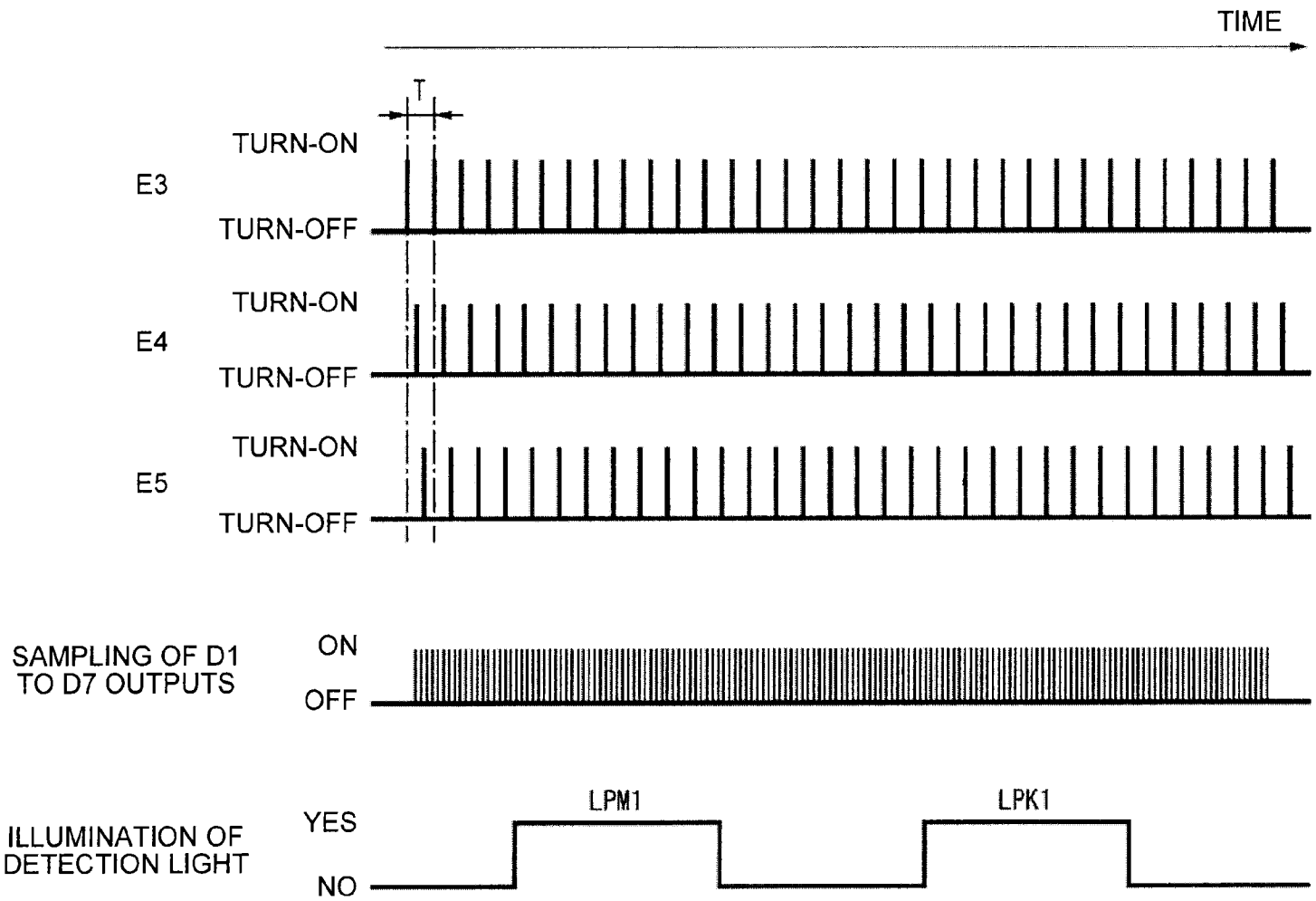
FIG. 46 is a timing chart illustrating an example of light emission timing of the image sensor.

At this occasion, in the control for turning on the three light-emitting units E3, E4, E5, the ON/OFF control may be performed in a time divisional manner with predetermined time T as illustrated in FIG. 46. Accordingly, the accuracy of detection can be further improved by averaging the calculation results of the deviations of the positions obtained from the reflected lights from the light-emitting units. Further, the detection accuracy may be further improved by removing the maximum value, the minimum value, or abnormal values from the detection results.

Figure 47:
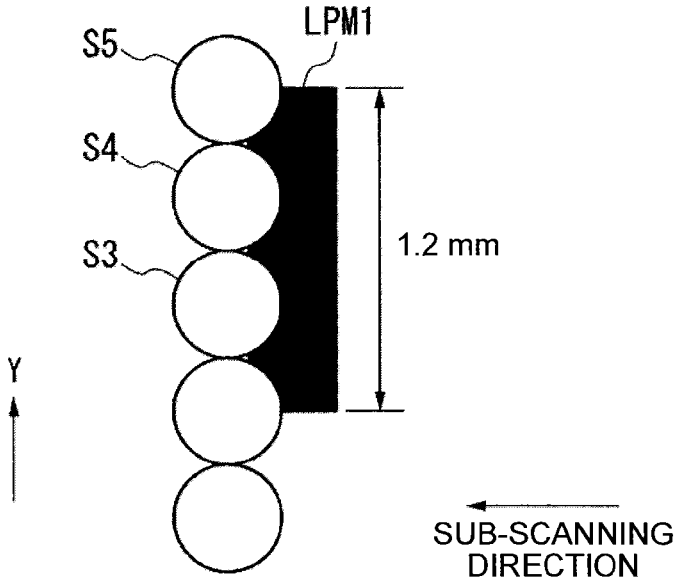
FIG. 47 is a diagram illustrating an example of a light spot formed by the image sensor.

In this case, as illustrated in FIG. 47, the two light-emitting units (for example, E3, E4) may be the light-emitting units which are turned on. The light-receiving units D3 and D4 receive the reflected lights from the light spots S3, S4 which are emitted and formed by the light-emitting units E3 and E4, and the output signals which are output from the light-receiving units D3 and D4 are averaged, so that the detection accuracy of the test pattern can be improved using the result obtained for each light-emitting unit E.

In each of the above embodiments, the number of light-emitting units and the number of light-receiving units are only examples, and are not limited thereto. The upper limit may be determined appropriately in accordance with the detection range in the main scanning direction with the image sensor.

In the explanation about each of the above embodiments, the eleven illumination micro lenses (LE1 to LE11) and the eleven light-receiving micro lenses (LD1 to LD11) are integrally formed, but the embodiments are not limited thereto.

In the explanation about each of the above embodiments, all the reflection-type optical sensors have the same number of light-emitting units, but the embodiments are not limited thereto.

In each of the above embodiments, the reflection-type optical sensor may be provided with a processing device, and at least a portion of the processing in the printer control device 2090 may be performed by the processing device.

In each of the above embodiments, at least a portion of the processing in the printer control device 2090 may be performed by a scanning control device.

In the explanation about each of the above embodiments, four colors of toners are used, but the embodiments are not limited thereto. For example, five or six colors of toners may be used.

In the explanation about each of the above embodiments, the image sensor 2245 detects the toner pattern on the intermediate transfer belt 2040, but instead of this, the toner pattern on the surface of the photosensitive drum may be detected. The surface of the photosensitive drum is almost regular reflection body, just like the intermediate transfer belt 2040.

In the explanation about each of the above embodiments, the intermediate transfer-type image forming apparatus is such that the image forming apparatus once transfers the toner image on the photosensitive drum to the intermediate transfer belt, and transfers the toner image from the intermediate transfer belt to a sheet-shaped recording medium. However, the present invention is not limited thereto. For example, a direct transfer-type image forming apparatus may be used to directly transfer a toner image on a photosensitive drum onto a sheet-shaped recording medium. In this case, a direct transfer belt which is an endless belt for conveying the sheet-shaped recording medium is a moving member.

In the explanation about each of the above embodiments, the image forming apparatus is the color printer 2000, but the embodiments are not limited thereto. The image forming apparatus may be an image forming apparatus other than a printer such as, a copier, a facsimile machine, or an MPF having them integrally.

In each of the above embodiments, the detection processing of the deviation of the position and the detection processing of the toner density may be performed in the opposite order. In this case, the toner pattern is formed in accordance with the order.

In each of the above embodiments, a pattern for estimating the position of the toner pattern in the main scanning direction may be formed.

According to the embodiment, the position of the test pattern formed on the moving member can be detected more accurately, and the image forming condition of the image forming apparatus is corrected more accurately, thus preventing deviation of the output image.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus that forms, on a surface of a moving member moving in a first direction, an image under an image forming condition in accordance with image information, the image forming apparatus comprising:

a reflection-type optical sensor including an emission system including light emitters arranged in a second direction perpendicular to the first direction and a light-receiving system including light receivers that receive reflected light resulting from reflection of emission light emitted from the emission system at the surface of the moving member; and a determination device that determines whether there is an abnormality on the surface of the moving member on the basis of output signals from at least two or more of the light receivers, wherein the emission system and the light receiving system are arranged such that reflected light from the moving member originating from a plurality of the light emitters in the emission system is received by a plurality of the light receivers such that the plurality of the light receivers each receives light from multiple ones of the plurality of the light emitters.

2. The image forming apparatus according to claim 1, wherein the determination device determines whether there is abnormal output that is different from reflected light output from a test pattern for position detection, on the basis of output signals from at least two or more light receivers receiving reflected light reflected by the test pattern for position detection on the surface of the moving member.

3. The image forming apparatus according to claim 2, wherein the determination device determines whether there is abnormal output or not, on the basis of output signals from at least two or more light receivers when at least two or more light emitters are turned on and the test pattern for position detection is illuminated.

4. The image forming apparatus according to claim 2, wherein the determination device determines whether there is abnormal output or not, on the basis of difference in output timing between the output signals from at least two or more light receivers.

5. The image forming apparatus according to claim 2, wherein the determination device determines whether there is abnormal output or not, on the basis of difference in intensity between the output signals from at least two or more light receivers.

6. The image forming apparatus according to claim 2 comprising a first processing device that corrects an output signal from the light-receiving system, on the basis of a determination result of whether the abnormal output exists or not.

7. The image forming apparatus according to claim 6, wherein a first processing device detects deviation of a position in the test pattern for position detection on the basis of the corrected output signal from the light-receiving system, and adjusts the image forming condition in accordance with the detection result.

8. The image forming apparatus according to claim 2 comprising a storage device storing an output signal from the light-receiving system on the basis of a determination result of whether the abnormal output exists or not.

9. The image forming apparatus according to claim 8 comprising a second processing device that corrects output signals from multiple light receivers receiving reflected light reflected by the test pattern for position detection, using the output signal stored in the storage device.

10. The image forming apparatus according to claim 9, wherein the second processing device detects deviation of a position in the test pattern for position detection on the basis of the corrected output signal from the light receiver, and adjusts the image forming condition in accordance with the detection result.

11. An image forming apparatus according to claim 1, wherein the emission system includes at least three light emitters arranged along the second direction, and the light-receiving system includes at least three light receivers.

12. The image forming apparatus according to claim 11, wherein a number of light receivers is equal to a number of light emitters, and the light emitters and the light receivers correspond to each other in one-to-one manner.

13. The image forming apparatus according to claim 1, wherein when there is a detected object on the surface of the moving member, the determination device determines a size of the detected object on the basis of number of light receivers detecting reflected light output from the detected object.

14. The image forming apparatus according to claim 13, wherein a processing device adjusts an image forming condition on the basis of the determined size of the detected object.

15. The image forming apparatus according to claim 13 comprising:

a memory that stores information about the determined size of the detected object; and a processor that determines change of the information about the size of the detected object stored in the memory over time, and notifies abnormality on the basis of the information change determination result.

* * * * *